United States Patent [19]

Tanaka et al.

[11] Patent Number: 4,989,644

[45] Date of Patent: Feb. 5, 1991

[54] AUTOMATIC MISPICKED WEFT YARN REMOVAL SYSTEM FOR A FLUID JET LOOM

[75] Inventors: Kazuhiro Tanaka, Ome; Masayuki Koriyama, Tokyo; Jotaro Uehara, Higashikurume; Keizo Shizuka, Tokyo; Kimimasa Onishi, Hichioji, all of Japan

[73] Assignee: Nissan Motor Co., Ltd., Yokohama, Japan

[21] Appl. No.: 341,403

[22] Filed: Apr. 21, 1989

[30] Foreign Application Priority Data

Aug. 6, 1988 [JP] Japan ..... 63-196979

[51] Int. Cl.[5] ..... D03D 47/30; D03D 47/34

[52] U.S. Cl. ..... 139/116.2; 139/435.4; 139/452

[58] Field of Search ..... 139/116.2, 435.4, 452, 139/194

[56] References Cited

U.S. PATENT DOCUMENTS

| | | | |
|---|---|---|---|
| 4,378,821 | 4/1983 | Umezawa | 139/452 |
| 4,620,570 | 11/1986 | Suzuki | 139/116 A |
| 4,730,643 | 3/1988 | Tamatani | 139/116 A |
| 4,749,006 | 6/1988 | Miyamoto | 139/116 A |
| 4,766,937 | 8/1988 | Kojima et al. | 139/452 |

FOREIGN PATENT DOCUMENTS

| | | |
|---|---|---|
| 62-57969 | 3/1962 | Japan . |
| 62-144159 | 9/1962 | Japan . |
| 59-228047 | 12/1984 | Japan . |
| 61-47849 | 3/1986 | Japan . |
| 62-250251 | 10/1987 | Japan . |
| 60-2749 | 1/1989 | Japan . |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

A weft treatment system and method for removing a mispicked weft yarn from a weft path of a fluid jet loom of the type wherein a weft yarn from a weft supply member is introduced through a weft storage unit to a weft inserting nozzle to be picked. With this system and method, a mispicked weft yarn is detected when mispick occurs. Then, the operation of a cutter and weaving operation of the loom are stopped. Subsequently, the loom is reversely run to expose the mispicked weft yarn at the cloth fell of a woven fabric. More specifically, the weft winding arm is reversely rotated around the storage drum to unwind the weft yarn on the drum. The thus exposed mispicked weft yarn is drawn through the weft storage unit by a weft traction device disposed between the weft supply member and the weft storage unit.

46 Claims, 40 Drawing Sheets

AUTOMATIC MISPICKED WEFT YARN REMOVAL SYSTEM FOR A FLUID JET LOOM

BACKGROUND OF THE INVENTION

1. Field of the Invention

This invention relates to a weft treatment system and method in a fluid jet loom for treating a weft yarn when mispick or the like occurs during loom operation, and more particularly to a device and process of automatically removing a faulty or mispicked weft yarn from the path of the weft yarn to be picked.

2. Description of the Prior Art

In a fluid jet loom, a weft yarn is picked from a weft inserting or main nozzle into the shed of warp yarns so that the weft yarn flies from the weft picking side to the counter-weft picking side under the influence of an air jet ejected from the weft inserting nozzle. During such weft picking, mispick often occurs where the weft yarn from the weft inserting nozzle does not reach the counter-weft picking side. Additionally, a weft yarn occurs on the upstream side of the weft inserting nozzle. It is necessary to remove such a faulty weft yarn from the path of the weft yarn to be picked, prior to restarting of the loom.

Such removal treatment of faulty weft yarn is disclosed, for example, in Japanese Patent Provisional Publication No. 59-228047. The method of weft yarn removal treatment of this publication is as follows: (a) Mispick, where the leading end of the picked weft yarn does not reach the counter-weft picking side is detected. (b) Operation of the loom is stopped. (c) The loom is run in reverse thereby exposing the mispicked weft yarn at the cloth fell of a woven fabric. (d) The mispicked weft yarn is extracted from the shed of warp yarns to the weft picking side by a weft yarn separating device. (e) The extracted mispicked weft yarn is sucked by a suction nozzle disposed between the weft inserting nozzle and the array of the warp yarns. (f) The sucked mispicked yarn is cut at a position between the suction nozzle and the weft inserting nozzle, thus removing the mispicked weft yarn.

However, with the above weft yarn removal treatment method, it is required to reciprocally move the weft yarn separating device in the direction the width of the woven fabric within the shed of the warp yarn shed, and to move the suction nozzle from its withdrawal position to its operational position between the weft inserting nozzle and the warp yarn array. This results in a large and complicated weft yarn removal mechanism, thereby complicating a control system for the removal mechanism.

SUMMARY OF THE INVENTION

It is an object of the present invention to provide an improved weft treatment system and method for a fluid jet loom, which is simple in construction and in control for making a secure faulty weft yarn removal operation.

Another object of the present invention is to provide an improved weft treatment system and method for a fluid jet loom, by which removal of a faulty weft yarn is effectively carried out without using a mechanism largely movable to the path of the weft yarn to be picked.

A further object of the present invention is to provide an improved weft treatment system and method for a fluid jet loom, in which a faulty weft yarn is removed by forcing it along a part of a path of weft yarn to be picked.

The weft treatment system and method for a fluid jet loom, of the present invention is arranged as follows: (a) A faulty weft yarn is detected. (b) Operation of the loom is stopped. (c) The faulty weft yarn is forced along a part of a path of the weft yarn to be picked thereby removing the faulty weft yarn. Preferably, the faulty weft yarn is drawn through a weft storage unit by a weft traction device disposed between the weft storage device and a weft supply member.

Accordingly, removal treatment of the faulty weft yarn can be accomplished, for example, merely by having the weft traction device disposed between the weft supply member and the weft storage unit. This simplifies the construction and control of a mechanism for faulty weft yarn removal treatment thereby facilitating operation of the loom. Besides, mechanisms around the weft storage unit are simplified and therefore maintenance thereof easing. Furthermore, the removal of the faulty weft yarn is automatically achieved by the weft traction device which is operated in a stationary state relative to the path of the weft yarn to be picked.

BRIEF DESCRIPTION OF THE DRAWINGS

In the drawings, like reference numerals designate like elements and parts throughout all figures, in which.

DETAILED DESCRIPTION OF THE INVENTION

Referring now to FIGS. 2 to 5, there is shown a weft picking system including a first embodiment of a weft treatment system in a fluid jet loom.

The weft picking system is generally arranged and operated as follows: A weft yarn W drawn from a yarn supply member or bobbin 15 is inserted into a pipe-shaped weft winding arm 10*a* of a weft storage unit 10. The tip end section of the weft winding arm 10*a* moves or rotates around a drum 10*b* of the weft storage unit. Accordingly, the weft yarn W from the weft winding arm 10*a* is wound on the drum 10*b* for the purpose of being measuring and stored by a predetermined length prior to weft picking. The weft yarn W wound on the drum 10*b* is passed through into a weft inserting nozzle (or main nozzle) 11. The weft inserting nozzle 11 is adapted to eject air jet therefrom in order to project the weft yarn W under influence of the air jet. The thus projected weft yarn W is inserted or picked into the shed formed in the array of warp yarns Y, thereby accomplishing a weft picking or insertion. During this weft picking, the air jet from the weft inserting nozzle 11 is enhanced and assisted by air jets ejected from a plurality of auxiliary nozzles 20 disposed along the insertion path of the weft yarn W. A measuring pawl 10*c* is provided to be inserted into and released (withdrawn) from the drum 10*b* in such a manner as to be engaged with and released from the weft yarn W wound on the drum 10*b*. The measuring pawl 10*c* is adapted to be released from the drum 10*b* to be disengaged from the weft yarn during weft picking, while inserted into the drum to be engaed with the weft yarn to stop weft picking. Such a weft picking system is well known as disclosed in U.S. Pat. No. 4,378,821 entitled "Weft Detaining Device of Shuttleless Loom". Additionally, a weft storage unit similar to the above-mentioned is disclosed in U.S. Pat. No. 4,766,937 entiled "Weft Storage Device".

The weft treatment system is operated according to a weft treatment method generally summarized as follows:

1st stage . . . A mispicked or faulty weft yarn is detected.

2nd state . . . Cutting function for weft yarn is stopped.

3rd stage . . . Operation of the loom is stopped.

4th stage . . . The loom is reversely run in order to expose the mispicked weft yarn at the cloth fell.

5th stage . .. A weft yarn including the exposed mispicked weft yarn is drawn through the weft storage unit under action of a weft traction device which is disposed between said weft storage unit and the weft supply member.

6th stage . . . A weft yarn is inserted into the weft inserting nozzle (or main nozzle) from the weft traction device through the weft storage unit under influence of fluid jet from a weft supply nozzle disposed at the inlet side of the weft traction unit and under suction of the inlet of the weft inserting nozzle.

The above-mentioned 1st to 6th stages will be discussed in detail hereinafter with reference to FIGS. 1A to 5.

Figure 1A:
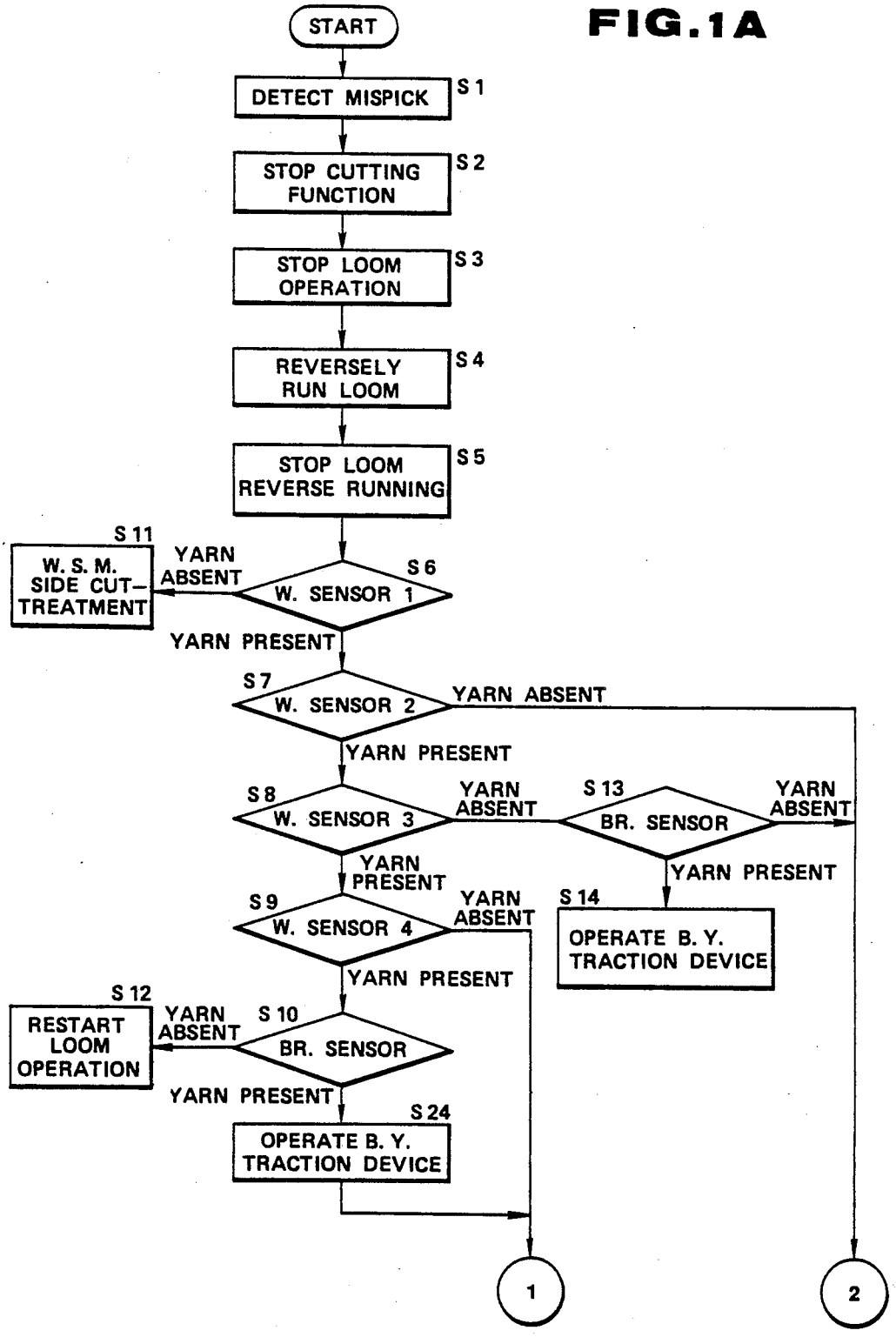
FIGS. 1A to 1C are flowcharts of processing of weft treatment of a first embodiment of a weft treatment system and method in accordance with present invention.
Figure 1B:
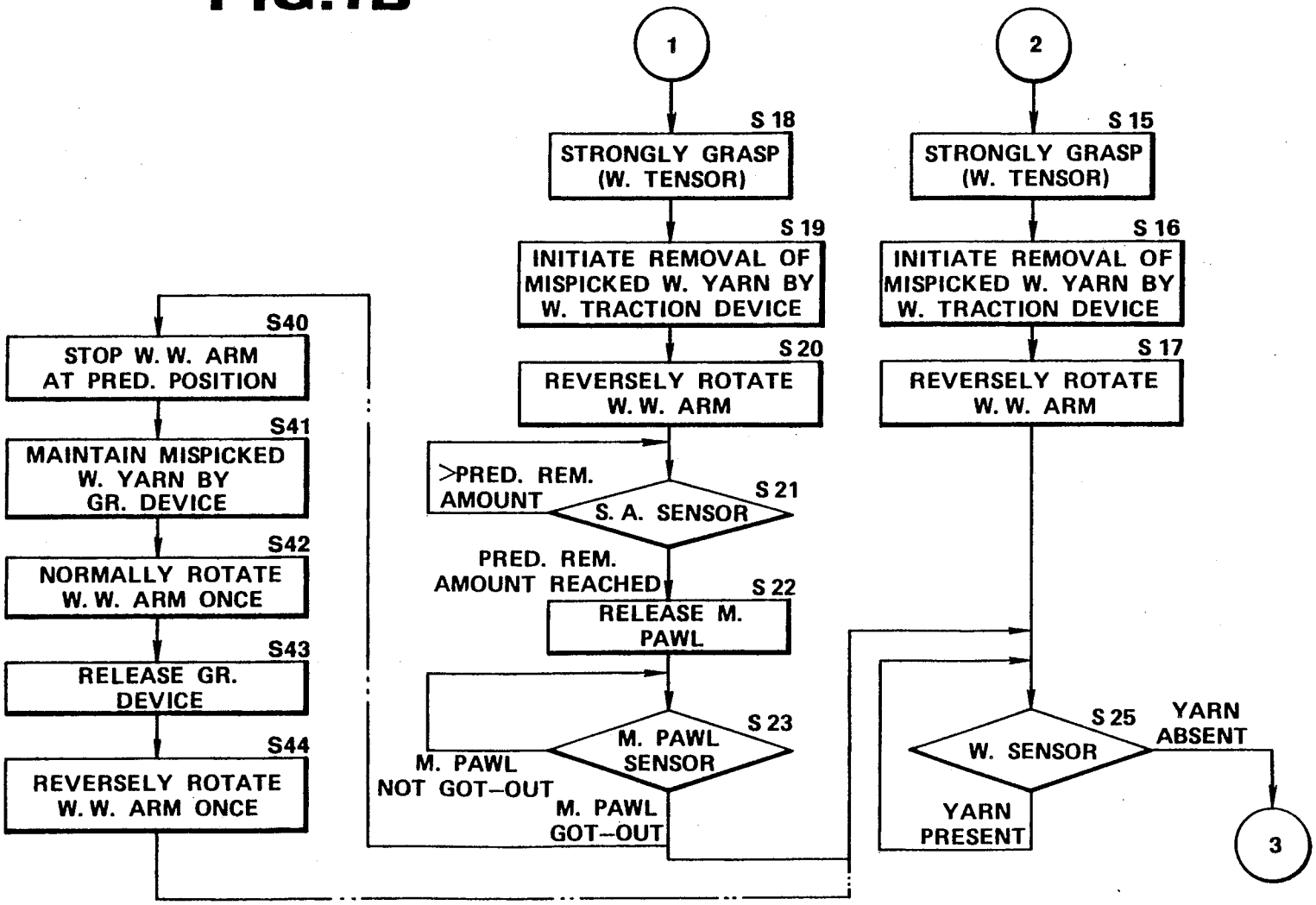
Figure 1C:
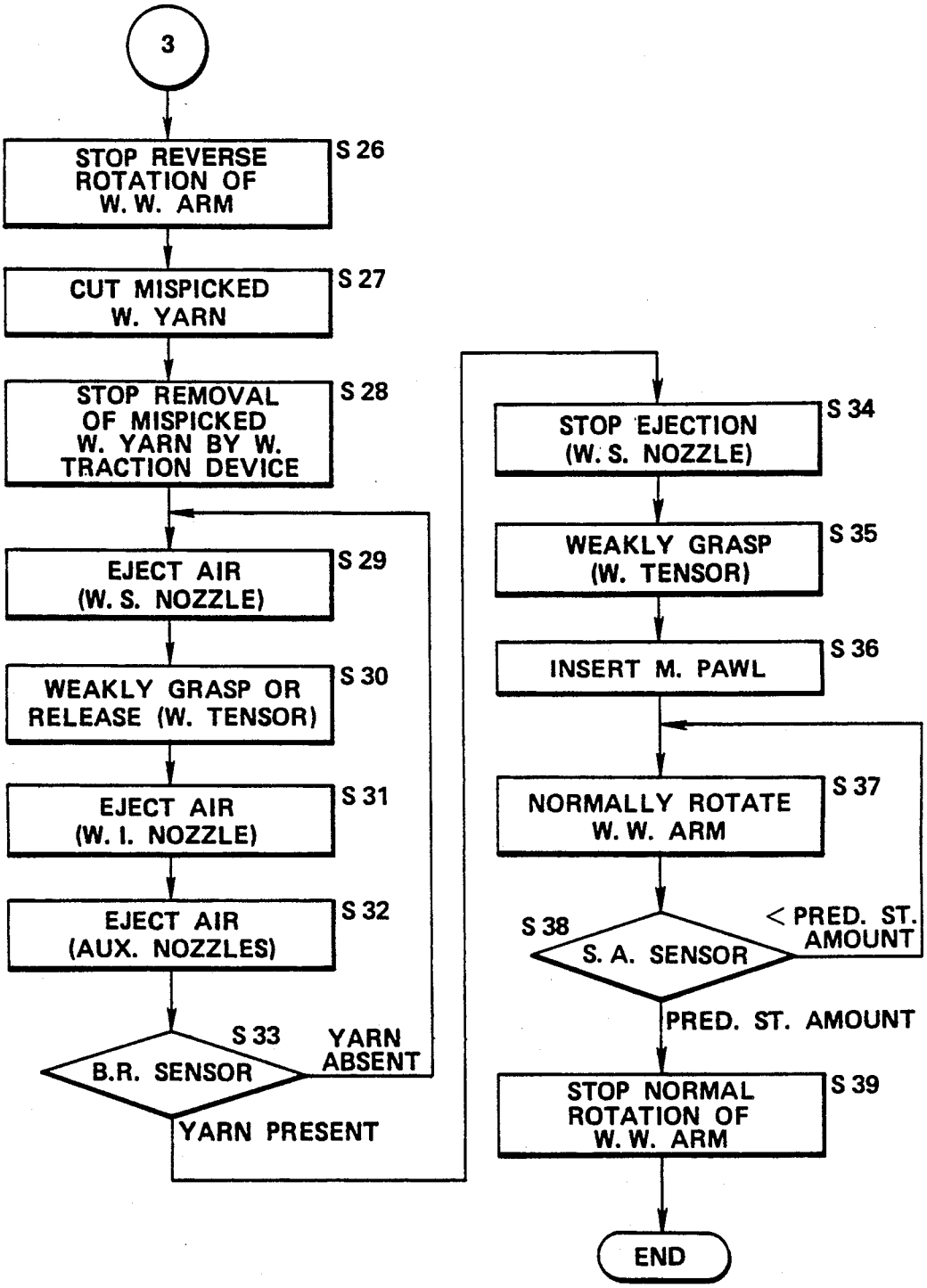

The 1st stage:

During weaving operation of the loom, a control circuit 13 detects the mispick at a predetermined timing upon input of a yarn absence signal (representative of absence of the weft yarn) from a weft sensor 1 disposed at the inlet side of the weft winding arm 10*a* of the weft storage unit 10, a weft sensor 2 disposed at the inlet side of the weft inserting nozzle 11, a weft sensor 3 disposed at the outlet side of the weft inserting nozzle 11, or upon input of a yarn breakage (presence) signal (representing presence of the weft yarn) from a weft breakage sensor 5 (See a step S1 in FIG. 1A).

The 2nd stage:

Upon detection of the mispick, the control circuit 13 stops the cutting operation of a normally used cutter 14 arranged to cut the weft yarn W to have a predetermined length, i.e., stops cutting function (for the weft yarn) of the loom (See a step S2 in FIG. 1A).

The 3rd stage:

Under a control command from the control circuit 13, the normal rotation of a loom main shaft (not shown), i.e., the weaving revolution of the loom is stopped thereby stopping operation of the loom (See step S3 in FIG. 1). Usually, this weaving revolution is stopped at the next weaving cycle of a weaving cycle in which a mispicked weft yarn Wa is detected.

The 4th stage:

(a) The loom main shaft starts its reverse rotation at a speed lower than the normal rotation under a control command from the control circuit 13, after a lapse of time to complete the stopping of the operation of the loom (See step S4 in FIG. 1A).

(b) The reverse rotation of the loom main shaft is stopped under a control command from the control circuit 13 at a time when the reed is located at its backward position in the weaving cycle (in which the mispick is made) and warp yarns (not shown) form the maximum shed opening (See step S5 in FIG. 1A).

Under the reverse rotation of the loom main shaft in the steps (a) and (b), the upper section of the warp yarns moves downward while the lower section moves upward. Thus, the upper and lower sections of the warp yarns forming the shed are alternately replaced with each other thereby allowing the mispicked weft yarn Wa to be exposed at the cloth fell of a woven fabric (not shown).

The 5th stage:

The control circuit 13 detects the mispicked weft yarn Wa or the broken (cut) position of the weft yarn W, and selects and executes processing suitable for the condition of the mispick. This will be explained with reference to the flowcharts of FIGS. 1A to 1C. First as shown steps 6 thru 10, the presence or absence of the weft yarn is detected by the sensors 1 thru 4 and the breakage sensor 5. Then, the processing is performed as follows:

(a) When the absence of the yarn is detected by the weft sensor 1 at step S6, the weft yarn is cut at the side of the weft supply member 15 and therefore a weft supply member side cut treatment is carried out in which the weft yarn W is passed from the weft supply member 15 through a weft tensor 16, the weft traction device 17, the weft storage unit 10 and into the weft inserting nozzle (main nozzle) 11, thus restarting the operation of the loom.

(b) When the presence of the yarn is detected by weft sensors 1 thru 4 at steps S6 thru S9 while the absence of the yarn is detected by the breakge sensor 5 at the step S10, loom stopping is confirmed to be made for causes other than mispick and therefore the weaving operation of the loom is restarted after such stopping cause is removed.

Figure 3:
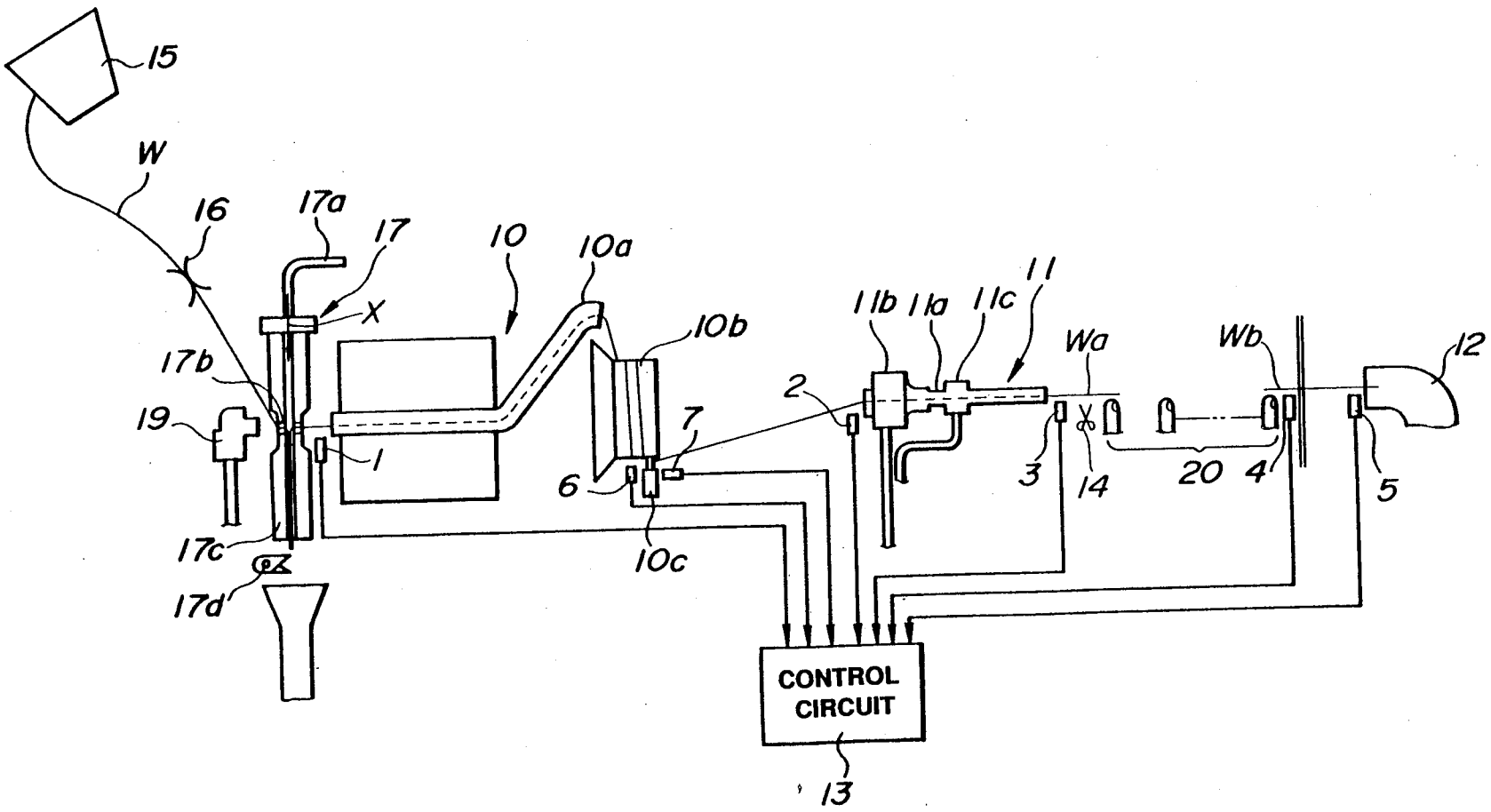
Figure 4:
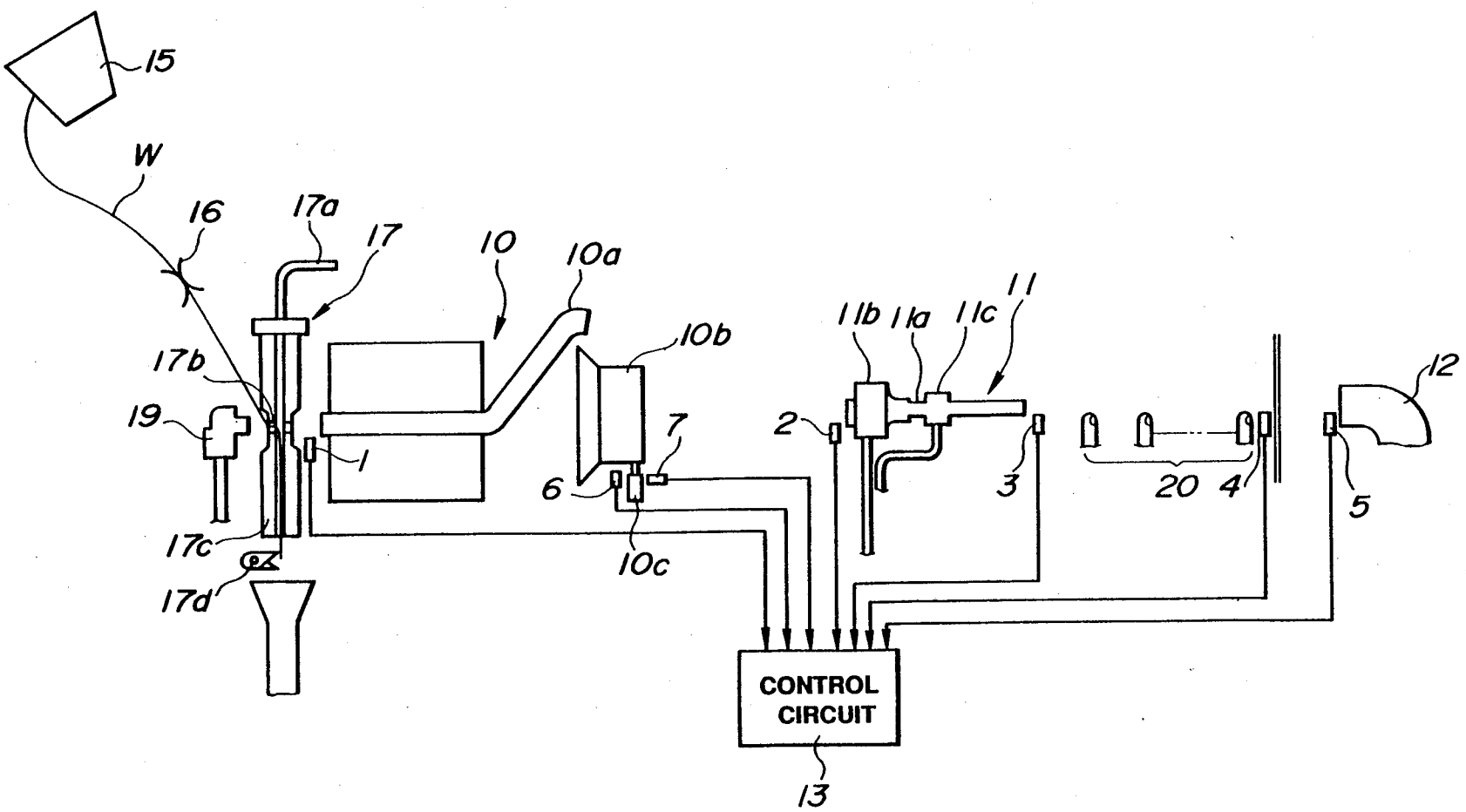

(c) When the presence of the yarn is detected by weft sensors 1 and 2 at steps S6 and S7 while the absence of the yarn is detected by the sensor 3 at step S8, the weft yarn W does not exist at the outlet side of the weft inserting nozzle 11, which corresponds to breakage (or cutting) of the yarn upon blowing of an air jet from the weft inserting nozzle. Taking the detection result of the weft breakage sensor 5 into account, if the presence of the yarn is detected by the breakage sensor 5 at step S13, there is a broken or cut yarn Wb separate from the weft yarn W. Accordingly, a broken yarn traction device 12 is operated to remove the broken yarn Wb as shown in FIG. 3. Thereafter, the weaving operation of the loom is restarted.

(d) When the presence of the yarn is detected by weft sensors 1 and 2 at steps S6 and S7 while the absence of the yarn is detected by weft sensor 3 and the breakage sensor 5 at steps S8 and S13, or when the presence of the yarn is detected by weft sensor 2 at step S6 while the absence of the yarn is detected at step S7, first the weft tensor 16 is brought into a strongly grasping condition at step S15 thereby preventing the weft yarn W from unwinding from the weft supply member 15. Subsequently, removal of the mispicked weft yarn is initiated as shown in step 16 so that air is ejected under pressure from the nozzle **17*a* of the weft traction device 17 in such a manner that air is blown to the weft yarn W within the weft introduction opening 17*b* from the side direction indicated by an arrow X in FIG. 3. Then, the weft winding arm 10*a* is reversely rotated at step S17 thereby to unwinding the weft yarn W wound on drum 10*b* of the weft storage unit 10. As a result, weft yarn W strongly grasped by weft tensor 16 is blown into pipe 17*c* opposite the nozzle 17*a* along with unwinding of the weft yarn from drum 10*b* (See FIG. 3**).

(e) When the presence of the yarn is detected by the weft sensors 1 to 3 at steps S6 to S8 while the absence of the yarn is detected by the weft sensor 4 at step S9, the weft tensor 16 is brought into its strongly grasping condition at step S18 the same as in steps S15 to S17 while removal of the mispicked weft yarn is initiated as shown in step S19. Then, after the weft winding arm **10*a* is reversely rotated at step 20, the storage amount of the weft yarn in the weft storage unit 10 is detected by a storage amount sensor 6 as shown at step S21. When the storage amount of the weft yarn becomes at such a predetermined remaining level that the weft yarn is wound, for example, two or three turns on the drum 10*b*, a measuring pawl 10*c* of the weft storage unit 10 is released from the drum 10*b* at step 22. Then, the control circuit 13 makes judgement as to whether the measuring pawl 10*c* gets out of the drum 10*b* or not from a signal from a measuring pawl sensor 7 at step of S23. Also in this case, weft yarn W strongly grasped by the weft tensor 16 is blown into pipe 17*c* along with unwinding of the weft yarn from the drum 10*b*** as same as in the above step (d).

(f) When the presence of the yarn is detected by the sensors 1 to 5 at steps S6 to S10, the broken yarn traction device 12 is operated to remove the broken weft yarn Wb. Simultaneously, the weft yarn W strongly grasped by the weft tensor 16 is blown into the pipe **17*c* along with unwinding of the weft yarn W from the drum 10*b* at the steps S18 to S23**.

(g) In the above-mentioned steps (d), (e) and (f), according to the signal from the weft sensor 1, judgement is made by the control circuit 13 as to whether the mispicked weft yarn Wa is removed from the weft inserting nozzle 11 and the weft storage unit 10 into the weft traction device 17 or not as shown at step S25. When the mispicked weft yarn Wa is removed, the reverse rotation of the weft winding arm **10*a* is stopped at a predetermined position at a step S26. At step S27, cutting operation of a cutter 17*d* of the weft traction device 17 is made thereby cutting the weft yarn W including the mispicked weft yarn Wa located in the pipe 17*c* under traction of air. Then, the air ejection from the nozzle 17*a* is stopped thereby stopping removal of the mispicked weft yarn as shown at step S28. Thus, the mispicked weft yarn Wa (FIG. 5) is removed by the weft traction device 17 (See FIG. 4**).

The 6th stage:

In this embodiment, after removing the mispicked weft yarn Wa, the weft yarn W is automatically passed from the weft traction device 17 through the weft storage unit 10 into the weft inserting nozzle 11, thus restarting the weaving operation of the loom. This is executed at steps S29 to S39 in FIG. 1.

Figure 5:
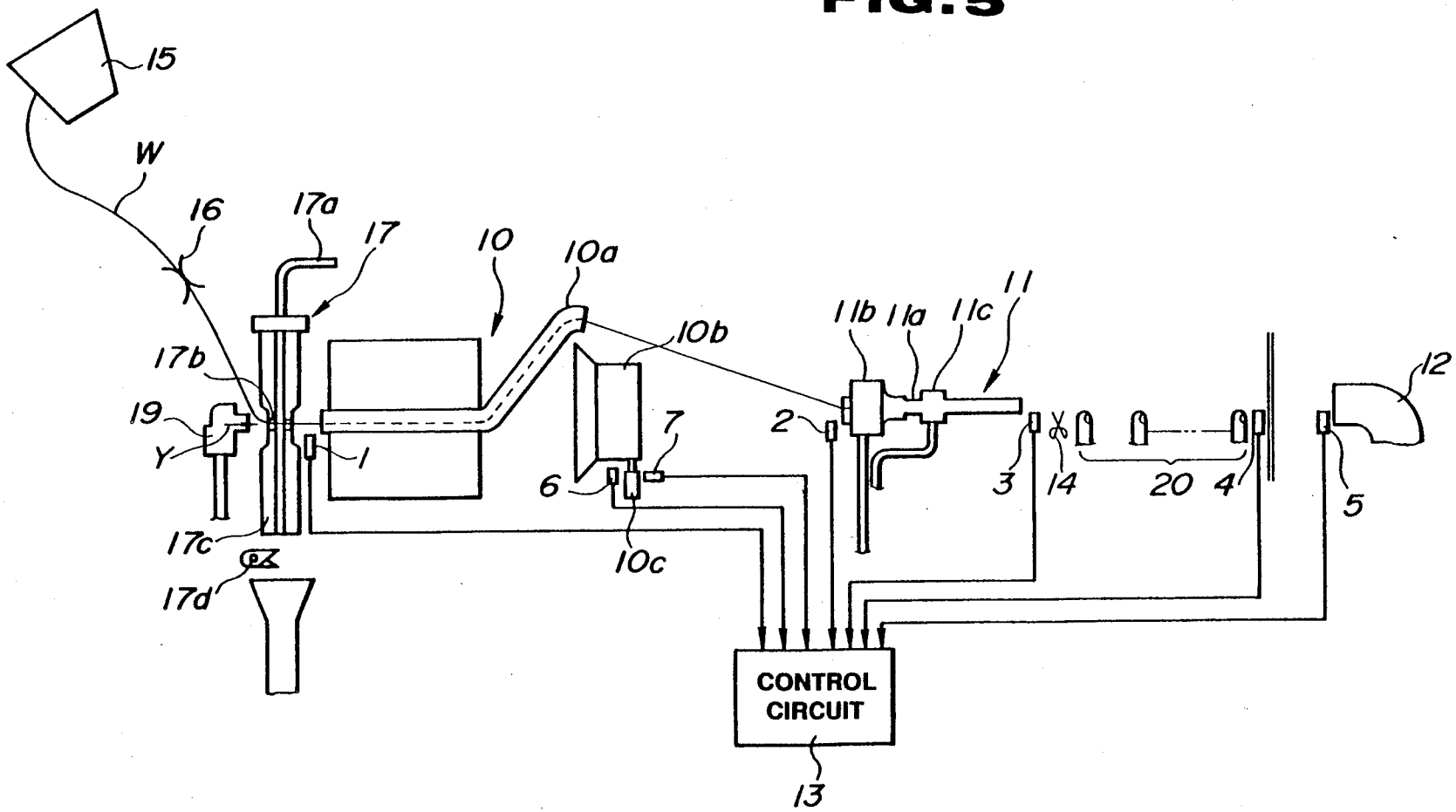

(a) At step S29, air is ejected from the weft supply nozzle 19 disposed outside of the inlet side of the yarn introduction opening **17*b* of the weft traction device 17 as indicated by an arrow Y in FIG. 5. At step S30, weft tensor 16 is brought alternately into a weakly grasping or releasable condition in which the weft yarn is drawn out from weft supply member 15 and a strongly grasping condition in which the weft yarn cannot be drawn out. At step S31, air ejection operation of the weft inserting nozzle 11 is made in which air is ejected from a first ejector nozzle 11*b* (for weft picking) which is disposed at the rear end section of the main body 11*a* of the weft inserting nozzle 11 and from a second ejector nozzle 11*c* disposed at the intermediate section of the weft inserting nozzle main body 11*a*, thereby developing suction at the inlet of the weft inserting nozzle main body 11*a*. At step S32, air ejection operation of a plurality of auxiliary nozzles 20 are performed at step S32. Accordingly, weft yarn W leading through weft tensor 16 from weft supply member 15 and extending through the weft introduction opening 17***b* is blown into the weft winding arm 10*a* under the influence of the air jet from the weft supply nozzle 19. Then, weft yarn W reaches a position near the inlet of the weft insertion nozzle main body 11*a* under the influence of an air stream from the weft winding arm 10*a* toward the inlet of the weft inserting nozzle main body 11*a*, and sucked into the weft inserting nozzle main body 11*a* under suction developed at the inlet of the weft inserting nozzle main body 11*a*. Then, weft yarn W is picked toward a counter-weft picking side under the influence of an air jet from the first ejector nozzle 11*b* and the second ejector nozzle 11*c*, and the auxiliary nozzles 20 (See FIG. 5). The counter-weft picking side is opposite to a weft picking side at which the weft inserting nozzle 11 is disposed.

(b) When the breakage sensor 5 detects the presence of the yarn in the above-picking of the weft yarn at step S33, air ejection of the weft supply nozzle 19 and the second ejector nozzle 11*c* is stopped while setting the air ejection pressure of the first ejector nozzle 11*a* at a picking operation pressure for weaving operation at step S34. At step S35, weft tensor 16 is brought into the weakly grasping condition. At step S36, the measuring pawl 10*c* is inserted into the drum 10*b*. At step S37, the weft winding arm 10*a* is normally rotated. Then, the storage amount of the weft yarn in the weft storage unit 10 is detected by the storage amount sensor 6 as shown at step S38. When the storage amount reaches a predetermined level over a level for one pick, the normal rotation of the weft winding arm 10*a* is stopped, thereby restarting the weaving operation of the loom thus completing a series of weft treatment operations (See FIG. 2).

Figure 2:
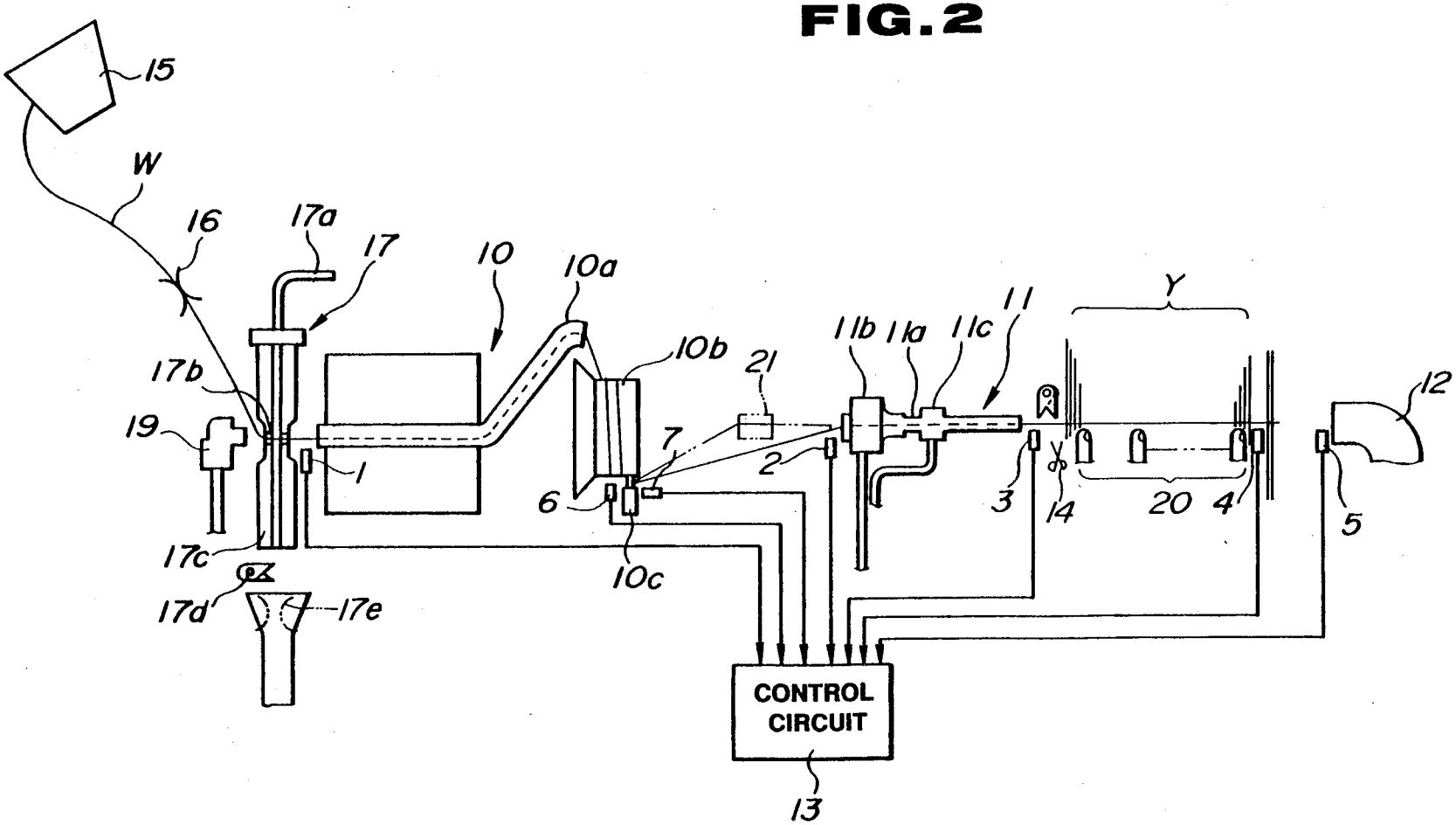
FIGS. 2 to 5 are schematic illustrations of a weft picking system, showing operation of the first embodiment weft treatment system and method.

While the first embodiment of the weft treatment system has been shown and described as being operated as shown in the flow indicated by solid line in FIG. 1, it will be understood that it may be operated as shown in a flow indicated by dot-dash-dash line in FIG. 1, in which inserted between steps S23 and S25 are step 40 (for stopping the weft winding arm 10*a* at a predetermined position), step S41 (for maintaining the mispicked weft yarn Wa by a grasping device 17*e* in FIG. 2), step S42 (for normally rotating the weft winding arm 10*a* by one time or turn), step S43 (for causing the grasping device 17*e* to release the weft yarn), and step S44 (for reversely rotating the weft winding arm by one time or turn), so that the mispicked weft yarn can be removed in combination of traction force caused by an air jet of the weft traction device 17 and winding force of the weft winding arm 10*a*.

Additionally, as shown in FIG. 2, a weft guide 21 having an ejector nozzle function may be provided between the weft storage unit 10 and the weft inserting nozzle 11, so that the weft yarn W is blown to pass from the weft winding arm 10*a* through the weft guide 21 to the weft inserting nozzle 11 under the influence of suction developed at the inlet of the weft guide 21 and an air jet from the outlet of the same. Furthermore, prior to starting of the weaving operation of the loom at step S39, the tip end section of the weft yarn projected from the tip end of the weft inserting nozzle 11 may be cut by a cutter indicated in phantom in FIG. 2, so that the cut weft yarn is removed by the broken yarn traction device 12. Although only by an air jet has been described as being used as means for carrying the weft yarn, it will be appreciated that a water jet, a harmless gas jet or the like may be used in place of an air jet.

It will be appreciated that traction devices such as the weft traction device 17 and the broken yarn traction device 12 may be of the type wherein the weft yarn W is drawn upon being passed through or between a pair of rollers, or of the type wherein the weft yarn is drawn upon being wound on a rod member.

While the weft treatment system and method has been shown and described in combination with the air jet loom, it will be understood that the weft treatment system and method may be used in combination with a water jet loom.

It will be appreciated that the drum 10*b* of the above-mentioned weft storage unit 10 may be replaced with other similar devices such as one in which a plurality of wires are arranged to form a drum-like or barrel-like peripheral surface.

FIGS. 6 to 11 illustrate a second embodiment of the weft treatment system and method in a fluid jet loom, which is similar to the first embodiment. The weft treatment method is generally summarized as follows:

1st stage . . . Mispick is detected.

2nd stage . . . Cutting function for weft yarn is stopped.

3rd stage . . . Weaving opration of the loom is stopped.

4th stage . . . The loom is reversely run thereby exposing a mispicked weft yarn at the cloth fell of a woven fabric.

5th stage . . . The weft yarn is unwound from the drum of the weft storage unit by reversely rotating the weft winding arm upon insertion of the measuring pawl into the drum of the weft storage unit under traction of the weft yarn leading from the weft storage unit to the weft supply member. Thereafter, the weft yarn is hauled in from the array of warp yarns by rotating the weft winding arm upon insertion of the measuring pawl into the drum under the traction of the weft yarn.

6th stage . . . A weft yarn is passed into the weft inserting nozzle (or main nozzle) through a weft traction device and the weft storage unit under influence of a fluid jet from the weft supply nozzle disposed at the inlet side of the weft traction unit and under suction at the inlet of the weft inserting nozzle.

In this embodiment, the 1st stage to the 4th stages, steps (a) to (d) in the 5th stage, and the 6th stage are the same as the first embodiment in FIG. 1. Therefore, only the steps (e) to (g) in the 5th stage will be discussed hereinafter for the simplicity of illustration. Similarly, the same steps as in the first embodiment are likewise omitted in the flowchart in FIG. 6.

(e) When the presence of the yarn is detected by the weft sensors 1, 2, 3 and 4 at steps S6 to S9 while the absence of the yarn is detected by the breakage sensor 5 at step S10, the weft yarn W is in a so-called breakage condition in which the weft yarn W is broken or cut in the array of the warp yarns Y. Accordingly, the weft traction device 12 is driven or operated at step S24 thereby removing the broken weft yarn Wb. then, at steps S20 to S22, weft yarn W strongly grasped by weft sensor 16 is blown into the pipe 17*c* under the influence of an air jet within the weft traction device 17 as the weft yarn is unwound from the drum 10*b*.

(f) When the presence of the yarn is detected by the weft sensors 1, 2 and 3 at steps S6 to S8 while the absence of the yarn is detected by the weft sensor 4 at step S9, the weft yarn W is in a so-called short pick condition in which the tip end section of the picked weft yarn W does not reach the counter-weft picking side and located within the array of the warp yarn Y. Accordingly, as shown in steps S18 to S45, the weft yarn W is strongly grasped by weft tensor 16, and removing of the mispicked yarn is initiated. Then, the weft winding arm 10*a* is reversely rotated at a speed lower than in normal rotation of the weft winding arm, and the measuring pawl 10*c* of the weft storage unit 10 is released from the drum 10*b*. Subsequently, judgement is made by a weft unwinding sensor 7' as to whether the weft yarn W wound on the drum 10*b* is unwound from the drum 10*b* or not.

Figure 8:
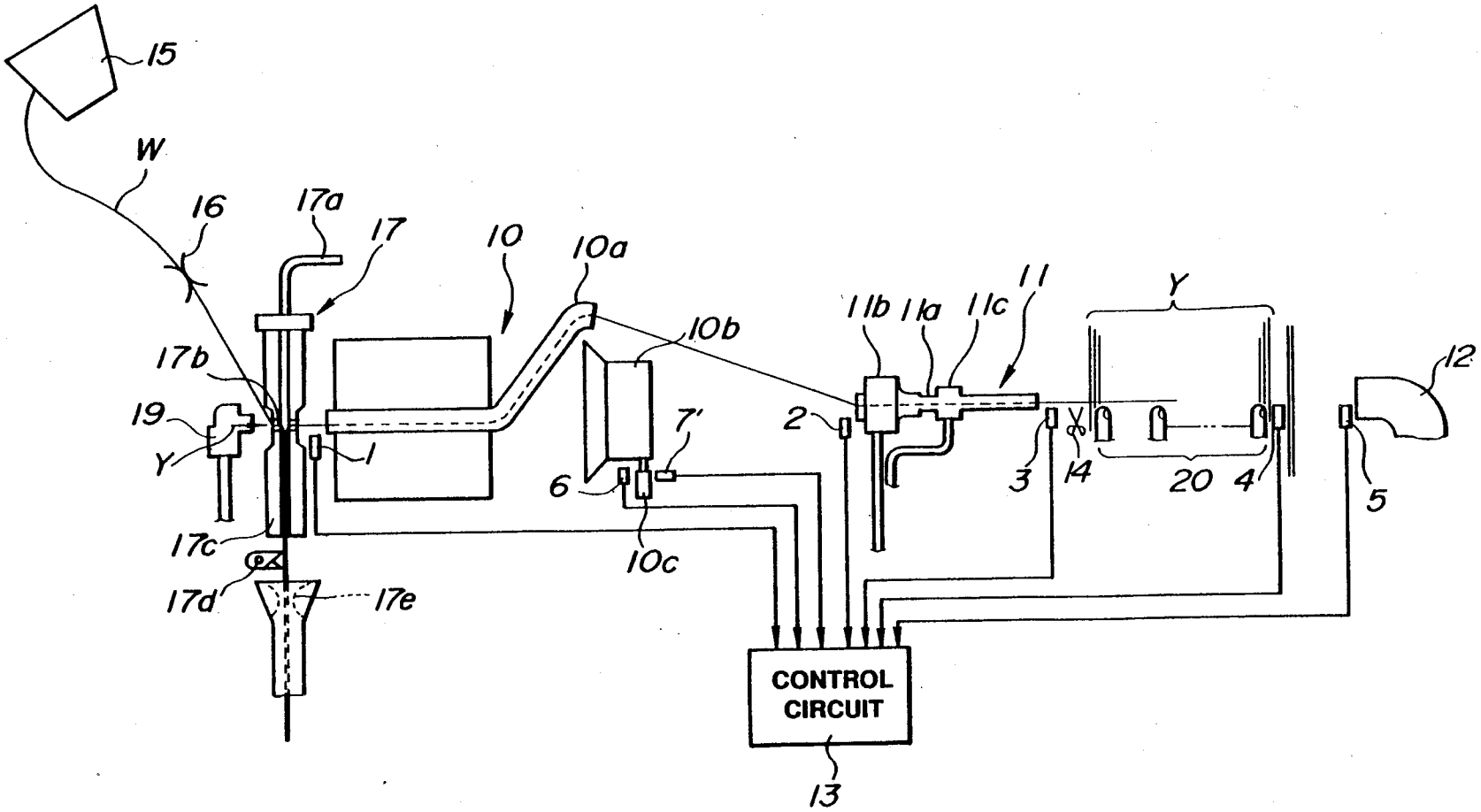

More specifically, this judgement is carried out as follows: When the whole weft yarn wound on the drum 10*b* is unwound with the reverse rotation of the weft winding arm 10*a* as shown in FIG. 8, the weft yarn W extended between the weft inserting nozzle 11 and the wet winding arm 10*a* rotatingly moves so as to describe the conical surface of a cone whose summit corresponds to the weft inserting nozzle 11. The weft unwinding sensor 7' detects the presence of the yarn when this rotating weft yarn W passes by the weft winding sensor 7'. Under the detection of the presence of the yarn by the weft unwinding sensor 7', the control circuit 13 makes such a judge that unwinding of the weft yarn W from the drum 10*b* is completed, in accordance with a program which has been previously stored in the control circuit 13. Also in this case, weft yarn W is strongly grasped by weft sensor 16 as seen in the above-mentioned step (e), and therefore weft yarn W is blown into the pipe 17*c* as it is unwound from the drum 10*b*.

Here, in the case of the mispick of the above-mentioned steps (e) and (f), during a time from detection of the mispick to stopping of the weaving operation of the loom, the mispicked weft yarn Wa is beaten up to complete a tight weaving connection between the weft yarn Wa and the warp yarn Y so that the mispicked weft yarn Wa is strongly held in the array of the warp yarns Y. In view of the above, in this embodiment, processing shown in steps S47 to S59 are executed upon providing the weft grasping device 17*e* to grasp the weft yarn W leading from the weft storage unit 10 to the side of the weft supply member 15, so that the mispicked weft yarn Wa leading to the weft inserting nozzle 11 from the array of the warp yarns Y is pulled or hauled in from the warp yarn array under the grasping force and the rotational force of the winding arm 10*a* thus removing the mispicked weft yarn Wa.

Figure 9:
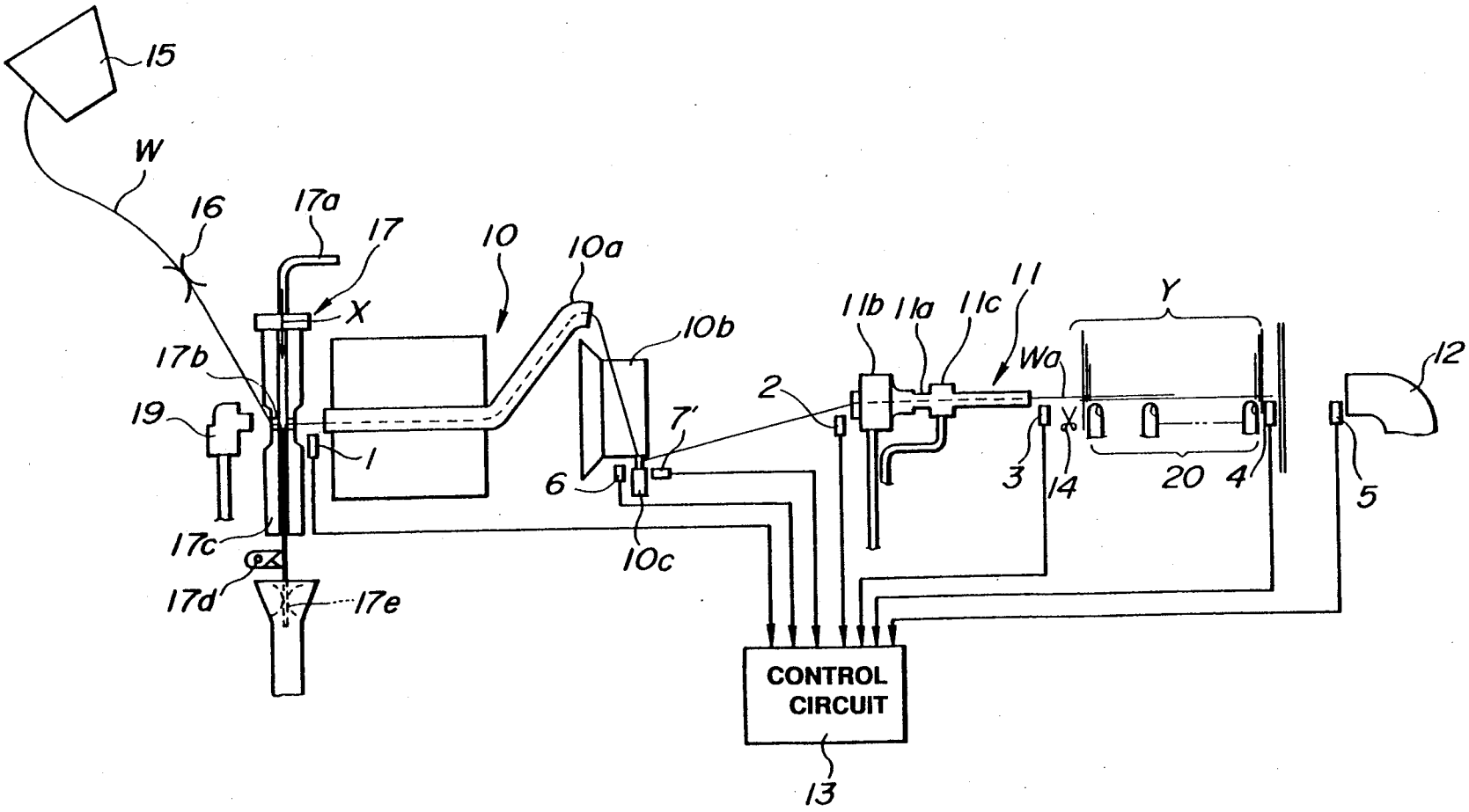

More specifically, when the presence of the yarn is detected by the weft unwinding sensor 7' at step S46 completing unwinding of the weft yarn W from the drum 10*b*, the reverse rotation of the weft winding arm 10*a* is stopped at step S47 so that the weft winding arm 10*a* is located in a predetermined position at which the tip end section of the weft winding arm 10*a* does not meet with the weft storage amount sensor 6, the weft unwinding sensor 7' and the measuring pawl 10*c*. At steps S48 to S50, the measuring pawl 10*c* is inserted into the drum 10*b*, the weft yarn W is tightly grasped by the weft grasping device 17*e*, and the weft winding arm 10*a* is normally rotated by one time. Then, as shown in FIG. 9, the weft yarn W extended between the weft inserting nozzle 11 and the weft winding arm 10*a* is caught by the measuring pawl 10*c* under rotation of the weft winding arm 10*a*, so that the weft yarn W is wound on the drum 10*b* in an amount less than one turn. At this time, the mispicked weft yarn Wa is hauled in toward the weft winding arm 10*a* from the warp yarn shed under the grasping force of the weft grasping device 17*e* and the rotational force of the weft winding arm 10*a*.

At the steps S51 and S52, the weft yarn W is released from the weft grasping device 17*e*, and the measuring pawl 10*c* is released from the drum 10*b* before one normal rotation of the weft winding arm 10*a* is completed. Upon this one normal rotation of the weft winding arm, releasing action of the weft grasping device 17*e* and releasing action of the measuring pawl 10*c*, the mispicked weft yarn Wa hauled in toward the weft traction device 17 is blown into the pipe 17*c* while being unwound from the drum 10*b*. Thereafter, at step S53, the detecting condition of weft sensor 1 is judged by the control circuit 13 in accordance with the program previously stored in control circuit 13. More specifically, in the case in which the presence of the yarn is detected by weft sensor 1 at step S53, the weft yarn W exists on the side of the weft winding arm 10*a*. Accordingly, at steps S54 to S56, the measuring pawl 10*c* is inserted into the drum 10*b*, the weft yarn W is tightly grasped by the weft grasping device 17*e*, and the weft winding arm 10*a* is reversely rotated by one time. Then, as shown in FIG. 9, under rotation of the weft winding arm 10*a*, the weft yarn W extended between the weft inserting nozzle 11 and the weft winding arm 10*a* is caught by the measuring pawl 10*c* and wound on the drum 10*b* in an amount less than that corresponding to one turn, while the mispicked weft yarn Wa is hauled in toward the weft winding arm 10*a* from the array of the warp yarns Y under the grasping force of the weft grasping device 17*e* and the rotational force of the weft winding arm 10*a*. At steps S58 and S59, the weft yarn W is released from the weft grasping device 17*e*, and the measuring pawl 10*c* is released from the drum 10*b* before one reserve rotation of the weft winding arm 10*a* is completed. Upon this one reverse rotation of the weft winding arm, releasing action of the weft grasping device 17*e* and releasing action of the measuring pawl 10*c*, the mispicked weft yarn Wa hauled in toward the weft traction device 17 is blown into the pipe 17*c* while being unwound from the drum 10*b*. Thereafter, at step S53, the detecting condition of the weft sensor 1 is judged by the control circuit 13 in accordance with the program previously stored in the control circuit 13. More specifically, in the case in which the presence of the yarn is detected by the weft sensor 1 at the step S59, the weft yarn W is confirmed to exist on the side of the weft winding arm 10*a*, so that the flow of processing returns to the step 48.

Figure 10:
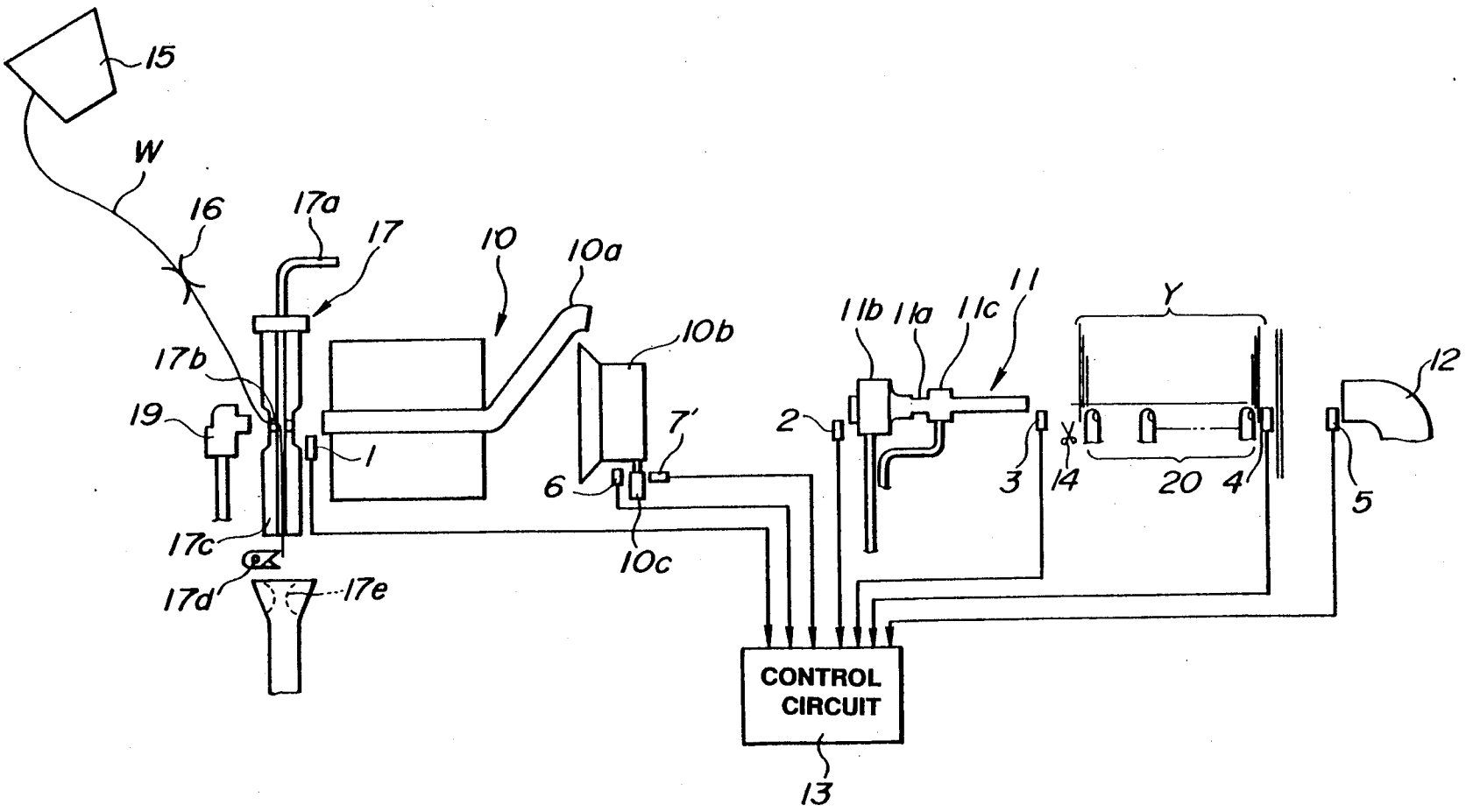

(g) In the case in which the absence of the yarn is detected by the weft sensor 1 in the step S17, the step S53 and the step S59, the weft yarn W including the mispicked weft yarn Wa is removed from a range from the array of the warp yarns Y array to the weft winding arm. Accordingly, at step S26', rotation of the weft winding arm 10*a* is stopped so that the tip end section of the weft winding arm 10*a* is located in a predetermined position not to meet with the weft storage amount sensor 6, the weft unwinding sensor 7' and the measuring pawl 10*c*. Then, at the step S27, cutting action of the cutter 17*d* is made threby cutting the weft yarn W containing the mispicked weft yarn Wa drawn and located within the pipe 17*c*. Then, as shown at step S28, air ejection from the nozzle 17*a* is stopped thereby stopping removing operation of the mispicked weft yarn. Thus, the mispicked weft yarn Wa is removed by the weft traction device 17*e* as illustrated in FIG. 10.

Figure 11:
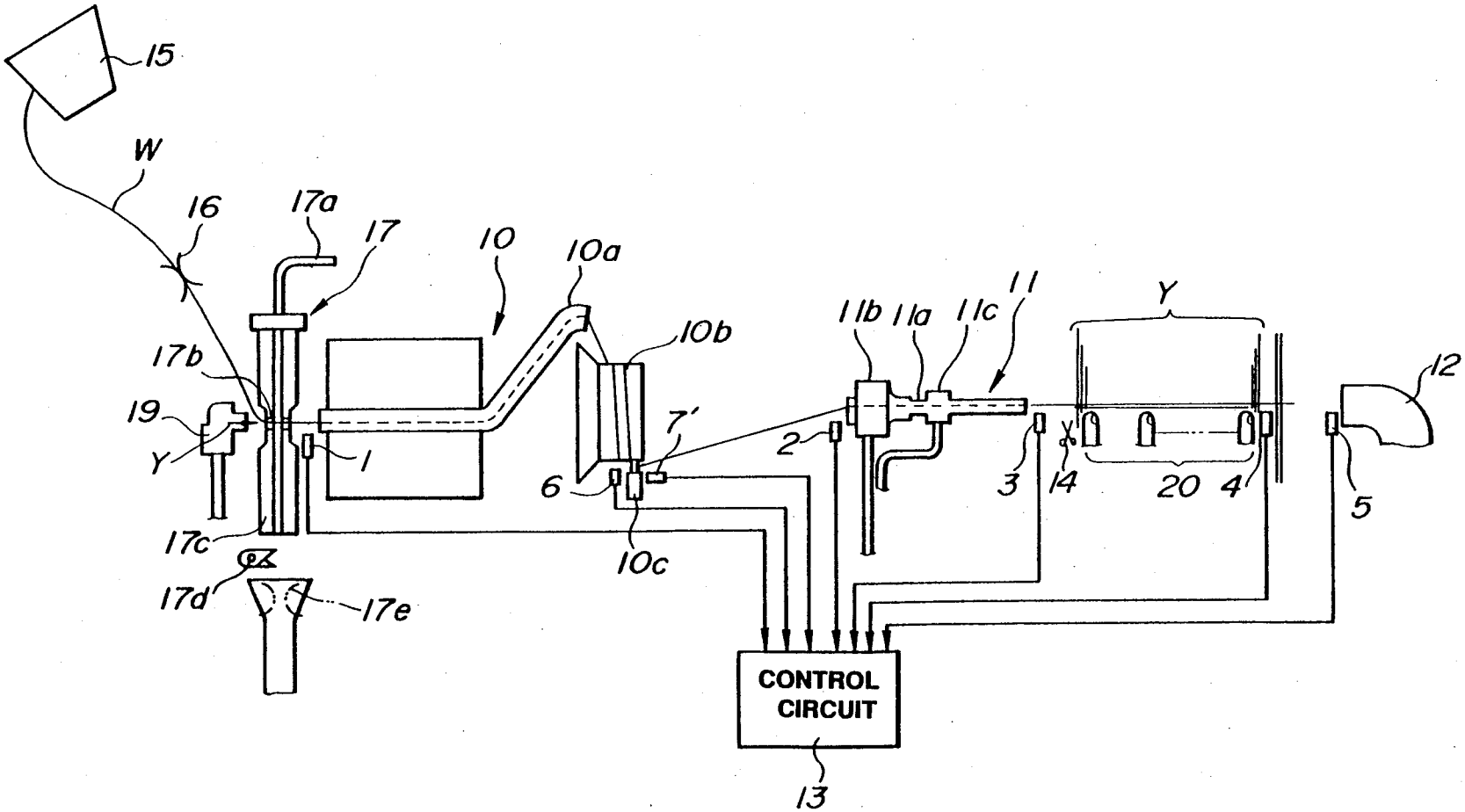

It will be understood that the operation of the 6 th stage is executed as same as in the first embodiment as illustrated in FIG. 11.

Figure 12:
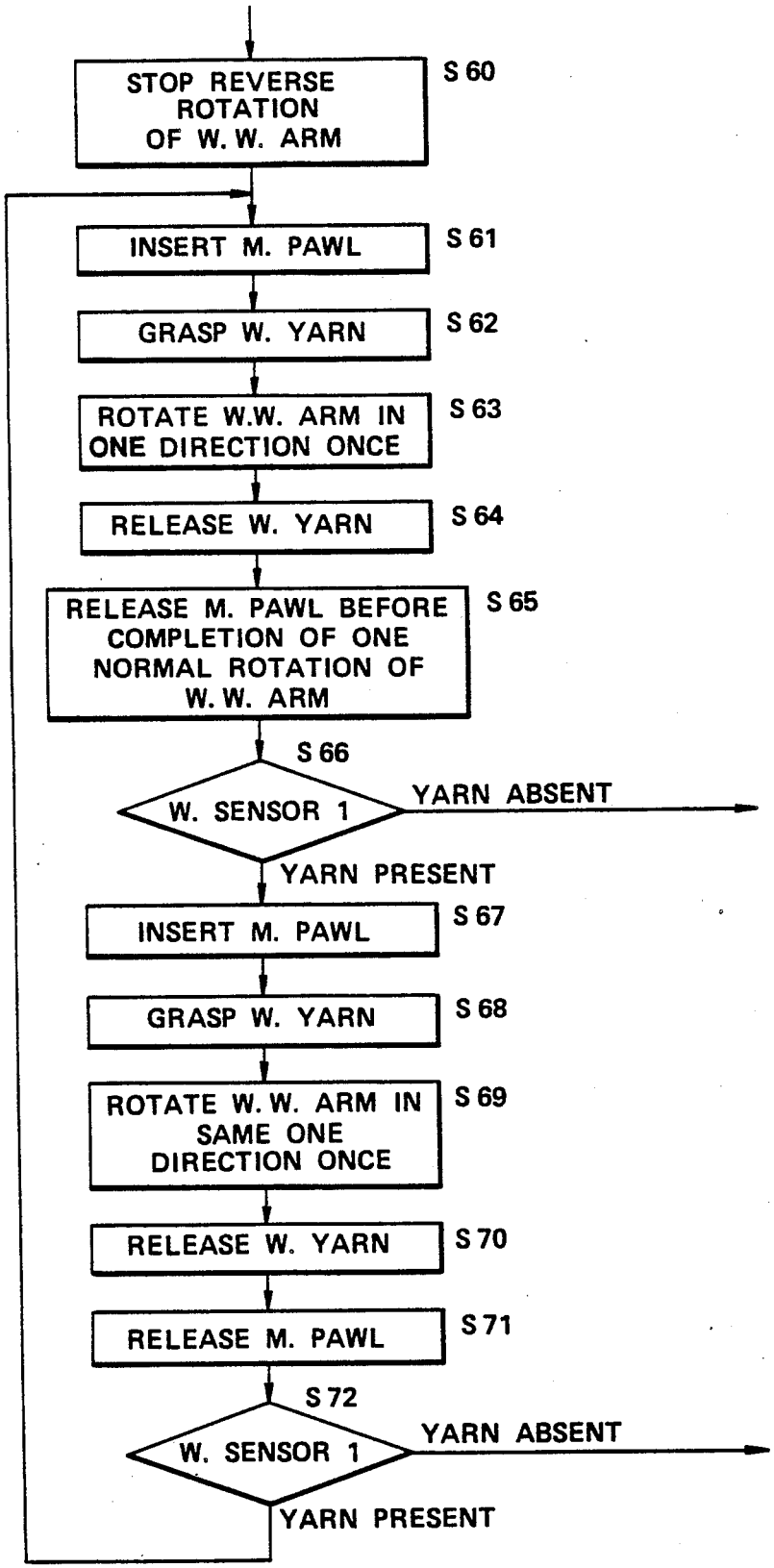
FIG. 12 is a flowchart of processing of weft treatment of a modified example of the second embodiment weft treatment system and method.

FIG. 12 shows the operation of a modified example of the second embodiment weft treatment system and method in accordance with the present invention. The operation of this modified example is the same as that shown in FIG. 6 with the exception that steps S60 to S72 are provided in place of the steps S47 to S59 in the flowchart of FIG. 6. In other words, in this modified example, the weft winding arm 10*a* is rotated only in one direction (i.e., the normal or reverse rotational direction) during a process for hauling in the mispicked weft Wa from the warp yarn array, while it has been described as being rotated in one direction and in an opposite direction in the operation of FIG. 6.

Figure 6A:
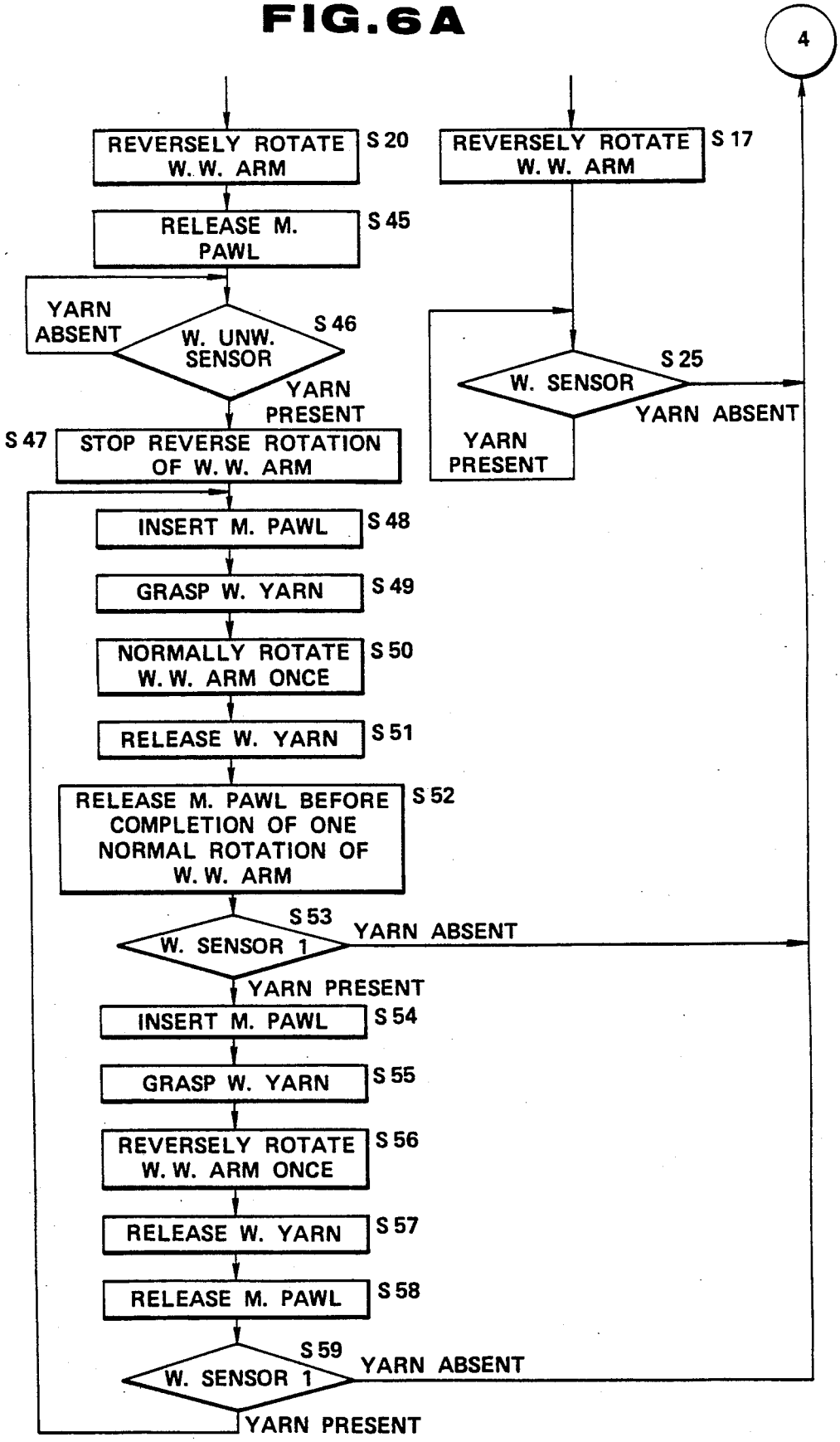
FIG. 6A and 6B are flowcharts of processing of weft treatment of a second embodiment of the weft treatment system and method in accordance with the present invention.
Figure 6B:
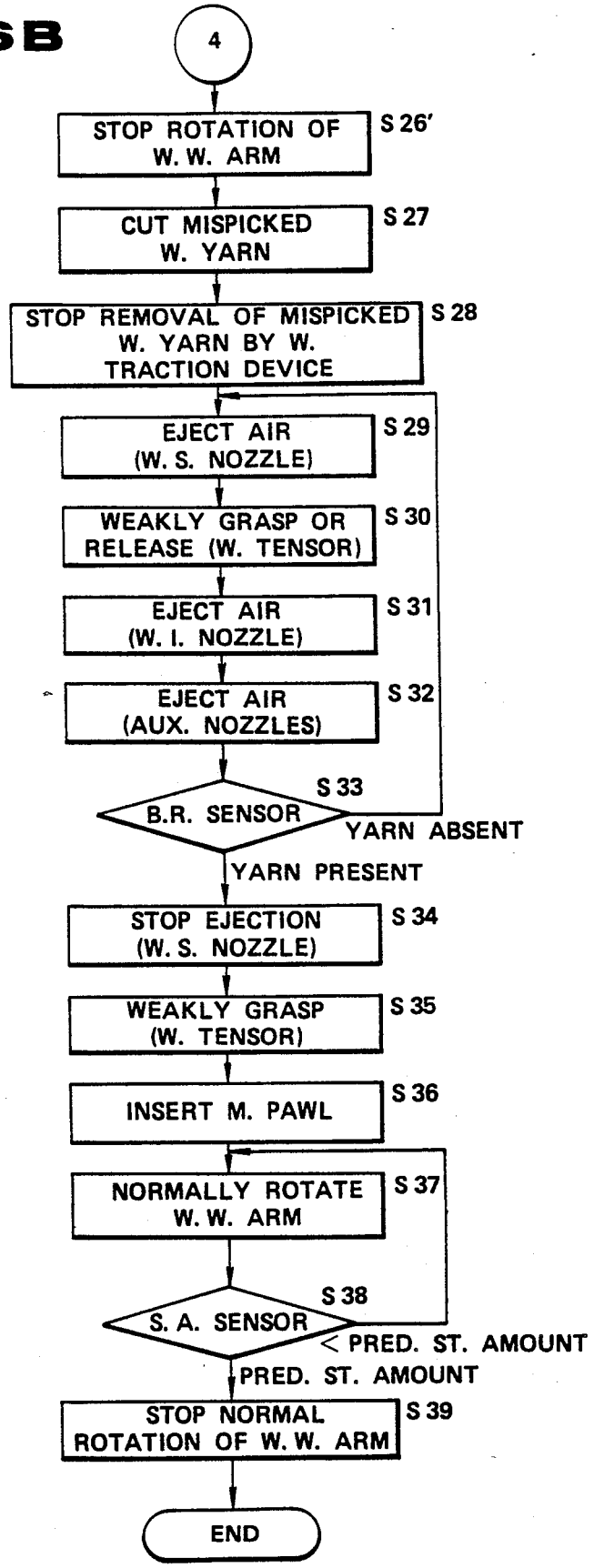

In this example, when the presence of the yarn is detected by the weft unwinding sensor 7' at the step S46 in FIG. 6 completing unwinding of the weft yarn W from the drum 10*b*, the reverse rotation of the weft winding arm 10*a* is stopped at the step S60 (corresponding to step 47 in FIG. 6) in FIG. 12 so that the weft winding arm 10*a* is located in a predetermined position at which the tip end section of the weft winding arm 10*a* does not meet with the weft storage amount sensor 6, the weft unwinding sensor 7 and the measuring pawl 10*c*. At steps S61 to S63, the measuring pawl 10*c* is inserted into the drum 10*b*, the weft yarn W is tightly grasped by the weft grasping device 17*e*, and the weft winding arm 10*a* is rotated in one direction, for example, normally rotated by one time. Then, as shown in FIG. 9, the weft yarn W extended between the weft inserting nozzle 11 and the weft winding arm 10*a* is caught by the measuring pawl 10*c* under the rotation of the weft winding arm 10*a*, so that the weft yarn W is wound on the drum 10*b* in an amount less than one turn. At this time, the mispicked weft yarn Wa is hauled in toward the weft winding arm 10*a* from the warp yarn array under the grasping force of the weft grasping device 17*e* and the rotational force of the weft winding arm 10*a*.

At steps S64 and S65, the weft yarn W is released from the weft grasping device 17*e*, and the measuring pawl 10*c* is released from the drum 10*b* before one normal rotation of the weft winding arm 10*a* is completed. Under this one normal rotation of the weft winding arm, releasing action of the weft grasping device 17*e* and releasing action of the measuring pawl 10*c*, the mispicked weft yarn Wa hauled in toward the weft traction device 17 is blown into the pipe 17*c* while being unwound from the drum 10*b*. Thereafter, at step S66, the detecting condition of the weft sensor 1 is judged by the control circuit 13 in accordance with the program previously stored in the control circuit 13. More specifically, in the case in which the presence of the yarn is detected by the weft sensor 1 at the step S66, the weft yarn W is confirmed to exist on the side of the weft winding arm 10*a*. Accordingly, at the steps S67 to S69, the measuring pawl 10*c* is inserted into the drum 10*b*, the weft yarn W is tightly grasped by the weft grasping device 17*e*, and the weft winding arm 10*a* is rotated in the above-mentioned one direction or normally rotated one time. Then, upon rotation of the weft winding arm 10*a*, the weft yarn W extended between the weft inserting nozzle 11 and the weft winding arm 10*a* is caught by the measuring pawl 10*c* and wound on the drum 10*b* in an amount less than that corresponding one turn, while the mispicked weft yarn Wa is hauled in toward the weft winding arm 10*a* from the array of the warp yarns Y under the grasping force of the weft grasping device 17*e* and the rotational force of the weft winding arm 10*a*. At steps S70 and S71, the weft yarn W is released from the weft grasping device 17*e*, and the measuring pawl 10*c* is released from the drum 10*b* before one normal rotation of the weft winding arm 10*a* is completed. Under this one normal rotation of the weft winding arm, releasing action of the weft grasping device 17*e* and releasing action of the measuring pawl 10*c*, the mispicked weft yarn Wa hauled in toward the weft traction device 17 is blown into the pipe 17*c* while being unwound from the drum 10*b*. Thereafter, at the step S72, the detecting condition of the weft sensor 1 is judged by the control circuit 13 in accordance with the program previously stored in the control circuit 13. More specifically, in the case in which the presence of the yarn is detected by the weft sensor 1 at this step S72, the flow of processing returns to the step 61. In the case in which the absence of the yarn is detected by the weft sensor 1 at steps S66, S72, the processing at steps S26' to S39 in FIG. 2 is executed. It will be understood that, in this example of FIG. 12, the weft winding arm 10*a* is rotated only in one direction, the control of a motor (not shown) for driving the weft winding arm 10*a* is simplified.

Figure 13:
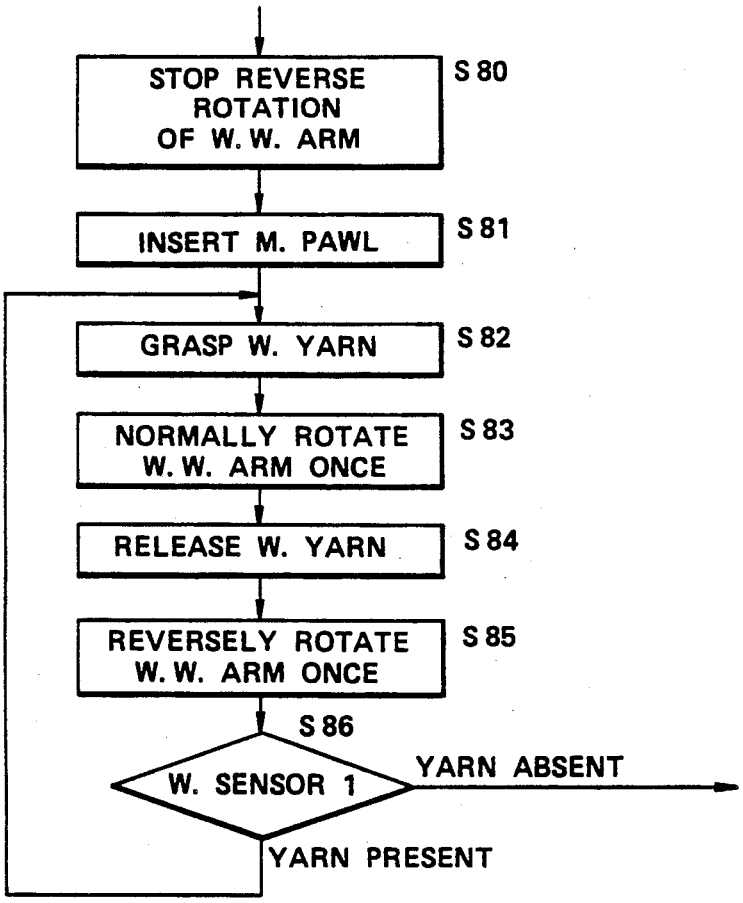
FIG. 13 is a flowchart of processing of weft treatment of another modified example of the second embodiment weft treatment system and method.

FIG. 13 shows the flowchart of operation of another modified example of the second embodiment weft treatment system and method in accordance with the present invention. In this modified example, the operation is the same as that of FIG. 6 with the exception that steps S80 to S86 are provided in place of steps S47 to S59 in FIG. 6, in which releasing or withdrawing operation of the measuring pawl 10*c* from the drum 10*b* is omitted.

In this example, when the presence of the yarn is detected by the weft unwinding sensor 7' at step S46 in FIG. 6 completing unwinding of the weft yarn W from the drum 10*b*, the reverse rotation of the weft winding arm 10*a* is stopped at step S80 (corresponding to the step 46 in FIG. 6) in FIG. 13 so that the weft winding arm 10*a* is located in a predetermined position at which the tip end section of the weft winding arm 10*a* does not meet with the weft storage amount sensor 6, the weft unwinding sensor 7' and the measuring pawl 10*c*. At steps S81 to S85, the measuring pawl 10*c* is inserted into the drum 10*b*, the weft yarn W is tightly grasped by the weft grasping device 17*e*, and the weft winding arm 10*a* is rotated in one direction, for example, normally rotated by one time. Then, the weft yarn W extended between the weft inserting nozzle 11 and the weft winding arm 10*a* is caught by the measuring pawl 10*c* under the rotation of the weft winding arm 10*a*, so that the weft yarn W is wound on the drum 10*b* in an amount less than one turn. At this time, the mispicked weft yarn Wa is hauled in toward the weft winding arm 10*a* from the warp yarn shed under the grasping force of the weft grasping device 17*e* and the rotational force of the weft winding arm 10*a*.

Thereafter, the weft yarn W is released from the weft grasping device 17*e*, and the weft winding arm 10*a* is rotated in a reverse direction to the above-mentioned direction, i.e., reversely under this operation, the mispicked weft yarn Wa hauled in toward the weft traction device 17 is blown into the pipe 17*c* while being unwound from the drum 10*b*. Thereafter, at step S86, the detecting condition of the weft sensor 1 is judged by the control circuit 13 in accordance with the program previously stored in the control circuit 13. In the case in which the presence of the yarn is detected by the weft sensor 1 at this step S86, the flow of processing returns to the step S81. In the case in which the absence of the yarn is detected by the weft sensor 1, the processing at steps S26' to S39 in FIG. 6 is executed. It will be understood that, in this example, releasing or withdrawing operation of the measuring pawl 10*c* is omitted, thereby simplifying the structure of the control circuit 13.

Figure 7:
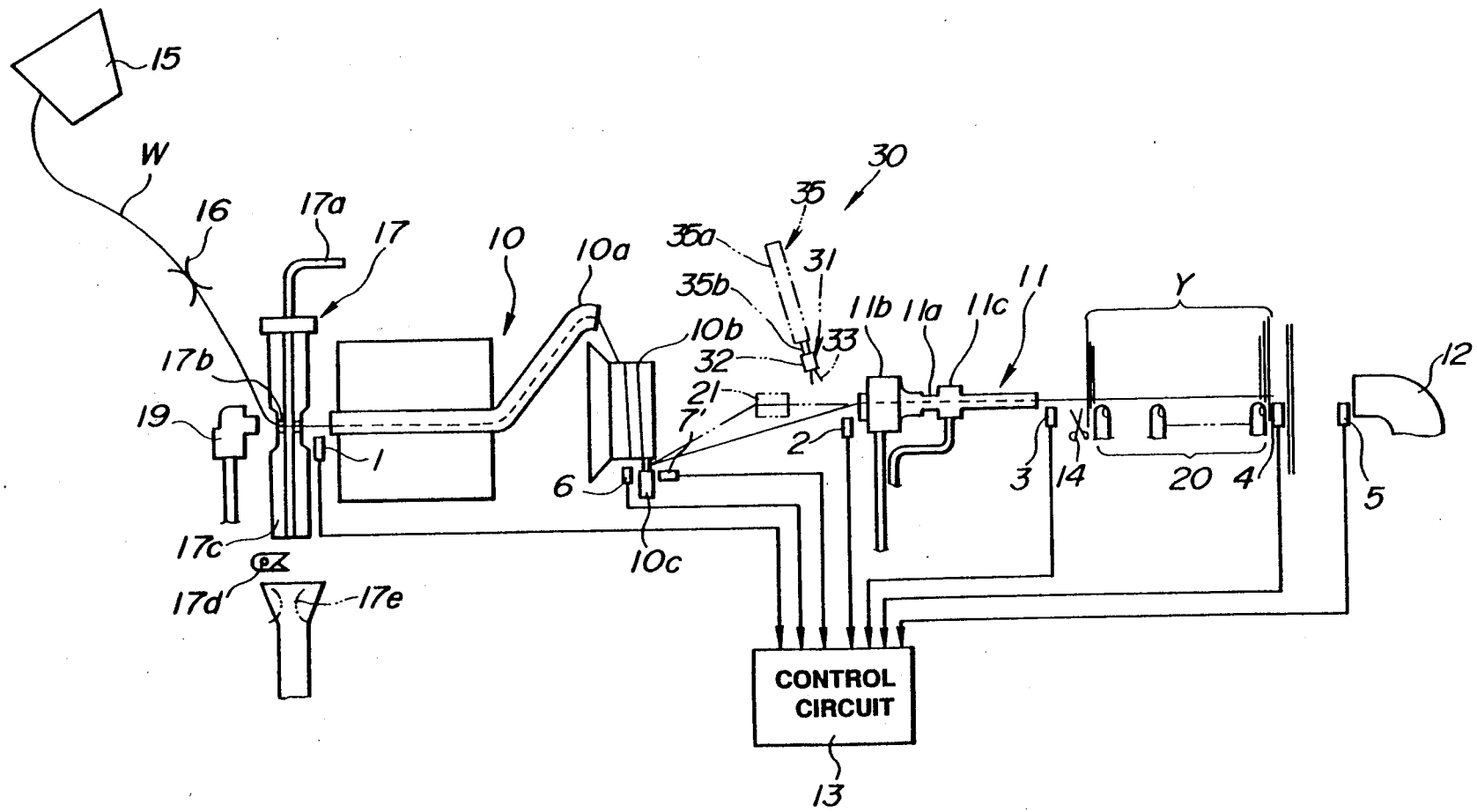
FIGS. 7 to 11 are schematic illustrations of a weft picking system, showing operation of the second embodiment weft treatment system and method.

In the second embodiment, another weft traction device 30 may be provided as indicated in phantom in FIG. 7. The weft traction device 30 is adapted to grasp the mispicked weft yarn Wa extended between the weft inserting nozzle 11 and the weft winding arm 10*a* and to pull it from the side direction thereby effectively hauling in the mispicked weft yarn Wa. This weft traction device 30 is generally constituted by a grasping mechanism 31 and a driving mechanism 35. The grasping mechanism 31 is adapted to grasp or release the weft yarn W and includes an actuator 32 which drives a pair of arms 33 to enable its open and close actions. The driving mechanism 35 includes a hydraulically or pneumatically operated cylinder 35*a* having a movable rod 35*b*. The actuator 32 of the grasping mechanism 31 is attached through a weft tension sensor (not shown) to the movable rod 35*b*.

Upon extension and contraction of the movable rod 35*b*, the grasping mechanism 31 is movable to take a grasping position to grasp the weft yarn W and a withdrawal position at which the weft yarn cannot be grasped. The grasping mechanism 31 makes its reciprocal movement between the grasping position and the withdrawal position in a condition to maintain grasping action of the grasping mechanism 31 under a control in which a predetermined value of tension T applied to the weft yarn W during grasping and pulling of the weft yarn is set at a standard. This reciprocal movement of the grasping mechanism provides vibration to the grasped weft yarn W so as to loose tight contact or uniting of the mispicked weft yarn Wa with the array of the warp yarns Y, thus effectively pulling the weft yarn W toward the weft winding arm 10*a*.

Also in this embodiment, the weft guide 21 having an ejector function may be provided between the weft inserting nozzle 11 and the weft storage unit 10, so that the weft yarn W is inserted from the weft winding arm 10*a* through the weft guide 21 to the weft inserting nozzle 11. In this case, the axis of the tip end section of the weft winding arm 10*a* is directed to the inlet of the weft guide 40. Accordingly, after the mispicked weft yarn Wa is removed, the weft yarn W is blown by air jet from the weft supply nozzle 19 and reaches the inlet of the weft guide 21 through the weft winding arm 10*a*. Then, the tip end section of the weft yarn W is sucked into the weft guide 21 under suction due to the ejector effect at the inlet of the weft guide 21, and thereafter inserted into the weft inserting nozzle 11.

Figure 14:
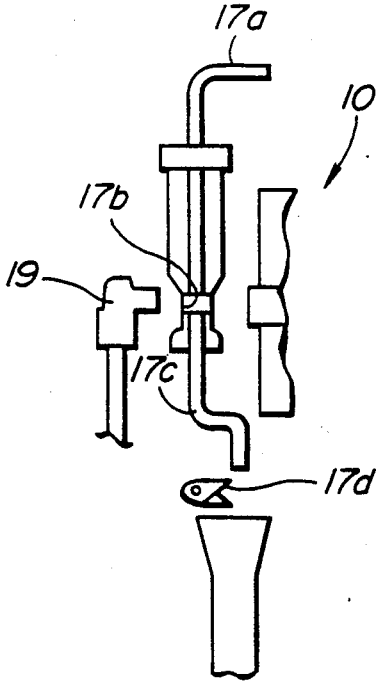
FIG. 14 is a fragmentary schematic illustration of a modified example of a weft traction device to be used in the second embodiment weft treatment system.

While the weft grasping device 17*e* has been shown and described as means for providing restraint to the weft yarn, it will be understood that the weft grasping device 17*e* may be replaced with other weft restraining devices such as one shown in FIG. 14 in which the inner surface of the pipe 17*c* is provided with a material having a larger frictional resistance such as rubber or plastic though not shown. The pipe 17*c* may be bent as shown in FIG. 14 thereby increasing a drawing resistance to the weft yarn.

FIGS. 15 to 22 illustrate a third embodiment of the weft treatment system and method in accordance with the present invention. The method of the third embodiment is summarized as follows:

1st stage . . . Breakage or cutting of a weft yarn is detected.

2nd stage . . . Cutting function for weft yarn is stopped.

3rd stage . . . Weaving operation of a loom is stopped.

4th stage . . . The loom is reversely run thereby exposing a broken weft yarn at the cloth fell of a woven fabric.

5th stage . . . A weft inserting nozzle ejects a fluid jet under a condition in which the presence of yarn is detected by a weft sensor disposed on the upstream side of a weft storage unit and by a breakage sensor disposed on the counter-weft picking side of the array of warp yarns. Upon this fluid jet ejection from the weft inserting nozzle, judgement is made as to whether the breakage of the weft yarn has occured at a position on the warp yarn array side relative to weft inserting nozzle or at a position between the weft inserting nozzle and a weft supply member.

6th stage ... The broken weft yarn is drawn to be removed by a breakage yarn traction device.

The above-mentioned stages will be discussed in detail hereinafter first in a case the weft yarn W is broken or cut in a position between the weft storage unit 10 and the weft inserting nozzle 11 with reference to FIGS. 15 to 17.

The 1st stage:

When the weft yarn W is broken or cut between the weft storage unit 10 and the weft inserting nozzle 11, a breakage signal $Q_5$ (representative of the presence of the yarn) from the yarn breakage sensor 5 is input to the control circuit 13 at a predetermined timing so that the control circuit 13 detects the breakage or cutting of the weft yarn W. The weft breakage sensor 5 is disposed on the inlet side of the breakage yarn traction device which is of the suction type and disposed on the counter-weft picking side relative to the weft sensor 4 (for detecting normal picking).

The 2nd stage:

Upon detection of the brekage of the weft yarn, the control circuit 13 operates to stop the weft yarn cutting function of the loom, i.e., such cutting action of the normally operated cutter 14 as to cut the picked weft yarn in a predetermined length.

The 3rd stage:

The operation of the loom is stopped by stopping the normal rotation of the main shaft (not shown) of the loom under control of the control circuit 13. This stopping of loom operation is normally made at a weaving cycle succeeding the weaving cycle in which the weft yarn breakage is detected.

The 4th stage:

The loom main shaft starts its reverse rotation at a speed lower than the normal operation under control of the control circuit 13, after lapse of a time to complete the stopping of operation of the loom. Then, the reverse rotation of the loom main shaft is stopped under control of the control circuit 13 at a timing at which the reed is located at its backward position in the weaving cycle (in which the weft yarn breakage occurs) and the warp yarns form the maximum shed opening. By this reverse running of the loom, the upper and lower sections of the warp yarns forming the shed are alternately replaced with each other thereby allowing the broken weft yarn leading from the weft inserting nozzle to the warp yarn array to be exposed at the cloth fell P of a woven fabric.

The 5th stage:

The presence of the yarn is detected by the weft sensor 1 located on the upstream side of the weft storage unit 10, while the presence of the yarn is detected by the weft breakage sensor 5. A detection signal $Q_{8-1}$ representing the presence of the yarn from the weft sensor 1 and a weft breakage signal $Q_5$ from the weft breakage sensor 5 are input to the control circuit 13. The control circuit 13 operates a valve arrangement (not shown) for the weft inserting nozzle 11 so that a fluid or air jet is ejected from the weft inserting nozzle 11. At this time, the control circuit 13 is supplied with a detection signal representing whether unwinding of the weft yarn from the drum is made or not. In this case, the weft yarn W is broken or cut at a position between the weft storage unit 10 and the weft inserting nozzle 11 so that the faulty or broken yarn Wa in the warp yarn array does not lead to the weft storage unit 10, while the weft yarn W wound on the drum 10*b* cannot be unwound. Accordingly, the detection signal $Q_{9-1}$ representing no unwinding of the yarn is input to the control circuit 13, and therefore the control circuit 13 makes judgement of the weft yarn W being broken or cut at a position between the weft storage unit 10 and the weft inserting nozzle 11.

Figure 15:
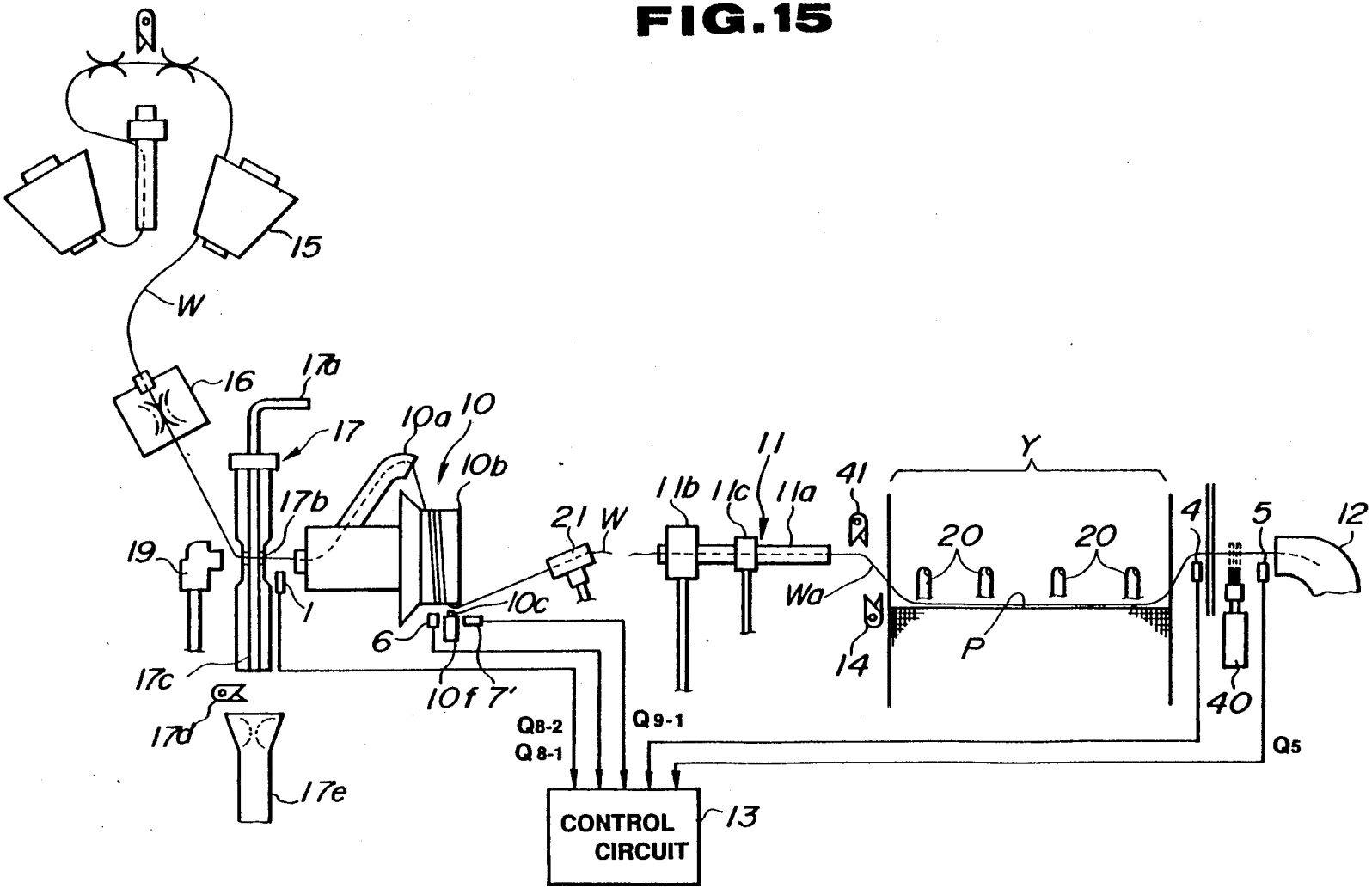
FIGS. 15 to 22 are schematic illustrations of a weft picking system, showing operation of a third embodiment of the weft treatment system and method in accordance with the present invention.

The 6th stage:

In a stage shown in FIG. 15, the control circuit 13 operates the broken yarn traction device 12 of the suction type so that the end section (on the side of the weft breakage sensor 5) of the broken weft yarn Wa is sucked into the suction pipe of the traction device 12. At this time, a weft traction device 40 is operated to apply vertical vibration to the broken weft yarn at a position between the weft sensors 4 and 5. The weft traction device 40 is the same in construction and operation as the weft traction device 30 shown in FIG. 7. Accordingly, the weft traction device 40 is movable between a withdrawal position indicated by solid line and a grasping position indicated in phantom. At the grasping position, the weft traction device 40 grasps the weft yarn Wa. The weft traction device 40 is adapted to make one reciprocal movement between the grasping and withdrawal positions, grasping the weft yarn Wa leading from the cloth fell P to the weft inserting nozzle 11. Otherwise, the weft traction device 40 may repeat such reciprocal movement several times upon grasping the weft yarn Wa, after it releases the weft yarn Wa upon completion of the above-mentioned one reciprocal movement. Thus, under combination of traction force of the weft traction device 40 and suction of the broken yarn traction device 12, the broken weft yarn Wa is securely got out of the warp yarn array to be removed, loosening the uniting of the broken weft yarn Wa with the array of the warp yarns Y.

Figure 16:
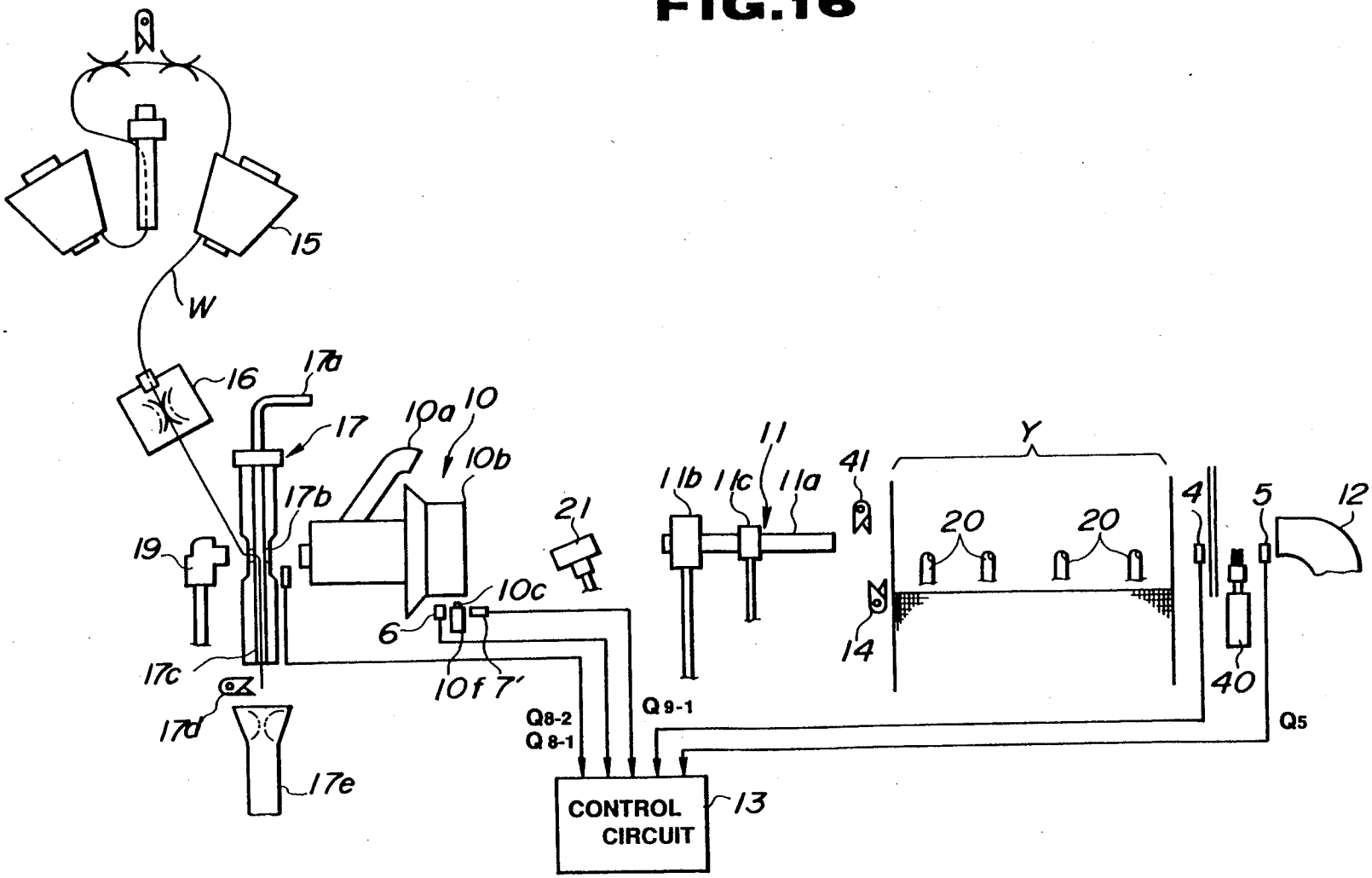

As shown in FIG. 16, since the detection signal $Q_{8-1}$ representative of the presence of the yarn is input from the weft sensor 1 to the control circuit 13, the control circuit 13 controllingly operates the weft tensor 16 disposed between the weft supply member 15 and the weft storage unit 10, the weft storage unit 10, and the weft supply nozzle 19 disposed on the upstream of the weft traction device 17. Thus, the weft yarn W on the upstream side of the weft inserting nozzle 11 is drawn or removed through the weft storage unit 10. More specifically, after the weft yarn W is strongly grasped by the weft tensor 16 to be prevented from drawing from the weft supply member 15, air is ejected from the nozzle 17*a* of the weft traction device 17 to blow the weft yarn W into the yarn introduction opening 17*b* from the side direction thereof, while the weft winding arm 10*a* of the weft storage unit 10 is reversely rotated at a speed lower than that in normal rotation to unwind the weft yarn W wound on the drum 10*b* of the weft storage unit 10. Then, the weft yarn strongly grasped by the tensor 16 is blown into the pipe 17*c* disposed opposite to the nozzle 17*a* under action of an air jet from the nozzle 17*a*, as the weft yarn W unwinds from the drum 10*b*. Then, a detection signal $Q_{8-2}$ representative of the absence of the yarn is output from the weft sensor 1 to the control circuit 13. When the weft winding arm 10*a* is detected to come into a predetermined position by a proximity switch (not shown) or a photoelectric sensor fixedly disposed near the weft winding arm 10*a*, the reverse rotation speed of the weft winding arm 10*a* is further lowered to stop the weft winding arm 10*a*. It will be understood that such lowering the weft winding arm rotation speed allows the weft winding arm 10*a* to accurately stop at the predetermined position. This predetermined position is out of the position of measuring pawl 10*c* of the weft storage unit 10. Then, the weft yarn W is cut by the cutter 17*d*.

It will be understood that the weft winding arm 10*a* is usually driven by a AC pulse motor and therefore increasing braking force for the weft winding arm 10*a* may be accomplished by applying direct current to the pulse motor. Otherwise, in order to increase the braking force, the weft winding arm 10*a* may be provided with a disc brake arrangement. It will be appreciated that accurate stopping of the weft winding arm 10*a* at the predetermined position is preferable from viewpoints of preventing the weft yarn from being caught by the measuring pawl 10*c* when the weft yarn is blown to the weft inserting nozzle side. Additionally, such accurate stopping of the weft winding arm improves the directivity of flying movement of the weft yarn thereby improving accuracy of weft passing into the weft inserting nozzle 11. The cut weft yarn W is sucked into the weft traction device 17*e* to be discarded. Thereafter, air ejection from the nozzle 17*a* is stopped thus completing removing of the faulty weft yarn.

Figure 17:
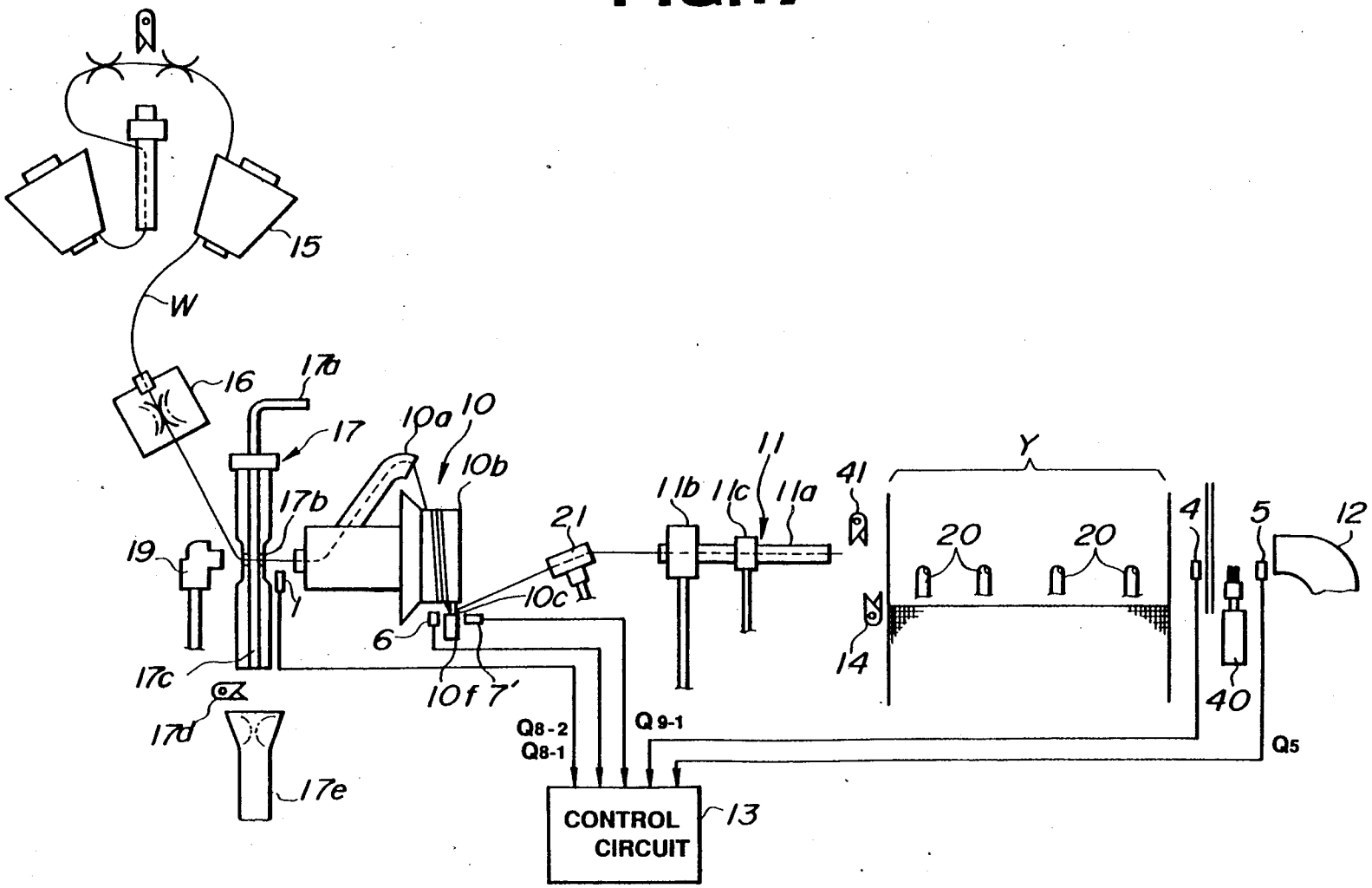

Thereafter, as shown in FIG. 17, the weft yarn W is automatically passed into the weft inserting nozzle 11 via the weft traction device 17, the weft storage unit 10 and the weft guide 21 having an ejector function. More specifically, air jet is ejected from the weft supply nozzle 19 disposed at the inlet of the yarn introduction opening 17*b*, and the weft tensor 16 is repeatedly brought alternately into the weakly grasping or releasing condition and into the strongly grasping condition, while starting air ejection operation of the weft guide 21 and the weft inserting nozzle 11. The air ejection operation of the weft guide 21 develops suction at the inlet of the weft guide 21. The air ejection operation of the weft inserting nozzle 11 is made by air ejection of the first ejector nozzle 11*b* located at the rear end section of the weft inserting nozzle main body 11*a* and by air ejection of the second ejector nozzle 11*c* of the same main body 11*a*, thereby developing suction at the inlet of the main body 11*a*. By this, the weft yarn W extended through the weft traction device yarn introduction opening 17*b* between the weft tensor 16 and the weft storage unit 10 is blown into the weft winding arm 10*a* under the action of air jet ejected from the weft supply nozzle 19. Then, the weft yarn W reaches the inlet of the weft guide 21 and is sucked into the weft guide 21 under the suction developed at the inlet of the weft guide 21. The weft yarn W in the weft guide 21 reaches the vicinity of the inlet of the weft inserting nozzle 11 and is sucked into the main body 11*a* of the weft inserting nozzle 11 under the suction developed near the inlet of the main body 11*a*. Then, the weft yarn W is projected from the weft inserting nozzle 11 under influence of air jets ejected from the first and second ejector nozzles 11*b*, 11*c* and flies toward the counter-weft picking side under the influence of air jets ejected from the auxiliary nozzles 20.

When the presence of the yarn is detected by the weft breakage sensor 5 upon the above flying of the weft yarn W, the weft yarn W is cut at its position near the outlet of the weft inserting nozzle 11 by a cutter 41, and sucked on the side of the warp yarn array by the yarn traction device 12 to remove it. Then, air ejection of the weft supply nozzle 19 and of the second ejector nozzle 11*c*, while setting air pressure of the first ejector nozzle 11*b* at an operational level for weaving operation. Then, weft tensor 16 is set to take its weakly grasping condition, and the measuring pawl 10*c* is inserted into the drum 10*b* of the weft storage unit 10. Additionally, the weft winding arm 10*a* is normally rotated, and the storage amount of the weft yarn in the weft storage unit 10 is detected by the storage amount sensor 6. When the storage amount reaches the predetermined amount more than a level for one pick, the normal rotation of the weft winding arm 10*a* is stopped, so that the loom is brought into a restarting condition.

Next, discussion will be made on a case in which the weft yarn W is broken or cut at a position between the weft supply member 15 and the weft storage unit 10 with reference to FIGS. 18 to 21. In this case, the 1st to 4th stages are the same as in the above-discussed case of FIGS. 15 to 17, and therefore only the 5th and 6th stages will be discussed.

Figure 18:
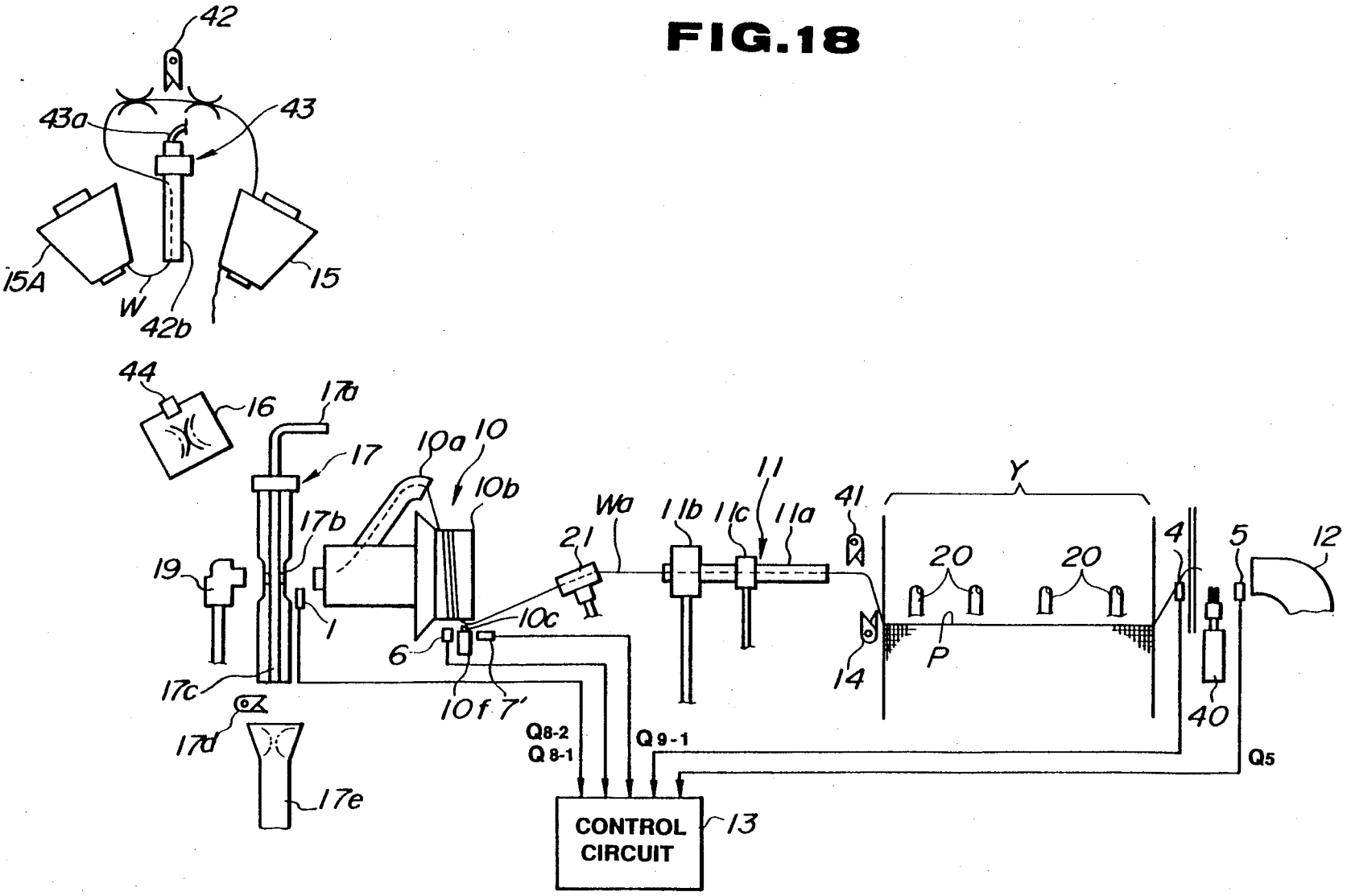

The 5th stage:

As shown in FIG. 18, when the weft yarn W is broken or cut at a position between the weft supply member 15 and the weft storage unit 10, the broken weft yarn Wa gets out of weft tensor 16 and the weft winding arm 10*a* under rotation of the weft winding arm 10*a*, so that the weft sensor 1 detects the absence of the yarn thereby outputting the detection signal $Q_{8\text{-}2}$ representative of the absence of the yarn. This signal $Q_{8\text{-}2}$ is input to the control circuit 13 to stop the operation of the loom, so that the control circuit 13 judges the fact that the weft yarn W is broken or cut at the position between the weft supply member 15 and the weft storage unit 10 in accordance with the previously set program in the control circuit 13.

Figure 19:
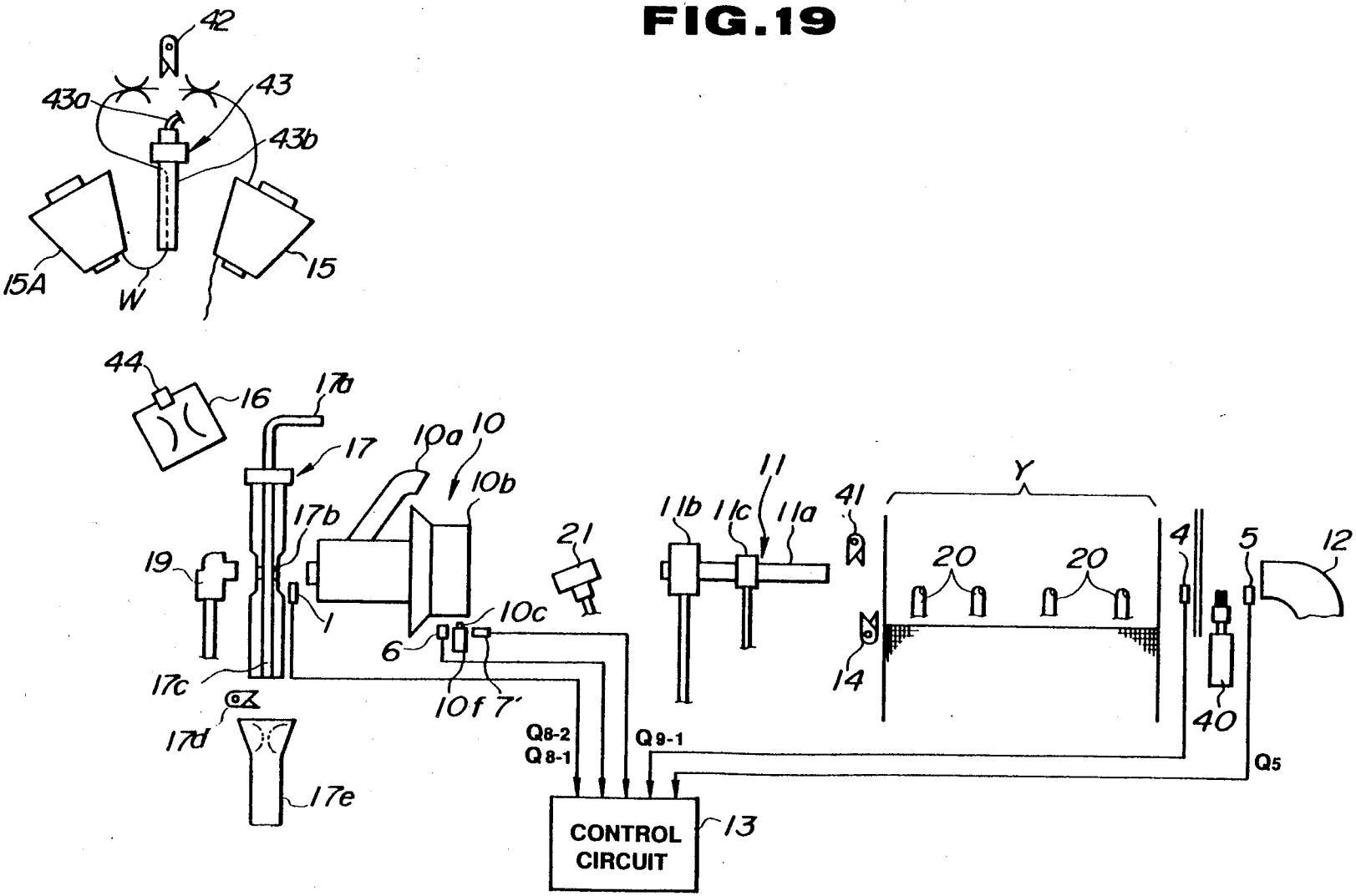

The 6th stage:

As shown in FIG. 19, the control circuit 13 operates to release the measuring pawl 10*c* from the drum 10*b*, to eject air from the weft inserting nozzle 11, and to unwind the faulty or broken yarn Wa from the drum 10*b* of the weft storage unit 10. Additionally, in the stage shown in FIG. 15, the control circuit 13 operates the broken yarn traction device 12 of the suction type so that the end section (on the side of the weft breakage sensor 5) of the broken weft yarn Wa is sucked into the suction pipe of the traction device 12. At this time, a weft traction device 10 is operated to apply vertical vibration to the broken weft yarn at a position between the weft sensors 4 and 5. The weft traction device 40 is the same in construction and operation as the weft traction device 30 shown in FIG. 7. Accordingly, the weft traction device 40 is movable between a withdrawal position indicated by solid line and a grasping position indicated in phantom. At the grasping position, the weft traction device 40 grasps the weft yarn Wa. The weft traction device 40 is adapted to make one reciprocal movement between the grasping and withdrawal positions, grasping the weft yarn Wa leading from the cloth fell P to the weft inserting nozzle 11. Otherwise, the weft traction device 40 may repeat such reciprocal movement several times grasping the weft yarn Wa, after it releases the weft yarn Wa upon completion of the above-mentioned single reciprocal movement. Thus, under combination of the traction force of the weft traction device 40 and suction of the broken yarn traction device 12, the broken weft yarn Wa is securely removed from the warp yarn array to be removed, loosing the uniting of the broken weft yarn Wa with the array of the warp yarns Y.

Figure 20:
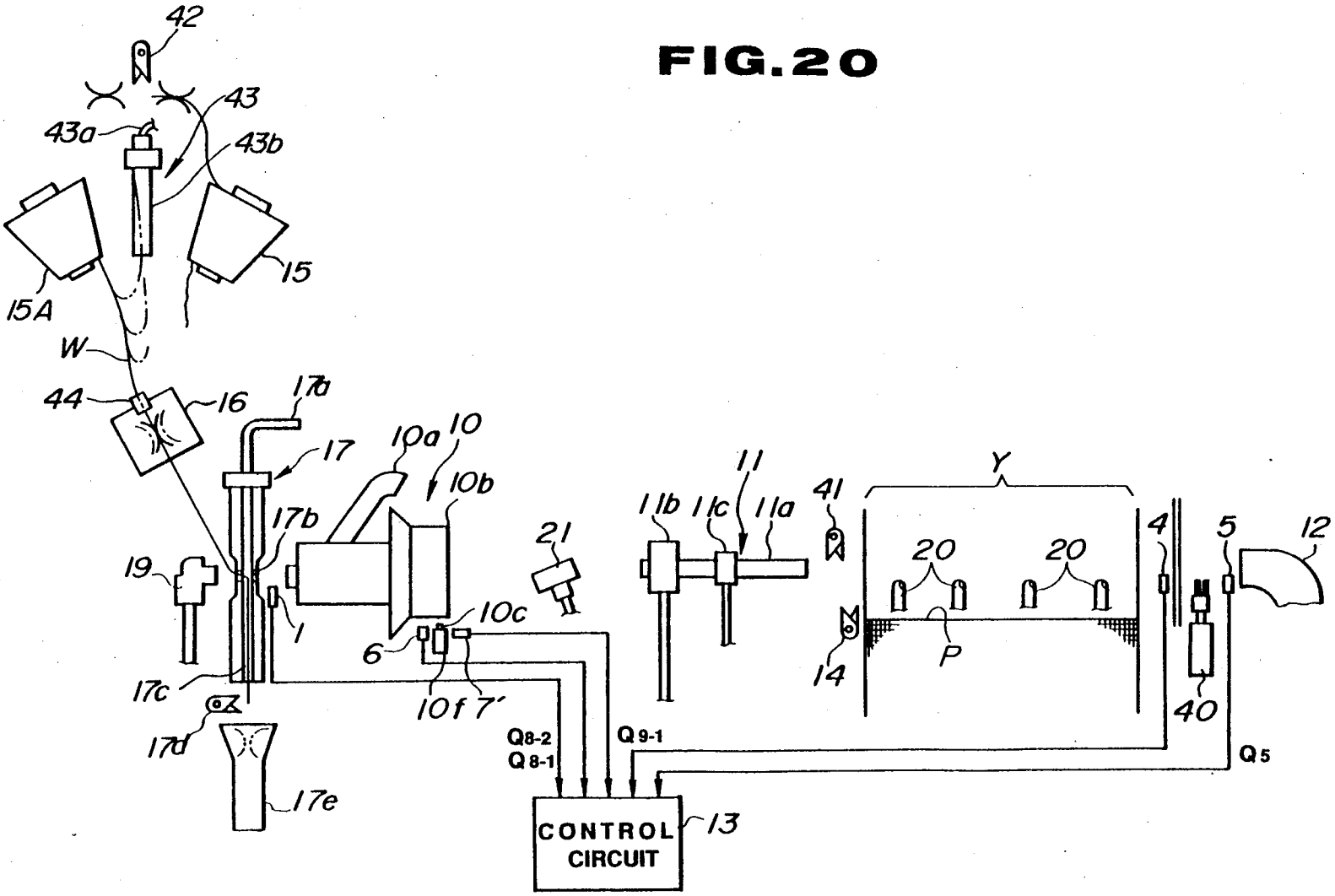

As shown in FIG. 19, the control circuit 13 operates to put the weft tensor 16 into its releasing condition while making the cutting operation of a so-called pig tail cutter 42 thereby cutting a so-called pig tail section of the weft yarn between the weft supply member 15A. Thereafter, as shown in FIG. 20, air ejection is made from the nozzle 43*a* of an auxiliary measuring device 43 in which an end section of the weft yarn is W from the auxiliary weft supply member 15A, from a weft supply nozzle 44 disposed at the inlet of the weft tensor 16 and having an ejector nozzle function, and from the nozzle 17*a* of the weft traction device 17. As a result, the end section of the weft yarn W from the auxiliary weft supply member 15A flies from the measuring pipe 43*b* of the auxiliary measuring device 43 toward the inlet of the weft supply nozzle 22. Then the weft yarn W is drawn into the weft supply nozzle 44 under the suction at the inlet of the weft supply nozzle 44, and thereafter is drawn into the pipe 17*c* of the weft traction device 17 via the weft tensor 16 in the releasing condition and the yarn introduction opening 17*b* of the weft traction device 17 under the influence of air ejection from the weft supply nozzle 44. Then, the cutter 17*d* makes its cutting operation thereby cutting the weft yarn W sucked into the pipe 17*c*.

Figure 21:
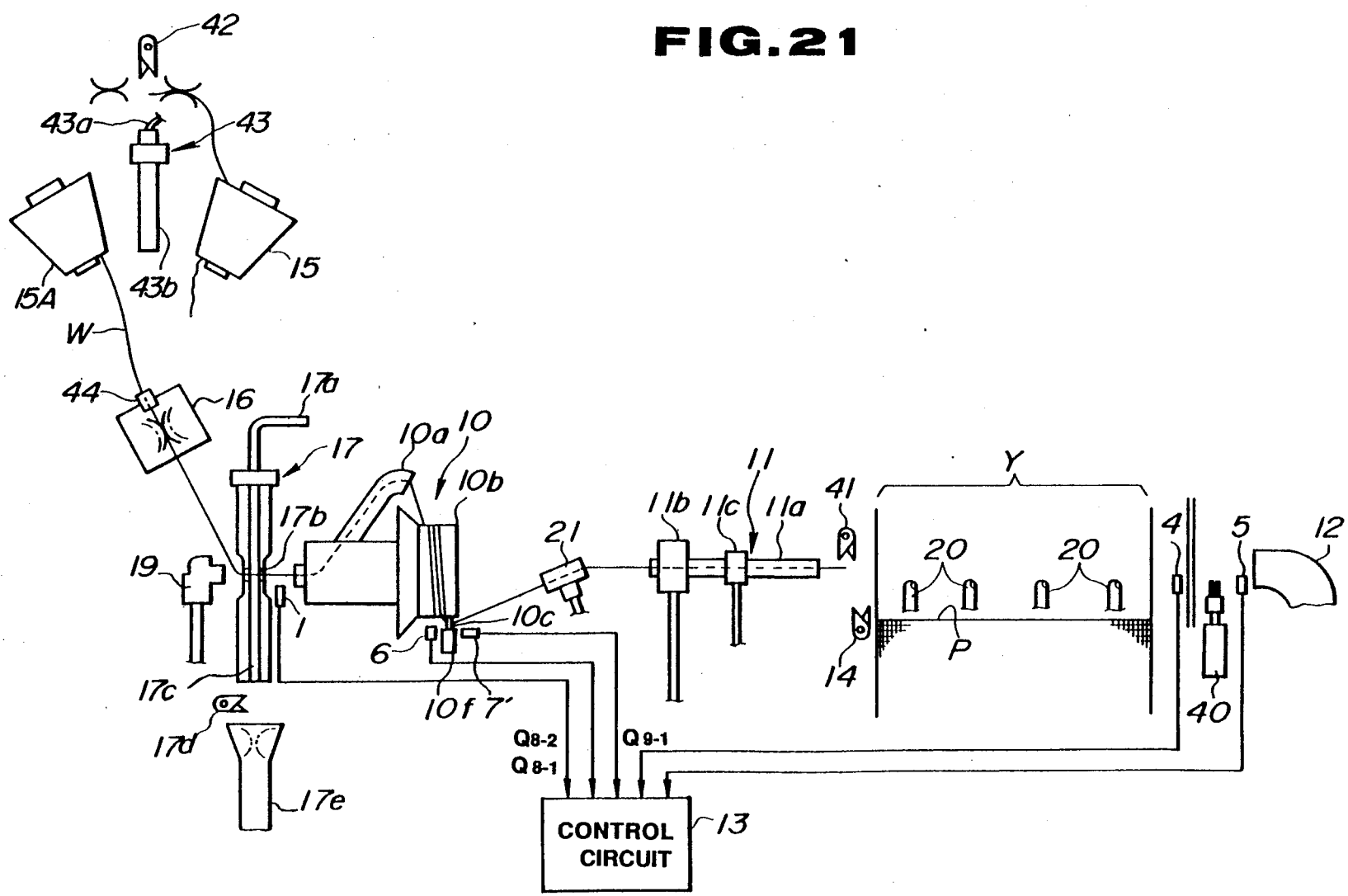
Figure 22:
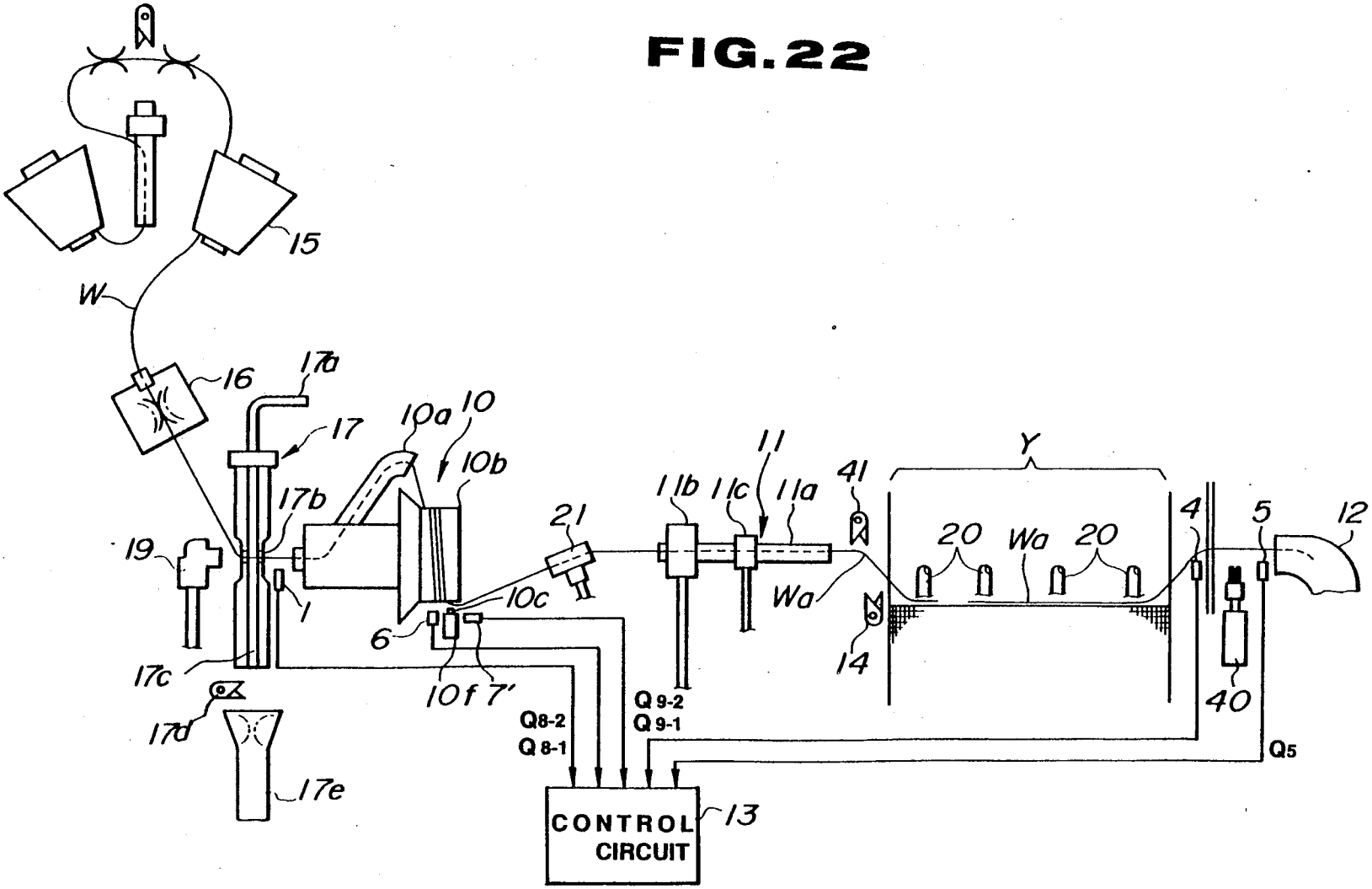

Subsequently, as shown in FIG. 21, the control circuit 13 operates to stop air ejection from the nozzle 43*a* of the auxiliary measuring device 43, from the weft supply nozzle 44 and from the nozzle 17*a* of the weft traction device 17. Additionally, an air jet is ejected from the weft supply nozzle 19 disposed at the inlet of the yarn introduction opening 17*b*, and the weft tensor 16 is repeatedly brought alternately into the weakly grasping or releasing condition and into the strongly grasping condition, while starting air ejection operation of the weft guide 21 and the weft inserting nozzle 11. The air ejection operation of the weft guide 21 develops suction at the inlet thereof. The air ejection operation of the weft inserting nozzle 11 is made by air ejection of the first ejector nozzle 11*b* located at the rear end section of the weft inserting nozzle main body 11*a*and by air ejection of the second ejector nozzle 11*c* located at the intermediate section of the same main body 11*a*, thereby developing suction at the inlet of the main body 11*a*. By this, the weft yarn W extended through the weft traction device yarn introduction opening 17*b* between the weft sensor 16 and the weft storage unit 10 is blown into the weft winding arm 10*a* under the action of air ejected from the weft supply nozzle 19. Then, the weft yarn W reaches the inlet of the weft guide 21 and sucked into the weft guide 21 under the suction developed at the inlet of the weft guide 21. The weft yarn W in the weft guide 21 reaches the vicinity of the inlet of the weft inserting nozzle 11 and sucked into the main body 11*a* of the weft inserting nozzle 11 under the suction developed near the inlet of the main body 11*a*. Then, the weft yarn W is projected from the weft inserting nozzle 11 under influence of air jets ejected from the first and second ejector nozzles 11*b*, 11*c* and flies toward the counter-weft picking side under the influence of air jets ejected from the auxiliary nozzles 20.

When the presence of the yarn is detected by the weft breakage sensor 5 upon the above flying of the weft yarn W, the weft yarn W is cut at its position near the outlet of the weft inserting nozzle 11 by a cutter 41, while being sucked on the side of the warp yarn array by the yarn traction device 12 to remove it. Then, air ejection of the weft supply nozzle 19 and of the second ejector nozzle 11*c*, while air pressure of the first ejector nozzle 11*b* is set at an operational level for weaving operation. Then, the weft sensor 16 is set to take its weakly grasping condition, and the measuring pawl 10*c* is inserted into the drum 10*b* of the weft storage unit 10. Additionally, the weft winding arm 10*a* is normally rotated, and the storage amount of the weft yarn in the weft storage unit 10 is detected by the storage amount sensor 6. When the storage amount reaches the predetermined amount more than a level for one pick, the normal rotation of the weft winding arm 10*a* is stopped, so that the loom is brought into restarting condition.

Next, a case in which the weft yarn W is cut on the side of the warp yarn array relative to the weft inserting nozzle 11 will be discussed with reference to FIG. 15. In this case, the weft breakage signal $Q_5$ from the weft breakage sensor 5 is input to the control circuit 13, so that the loom is reversely run and stopped after the weaving operation of the loom is stopped while the measuring pawl 10*c* gets out of the drum 10*b*. In this stopping condition, the control circuit 13 inspects the detecting conditions of weft sensor 1 and the weft breakage sensor 5, in which the weft sensor 1 outputs the weft presence detection signal $Q_{8\text{-}1}$ to the control circuit 13 while the weft breakge sensor 5 outputs the weft breakage signal $Q_5$ to the control circuit 13. In this condition in which the presence of the yarn is detected by the weft sensor 1 and the weft breakage sensor 5, when air ejection is ejected from the weft inserting nozzle 11, weft yarn W leading from the weft storage unit 10 to the weft inserting nozzle 11 is projected from the weft inserting nozzle 11 so that the weft yarn W is unwound from the drum 10*b* of the weft storage unit 10. Accordingly, a detection signal $Q_{9\text{-}2}$ representative of unwinding of the weft yarn is input from the weft unwinding sensor 7' to the control circuit 13. As a result, the control circuit 13 makes a judgement of the weft yarn being broken or cut on the side of the array of the warp yarns Y relative to the weft inserting nozzle 11.

FIGS. 23 to 26 illustrate a fourth embodiment of the weft treatment system and method in accordance with the present invention, which is similar to the first embodiment. In this embodiment, the weft yarn W from the weft supply member 15 is introduced to the weft storage unit 10. The storage unit 10 includes a rotatable body 10*e* which is driven by a motor (not shown). The drum 10*b* is relatively rotatably supported to the rotatable body 10*e* and maintained in its stationary state. The measuring pawl 10*c* is driven by an electromagnetically operated actuator 10*f* so as to be projected into or released (withdrawn) from a hole (not shown) formed on the peripheral surface of the drum 10*b* at a part near the end thereof. The weft winding arm 10*a* is installed to the rotatable body 10*e* in such a manner as to rotate together with the rotable body 10*e* as a single unit. The weft winding arm 10*b* functions to wind the weft yarn W on the drum 10*b*.

The weft yarn W from the weft storage unit 10 is introduced to the weft inserting nozzle 11. The weft inserting nozzle 11 is provided with the first ejector an nozzle 11*b* for ejecting air jet to accomplish weft picking and the second ejector nozzle 11*c* for ejecting an air jet to pass the weft yarn into the weft inserting nozzle main body 11*a*.

The weft supply nozzle 19 is disposed near the inlet of the pipe-like weft winding arm 10*a* to blow, the weft yarn W into the weft winding arm 10*a*. An air jet from the weft supply nozzle 19 is passed through the inside of the weft winding pipe 10*a* and ejected from the outlet of the weft winding arm 10*a* as indicated by an arrow-headed broken line A and directed to a booster 50. The booster 50 includes a large diameter pipe whose one end is disposed near the rear end of the weft inserting nozzle 11. The other end of the booster 50 is connected through a valve (not shown) to the suction opening of a blower (not shown). A cutter 51 is disposed within the booster 50. Additionally, the weft traction device 12 is disposed on the counter-weft picking side in a weft picking path through which the weft yarn is picked and flies.

The control circuit 13 is provided to controllably drive the motor for driving the rotatable body 10*e*, the electromagnetic actuator 10*f*, a variety of control valves for ejector nozzles 11*b*, 11*c*, the weft supply nozzle 19, the booster 50, and the cutter 51.

The weft storage or wound amount sensor 6 of the photoelectric type is disposed facing to the peripheral surface of the drum 10*b* and adapted to output a signal representing the wound amount of the weft yarn on the drum 10*b*. The weft unwinding sensor 7' of the photoelectric type is disposed near the front end of the drum 10*b* and adapted to output a signal representing the number of unwinding of the weft yarn unwound from the drum 10*b*. The weft sensor 2 of the photoelectric type is disposed near the inlet of the weft inserting nozzle 11 to detect the breakage of the weft yarn at a position between the weft storage unit 10 and the weft inserting nozzle 11. Additionally, a weft sensor 52 of the photoelectric type is disposed within the booster 50 to detect the presence or absence of the weft yarn within the booster 50. The reference numerals 53, 54, 55 and 56 designate weft end catch cords, a reed, a cutter on the counter-weft picking side, and a woven fabric, respectively.

The manner of operation of the fourth embodiment weft treatment system will be discussed hereinafter.

During weaving operation of the loom, the weft winding arm 10*a* rotates around the drum 10*b* with rotation of the rotatable body 10*e* under operation of the motor, so that the weft yarn W is wound on the drum 10*b* to be measured and stored prior to weft picking. Here, the rotation and stopping of the rotatable body 10*e* is controlled in such a manner that a predetermined weft wound amount (for example, an amount corresponding to 10 to 15 picks) is always held on the drum 10*b* under a condition in which the weft wound amount is detected by the weft storage amount sensor 7'.

In weft picking, the first ejector nozzle 11*b* of the weft inserting nozzle 11 starts air ejection to accomplish a predetermined previous air ejection. Thereafter, the electromagnetic actuator 10*f* is operated to release engagement of the weft yarn from the measuring pawl 10*c*, so that weft yarn W is unwound and drawn out from the drum 10*b* to initiate weft picking.

The number of unwinding of the weft yarn from the drum 10*b* is watched by the weft unwinding sensor 7'. When the number of signals generated from the unwinding sensor 7' reaches N on the assumption that N times of turns of the weft yarn on the drum correspond to a weft yarn length for one pick, the electromagnetic actuator 10*f* operates so that the measuring pawl 10*c* is inserted into the drum 10*b*. As a result, the weft yarn W engages with the measuring pawl 10*c* in a condition where N times of unwinding of the weft yarn from the drum 10*b* has been completed, thereby achieving a weft picking. The end section of the thus picked weft yarn W is caught under suction generated by the weft traction device 12. After the beating-up operation by reed 54, the weft yarn W is cut on the weft picking side by the cutter 14 and on the counter-weft picking side by the cutter 55.

Figure 24:
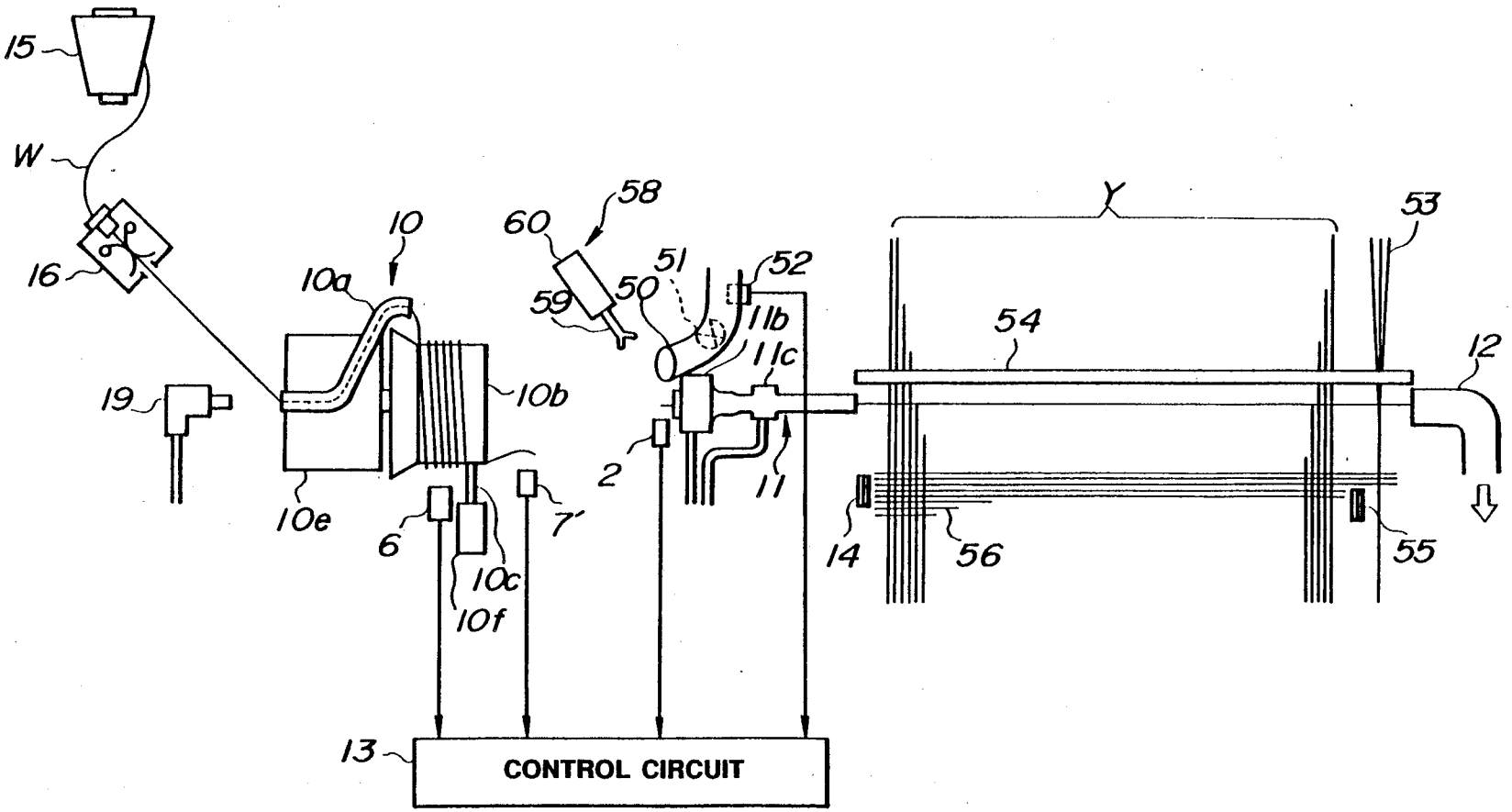

Next, discussion will be made on a case where the weft yarn W is broken or cut at a position between the weft storage unit 10 and the weft inserting nozzle 11 as shown in FIG. 24.

In this case, since the weft yarn W located forward of the weft sensor 2 becomes absent, a signal representative of weft yarn breakage is input from the weft sensor 2 to the control circuit 13. In accordance with this, the control circuit 13 operates as follows:

First the operation of the loom is stopped at a predetermined phase or rotational angle of the loom main shaft. The weft yarn W on the side of the weft inserting nozzle 11 relative to the broken position is picked as it is and therefore sucked into the weft traction device 12 as shown in FIG. 24.

Figure 25:
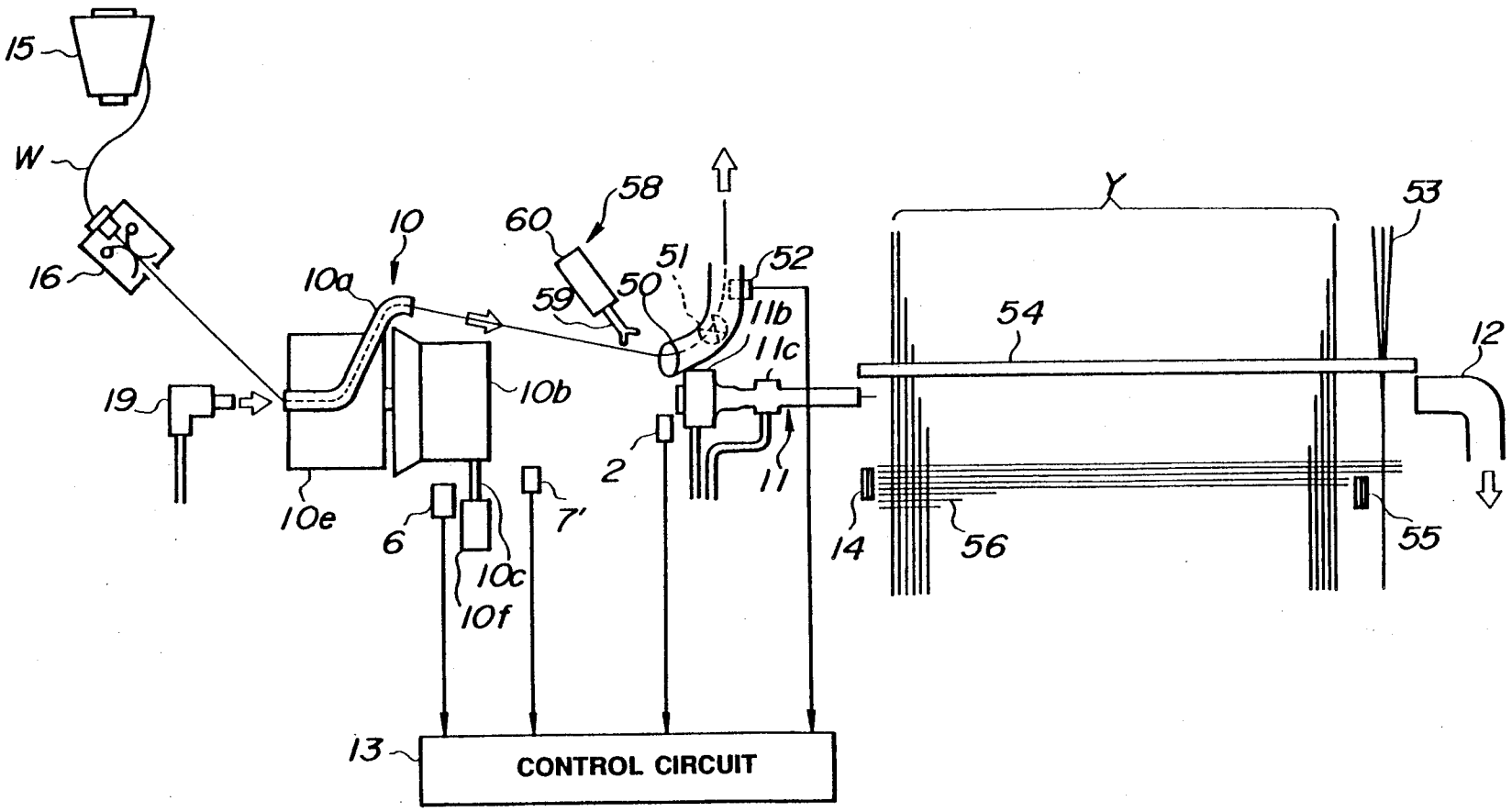
Figure 26:
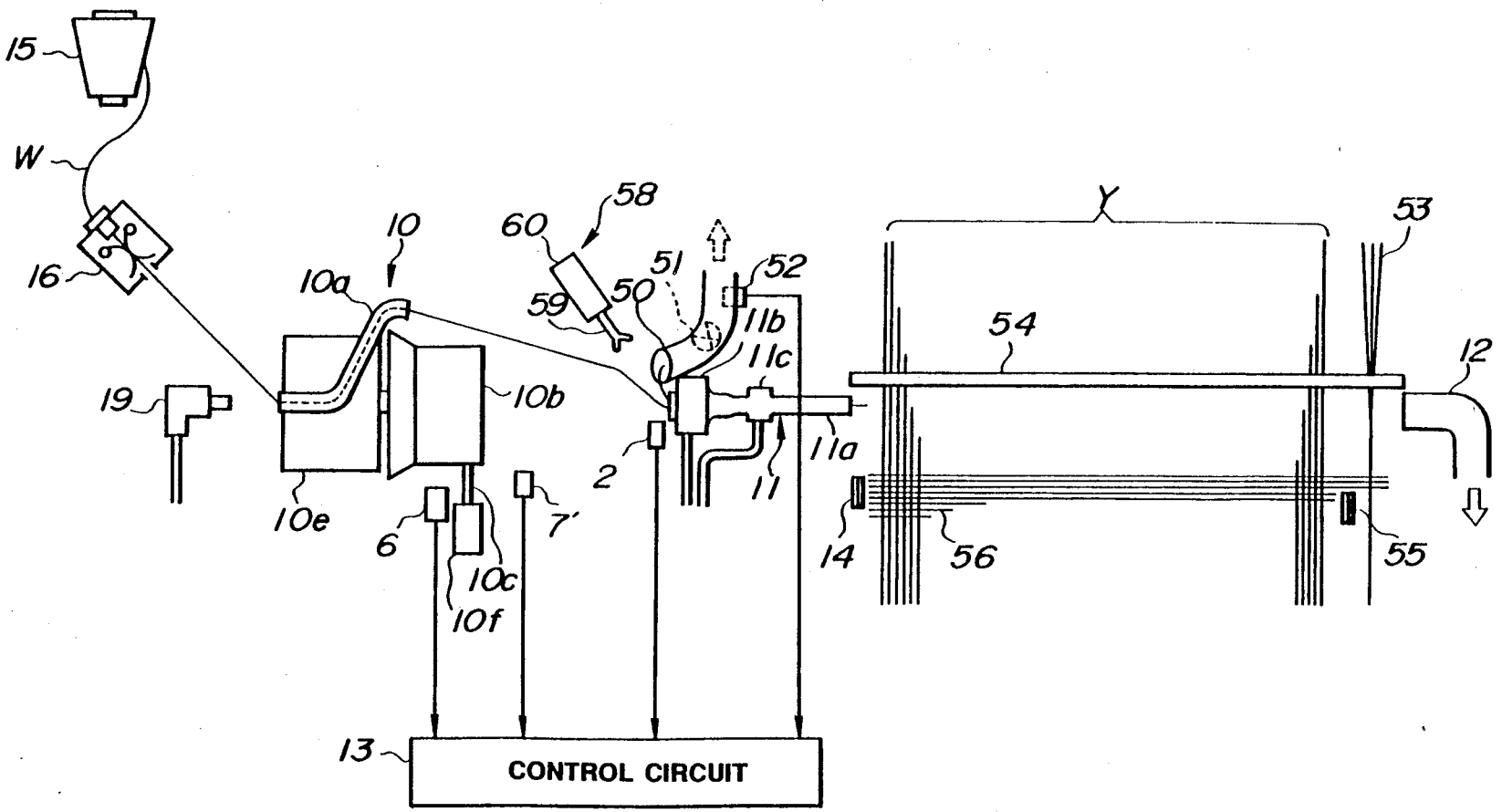

Subsequently, as shown in FIG. 25, the electromagnetic actuator 10*f* is operated to withdraw the measuring pawl 10*c* from the drum 10*b*, thereby releasing engagement of the measuring pawl 10*c* from the drum 10*b*.

Thereafter, air ejection is made from the weft supply nozzle 19 at a predetermined time, while initiating suction operation of the booster 50. At this time, an air jet from the yarn supply nozzle 19 is passed through the inside of the pipe of the weft winding arm 10*a* and ejected from the outlet of the pipe. Under this air jet from the weft winding arm 10*a*, the weft yarn W is blown toward and sucked into the booster 50 as shown in FIG. 25. Since the booster 50 has a larger inlet diameter, the weft yarn W can be easily received by the booster 50 without clogging even if the weft yarn W is sucked in a entangled condition. Then, the cutter 51 in the booster 50 is operated to cut off an excess portion of the weft yarn W.

Then such suction operation of the booster 50 is stopped while starting air ejection from the second ejection nozzle 11*c* of the weft inserting nozzle 11 so that suction is generated at the inlet of the weft inserting nozzle 11. Thus, the weft yarn W is smoothly passed into the weft inserting nozzle 11.

Figure 23:
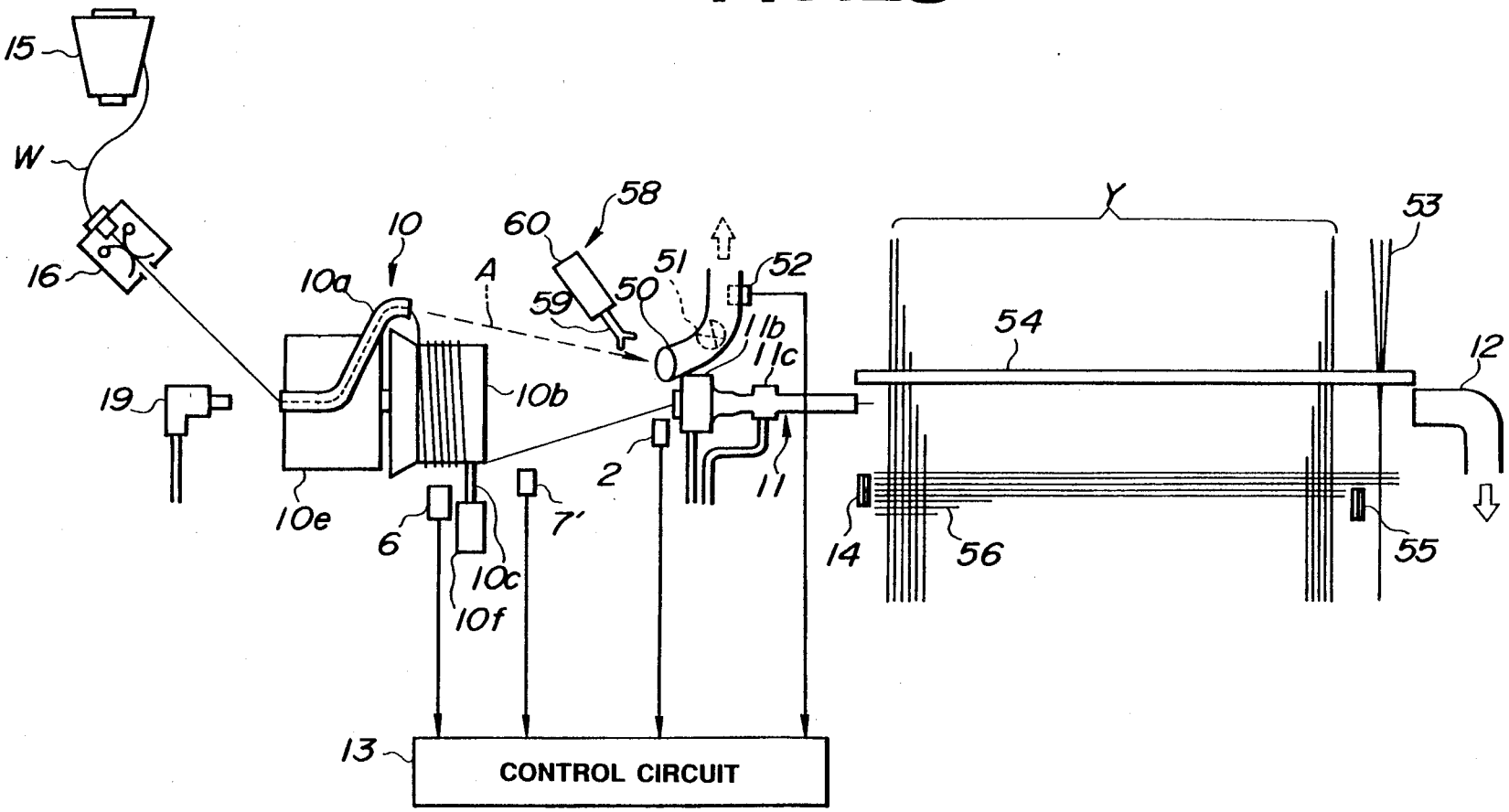
FIG. 23 to 26 are schematic illustrations of a weft picking system, showing operation of a fourth embodiment of the weft treatment system and method in accordance with the present invention.

In this case, a mechanical transferring device 58 may be provided near the booster 50 to facilitate the transferring action of the weft yarn W from the booster 50 to the weft inserting nozzle 11 as shown in FIG. 23. The mechanical transferring device 58 includes a fork-like member 59 contactable with the weft yarn W. The fork-like member 59 is operated by an electromagnetic actuator 60. While the weft inserting nozzle 11 has been shown and described as being provided with the ejector nozzle 11*c* only for generating suction at the inlet of the weft inserting nozzle 11, it will be understood that it may be replaced with a usual weft inserting nozzle without the ejector nozzle 11*c*.

Thereafter, in order to treat an excessive portion of the weft yarn W, air ejection from the weft inserting nozzle 11 is made thereby allowing the weft traction device 12 to suck the weft yarn W. Subsequently, the electromagnetic actuator 10*f* is operated to insert the measuring pawl 10*c* into the drum 10*b*. Then the cutter 14 on the weft picking side is operated to cut the weft yarn W, and the thus cut weft yarn is sucked into the weft traction device 12 to be moved. Then, the rotatable body 10*e* of the weft storage unit 10 is rotated thereby to wind a predetermined amount of the weft yarn W on the drum 10*b*. Thus, the loom stands ready for restarting.

It will be understood that, in this embodiment, the weft traction device 17 as same as in the first embodiment may be provided though not shown, in which the faulty weft yarn is drawn to the side of the weft supply member 15 relative to the weft storage unit 10 to be removed.

Figure 27:
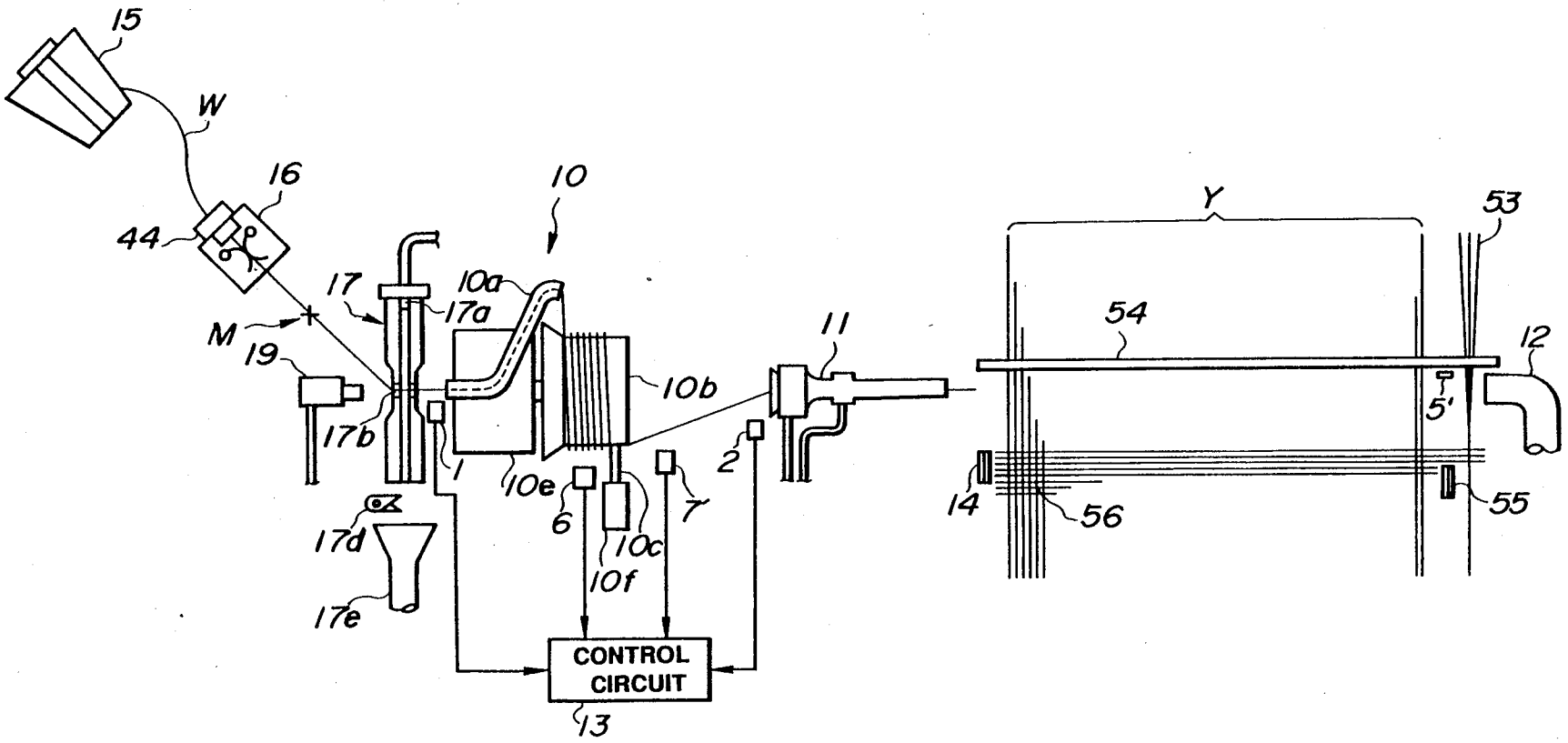
FIG. 27 is a schematic illustration of a weft picking system, showing a fifth embodiment of the weft treatment system and method in accordance with the present invention.
Figure 28:
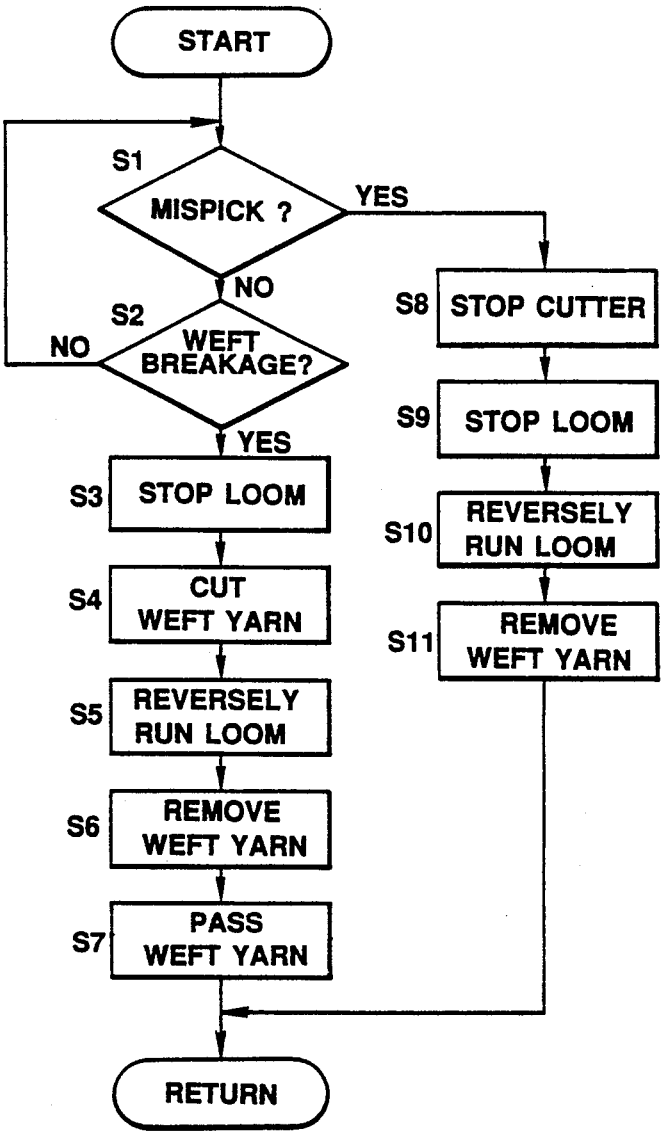
FIG. 28 is a flowchart of processing of the fifth embodiment weft treatment system and method of FIG. 27.

FIGS. 27 and 28 illustrate a fifth embodiment of the weft treatment system and method in accordance with the present invention, which is similar to the fourth embodiment. In this embodiment, the weft traction device 17 as same as in the first embodiment is provided. The cutter 17*d* and the weft grasping device 17*e* as same as in the first embodiment is provided in combination with the weft traction device 17. The weft sensor 1 of the photoelectric type is disposed between the weft traction device 17 and the weft storage unit 10 to detect breakage of the weft yarn at a position between the weft supply member 15 and the weft storage unit 10. More specifically, the weft sensor 1 is located at the inlet of the pipe-shaped weft winding arm 10*a* and adapted to output a signal representative of the presence or absence of the weft yarn. A weft sensor 5' is disposed on the counter-weft picking side to detect mispick. Additionally, the weft tensor 16 is provided at its weft inlet side with a nozzle 44 for introducing the weft yarn.

This embodiment operates as follows: During operation of the loom, according to the flowchart of FIG. 28, occurrence of mispick is watched in response to a signal from the weft sensor 5' at step S1. At step S2, breakage or cutting of the weft yarn W is watched in response to signal output from the weft sensors 1, 2.

When breakage or cutting is made at a position (indicated by the character M) between the weft supply member 15 and the weft storage unit 10, the signal (weft breakage detection signal) representative of absence of the yarn is fed from the weft sensor 1 to the control circuit 13. In response to this signal, the judgement is made at a step S2 as to whether the weft yarn is broken or not. In accordance with this judgement, processing from steps S3 to S7 are executed.

First at step S3, a loom stopping circuit (not shown) is operated to stop the operation of the loom. This loom stopping is carried out at a predetermined operational phase after beating-up of the picked weft yarn whose weft picking has not yet been completed at the time of the mispick. During a time period extending to the loom stopping, operation of the cutter 14 is continued. Accordingly, cutting of the weft yarn W is carried out at step S4, so that the weft yarn beaten up in a process of loom stopping is cut at a position between the weft inserting nozzle 11 and the woven fabric 56 to form a part of the woven fabric. Subsequently, the loom main shaft is reversely rotated by an operational angle of 180 degrees at step S5. At step S6, an air jet is ejected from the weft inserting nozzle 11 to remove the faulty weft yarn W passing through the weft storage unit 10 and the weft inserting nozzle 11. Then, the faulty weft yarn W is drawn from weft storage unit 10 and picked to reach the pipe of the weft traction device 12 located on the counter-weft picking side, so that the faulty weft yarn is sucked into the weft traction device 12 to be removed.

Next, at step S7, the operation of passing the weft yarn is carried out as follows:

The weft tensor 16 is opened to release the weft yarn W while the nozzle 19 is operated to eject air, so that the weft yarn is blown toward the yarn introduction opening 17*b* which being is drawn from the weft supply member 15. At this time, an air jet is ejected from the nozzle 17*a* of the weft traction device 17 into the pipe 17*c*, so that the weft yarn W is sucked through the yarn introduction opening 17*b* into the pipe 17*c* to be introduced into the suction pipe 17*e*. When the weft yarn W is introduced into the suction pipe 17*e*, the cutter 17*d* is operated to cut the weft yarn W.

Subsequently, an air jet is ejected from the weft supply nozzle 19 flows through the yarn introduction opening 17*b* to the pipe of the weft winding arm 10*a* so as to be ejected from the outlet of the weft winding arm pipe. Accordingly, the leading end of the weft yarn W drawn from the weft supply member 15 is blown to the weft inlet at the rear end of the weft inserting nozzle 11 under the influence of the above-mentioned air jet. At this time, air jet ejection is made also from the weft inserting nozzle 11, by which suction is developed at the weft inlet of the weft inserting nozzle 11. Under this suction, the leading end of the weft yarn W from the weft winding arm 10*a* is sucked into the weft inserting nozzle 11. Thus, the weft yarn W can be smoothly passed into the weft inserting nozzle 11.

Then, the weft yarn W is blown to and sucked into the weft traction device 12 on the counter-weft picking side. Subsequently, the cutter 14 is operated to cut the weft yarn W at a position near the tip end of the weft inserting nozzle 11, so that the cut weft yarn is sucked into the weft traction device 12 to be removed. Thereafter, the rotatable body 10*e* is rotated by the motor so as to wind a predetermined amount of the weft yarn W on the drum 10*b* of the weft storage unit 10, thus standing ready for restarting.

In the event that mispick occurs, processing is carried out as follow: When the mispick is detected in response to a signal representative of absence of the yarn from the weft sensor 5' on the counter-weft picking side, the processing goes from the step S8, stop cutter to step S9, stop the operation of the loom. In this condition, the mispicked weft yarn leads to the weft inserting nozzle 11. After the stopping of loom operation, the loom main shaft is reversely rotated at a step S10 thereby exposing the mispicked weft yarn at the cloth fell of the woven fabric. Then, air ejection is made from the weft inserting nozzle 11 at a step S11 to draw off the mispicked weft yarn from the cloth fell and to blow it to the suction pipe of the weft traction device 12 on the counter-weft picking side.

It will be understood that the mispicked weft yarn may be pulled by the weft traction device 17 on the side of the weft supply member 15 relative to the weft storage unit 10 and sucked into the pipe 17*e* to be removed.

Figure 29:
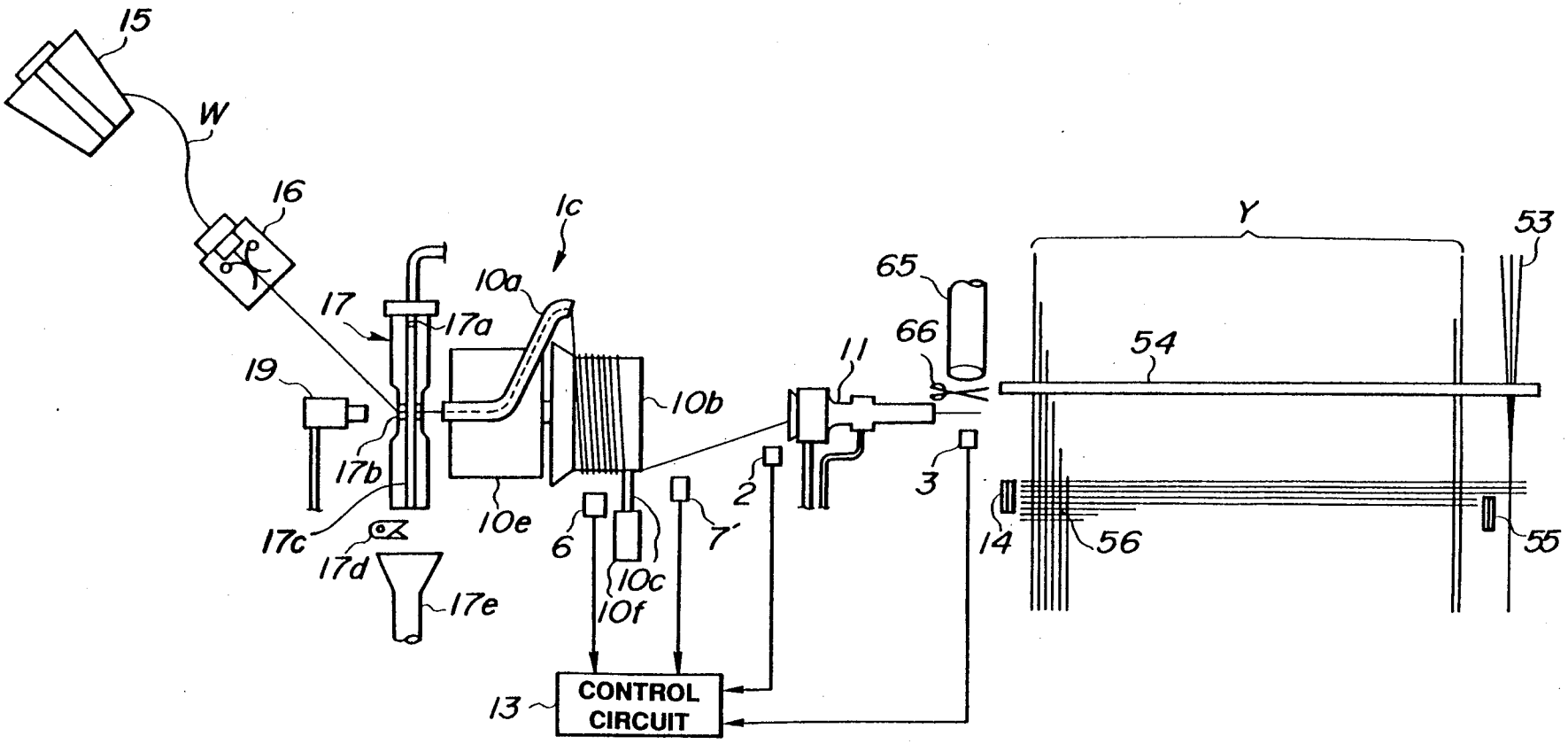
FIGS. 29 to 31 are schematic illustrations of a sixth embodiment of the weft treatment system and method in accordance with the present invention.
Figure 30:
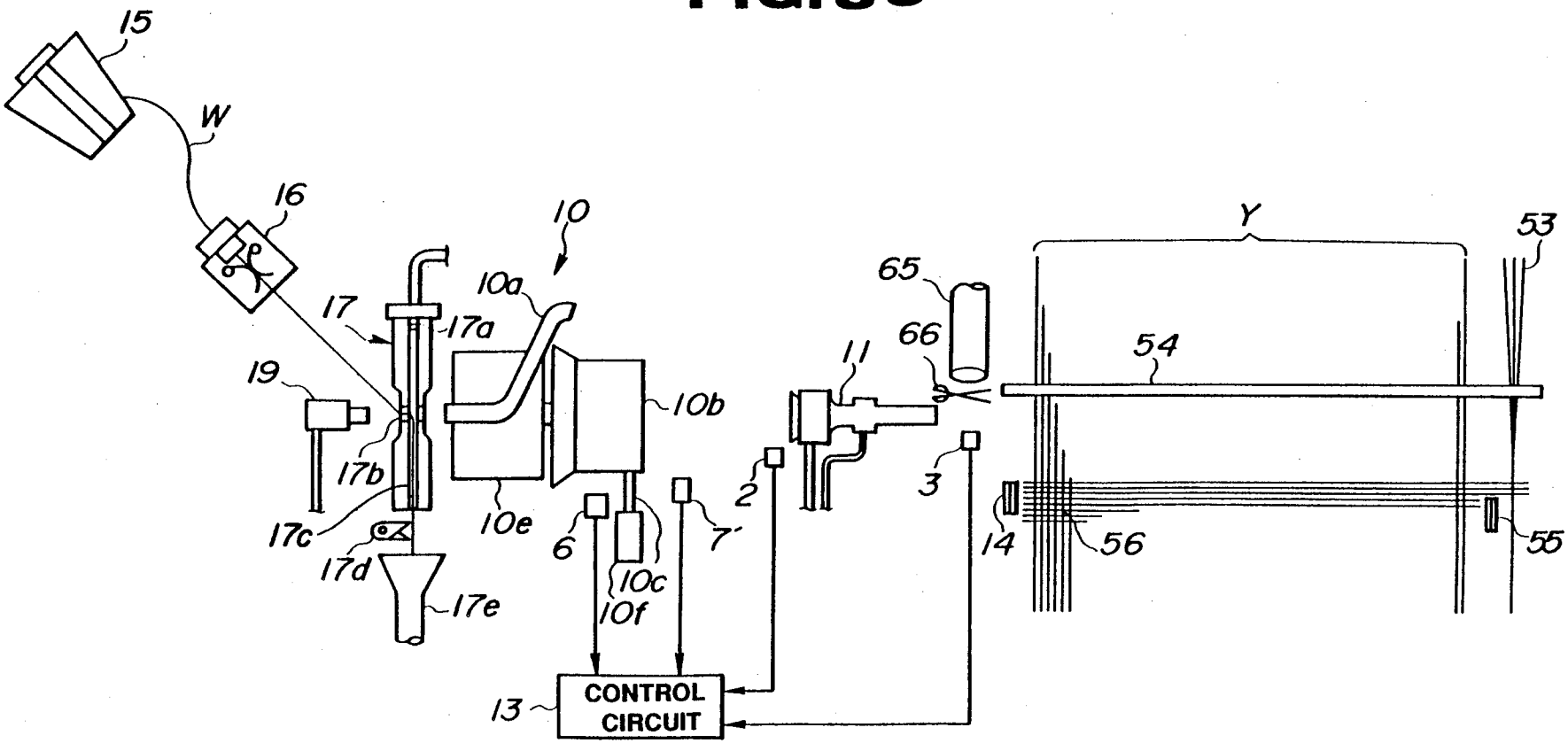
Figure 31:
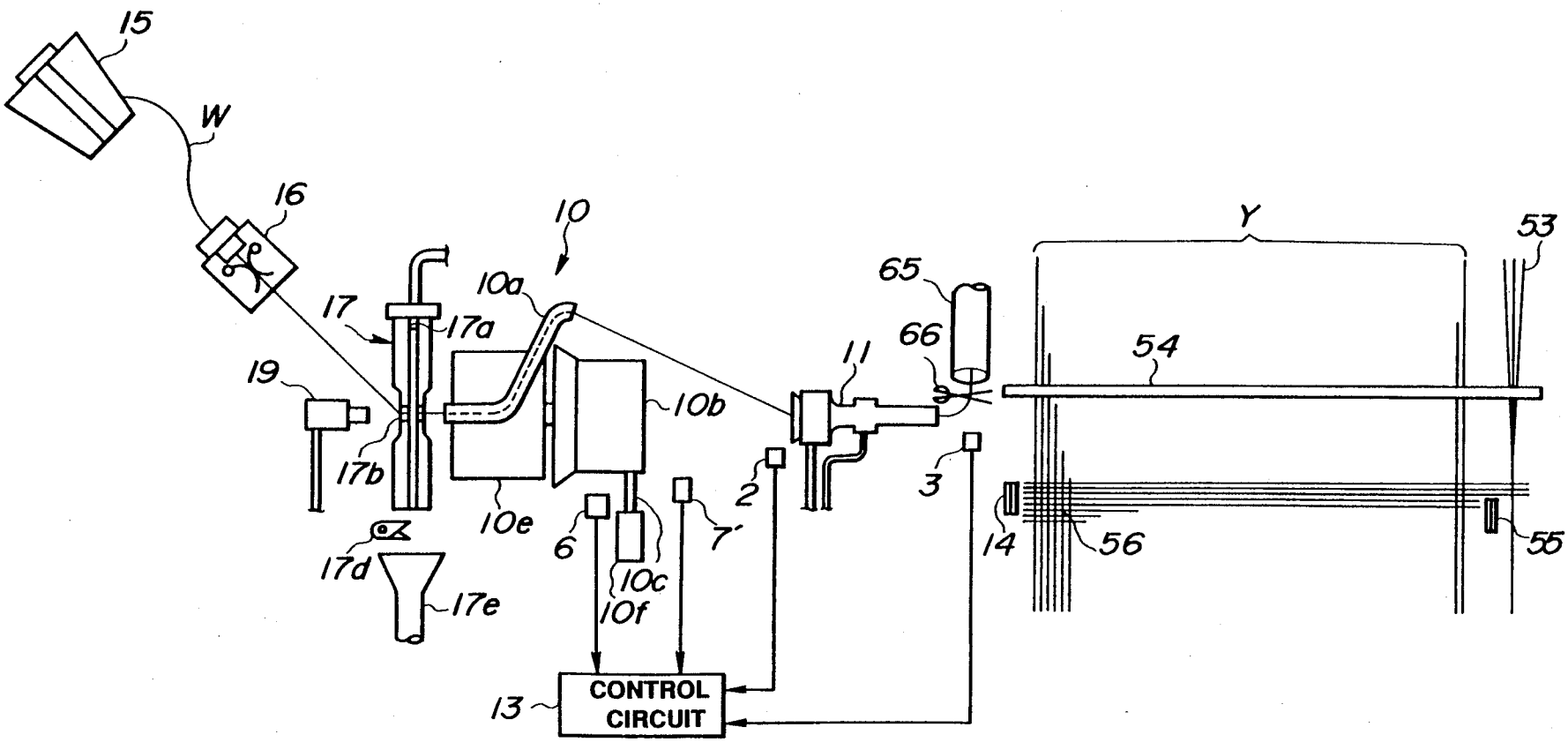

FIGS. 29 to 31 illustate a sixth embodiment of the weft treatment system and method according to the present invention, similar to the fifth embodiment. In this embodiment, a suction pipe 65 is provided near the weft inserting nozzle 11 in such a manner that its one end is opened near the tip end of the weft inserting nozzle 11. The other end of this suction pipe 65 is fluidly connected through a valve (not shown) to a blower (not shown). Additionally, a cutter 66 is provided between the open end of the suction pipe 65 and the weft inserting nozzle 11.

With this embodiment, in order to remove a faulty or mispicked weft yarn in the event that the weft yarn is broken or cut at a position between the weft storage unit 10 and the weft inserting nozzle 11, the weft winding arm 10*a* is reversely rotated upon rotation of the rotatable body 10*e* by the motor, so that the weft yarn W wound on the drum 10*b* is unwound. At this time, an air jet is ejected from the nozzle 17*a* into the pipe 17*c* through the yarn introduction opening 17*b* in which the weft yarn W is passed. Accordingly, as shown in FIG. 30, the unwound weft yarn W is forced into the pipe 17*c*. The thus forced weft yarn W is cut by the cutter 17*d* to be removed while air ejection operation of the nozzle 17*a* and suction operation of the suction pipe 17*e* is stopped.

Next, passing operation of the weft yarn is carried out as follows: An air jet is ejected from the weft supply nozzle 19 and flows through the yarn introduction opening 17*b* to the pipe of the weft winding arm 10*a* so as to be ejected from the outlet of the weft winding arm pipe. Accordingly, the leading end of the weft yarn W drawn from the weft supply member 15 is blown to the weft inlet at the rear end of the weft inserting nozzle 11 under the influence of the above-mentioned air jet. At this time, air jet ejection is made also from the weft inserting nozzle 11, by which suction is developed at the weft inlet of the weft inserting nozzle 11. Under this suction, the leading end of the weft yarn W from the weft winding guide 10*a* is sucked into the weft inserting nozzle 11. Thus, the weft yarn W can be smoothly passed into the weft inserting nozzle 11.

When the weft yarn W projects from the tip end of the weft inserting nozzle 11 upon completion of passing the weft yarn into the weft inserting nozzle, it is detected by the weft sensor 3 and therefore the weft sensor 3 outputs a detection signal representative of weft passing to the control circuit 13. Then, the control circuit 13 operates to stop air ejection from the weft inserting nozzle 11 and from the weft supply nozzle 19. Almost simultaneously, the suction pipe 65 is operated to suck the weft yarn W projected from the tip end of the weft inserting nozzle 11 as shown in FIG. 31. Subsequently, the cutter 66 is operated to cut the weft yarn W. The cut portion of the weft yarn W is sucked into the suction pipe 65 to be removed. Thereafter, the rotatable body 10*e* is rotated by the motor thereby rotating the weft winding arm 10*a*. Thus, a predetermined length of the weft yarn is wound on the drum 10*b* of the weft storage unit 10, so that the loom stands ready for restarting.

Figure 32:
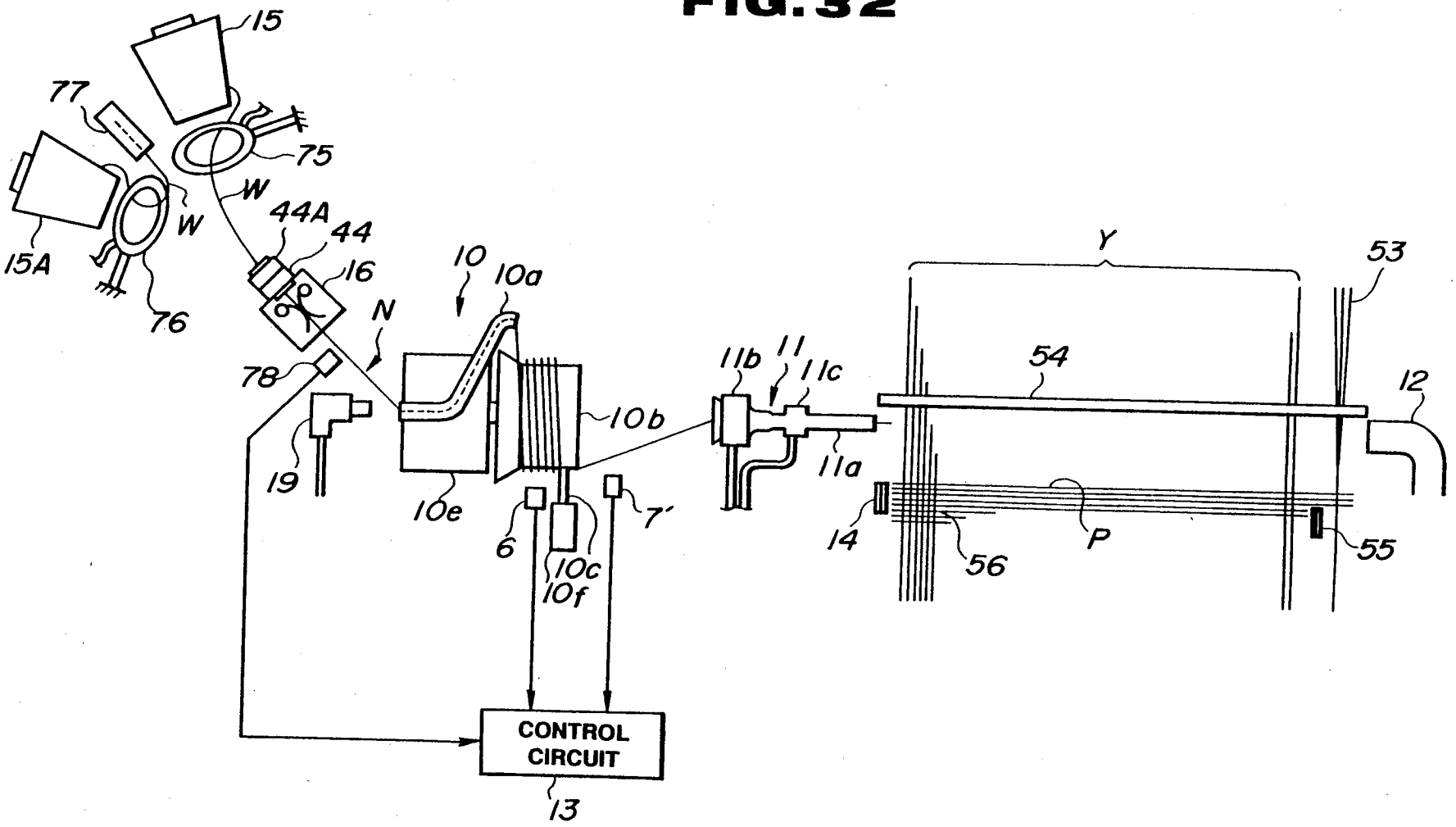
FIG. 32 is a schematic illustration of a weft picking system, showing operation of a seventh embodiment of the weft treatment system and method in accordance with the present invention.
Figure 33:
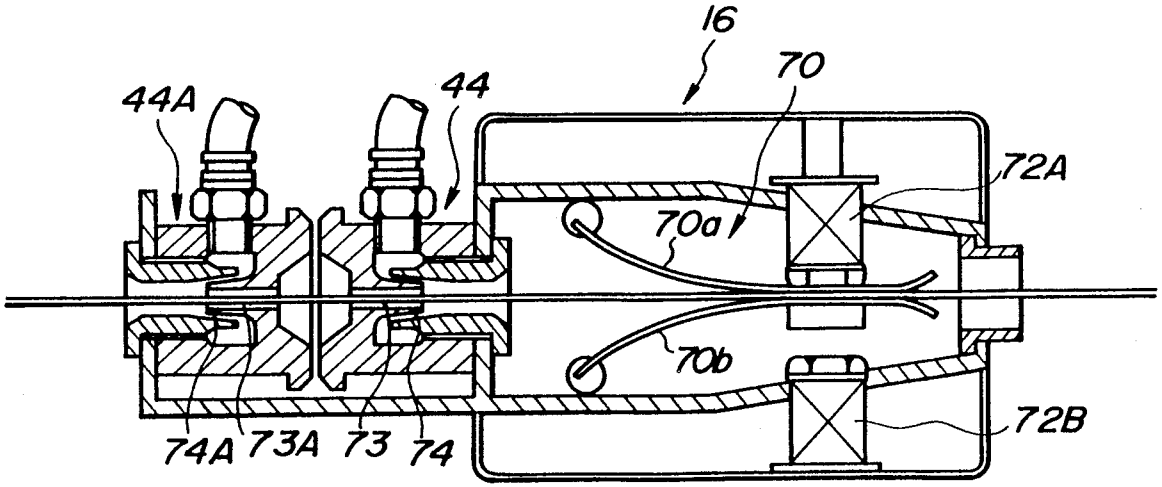
FIG. 33 is a longitudinal cross-sectional view of a weft tensor used in the seventh embodiment weft treatment system of FIG. 32.

FIGS. 32 to 35 illustrate a seventh embodiment of the weft treatment system and method in accordance with the present invention, which is similar to the fifth embodiment. In this embodiment, as shown in FIG. 33, the weft tensor 16 includes a grasping arrangement 70 constructed of a pair of plate springs 70*a*, 70*b* which are controllably moved respectively by electromagnets 72A, 72B. Accordingly, the plate springs 70*a*, 70*b* can grasp the weft yarn W therebetween and release it from them, in which the force of grasping the weft yarn W is controllable. The nozzle 44 for introducing the weft yarn is provided at the weft inlet side of the weft sensor 16. Additionally, another nozzle 44A for removing the weft yarn W from the weft sensor 16 is provided in such a position that the nozzle 44 is located between the nozzle 44A and the main body of the weft sensor 16. The nozzle 44 is formed with a weft introduction opening 73 through which the weft yarn W is passed, and an annular air ejection opening 74 surrounding the opening 73 to eject air therethrough. Similarly, the nozzle 44A is formed with a weft introduction opening 73A through which the weft yarn W is passed, and an annular air ejection opening 74A located surrounding the opening 74A to eject air therethrough. The axes of the nozzles 44, 44A are aligned with each other, so that the weft introduction openings 73, 73A of the nozzles 44, 44A are aligned with each other. Air ejection of these nozzles 44, 44A is controlled through valves (not shown) by the control circuit 13.

Additionally, rings 75, 76 are provided respectively near the weft supply members 15, 15A. Each ring 75, 76 is formed at its inner periphery with a slit (not shown) which is fluidly connected through a valve (not shown) to a blower (not shown) so that suction is developed within the ring. A weft feeding nozzle 77 is disposed between the two weft supply members 15, 15A in order to blow the tip end section of the wet yarns Y from the weft supply members 15, 15A toward the weft sensor 16. As shown in FIG. 32, the tip end section of the weft yarn W from the auxiliary weft supply member 15A is inserted, thereby making a standing-ready condition. A weft sensor 78 is provided to detect breakage or cutting of the weft yarn W at a position between the weft storage unit 10 and the weft supply members 15, 15A. The weft sensor 78 is of the photoelectric type and adapted to output signals representative of presence and absence of the weft yarn.

Figure 34:
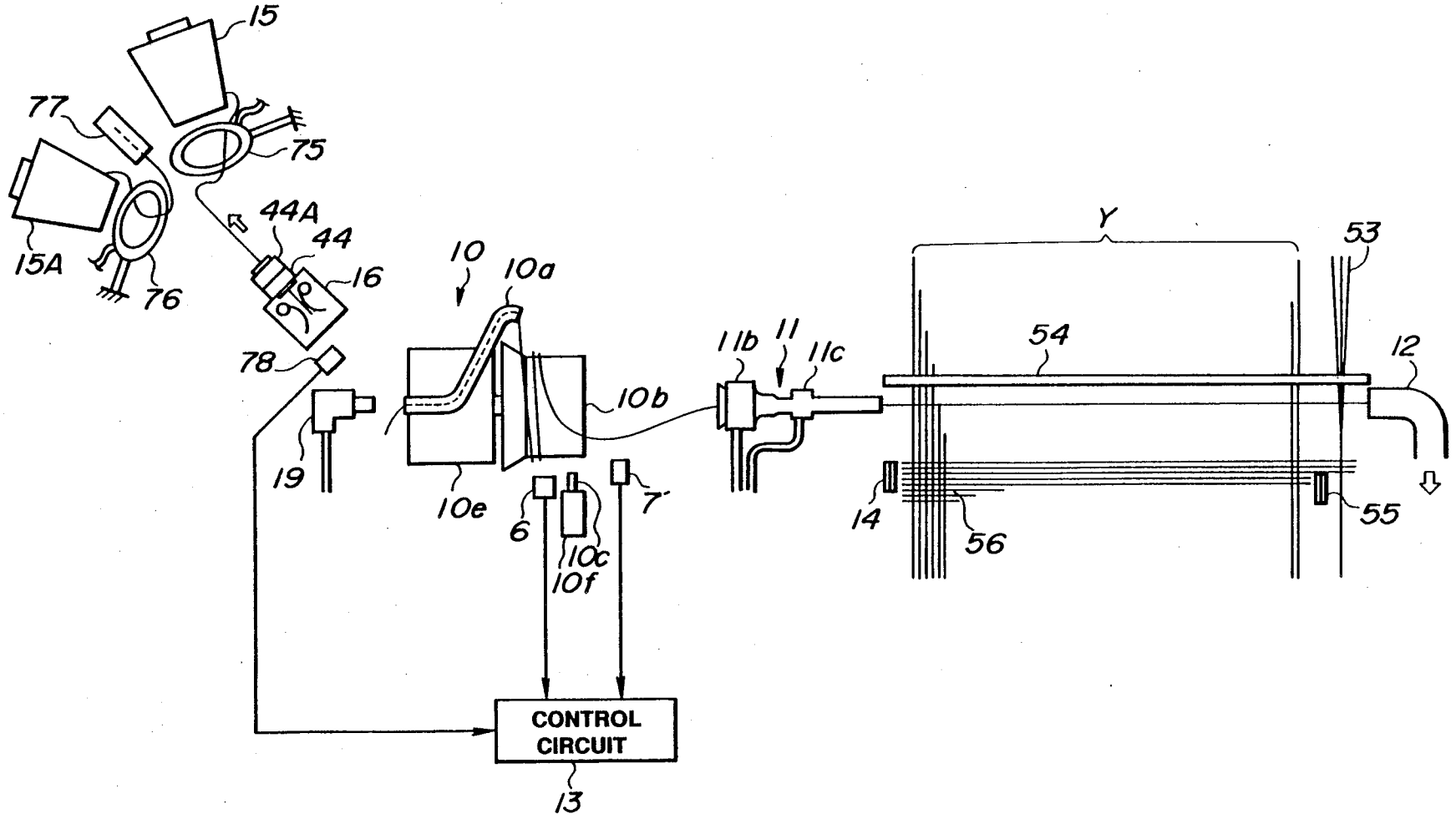
FIGS. 34 and 35 are schematic illustrations similar to FIG. 32 but showing another modes of operation of the seventh embodiment weft treatment system and method.

Next, discussion will be made on a case in which breakage or cutting of the weft yarn W occurs at a position (indicated by the character N in FIG. 32) between the weft storage unit 10 and the weft supply members 15, 15A. When such a weft yarn breakage occurs, the signal representative of absence of the weft yarn is fed from the weft sensor 78 to the control circuit 13, and therefore the control circuit 13 operates to accomplish the following operations:

First the operation of the loom is stopped at a predetermined operational phase. Next, in order to remove the faulty weft yarn, the electromagnetic actuator 10*f* is operated to withdraw the measuring pawl 10*c* from the drum 10*b* of the weft storage unit 10 thereby releasing the engagement of the measuring pawl with the weft yarn W as shown in FIG. 34. Then, air ejection is made in the weft inserting nozzle 11 so that the weft yarn remaining in the weft storage unit 10 is picked to reach the weft traction device 12 to be removed.

Figure 35:
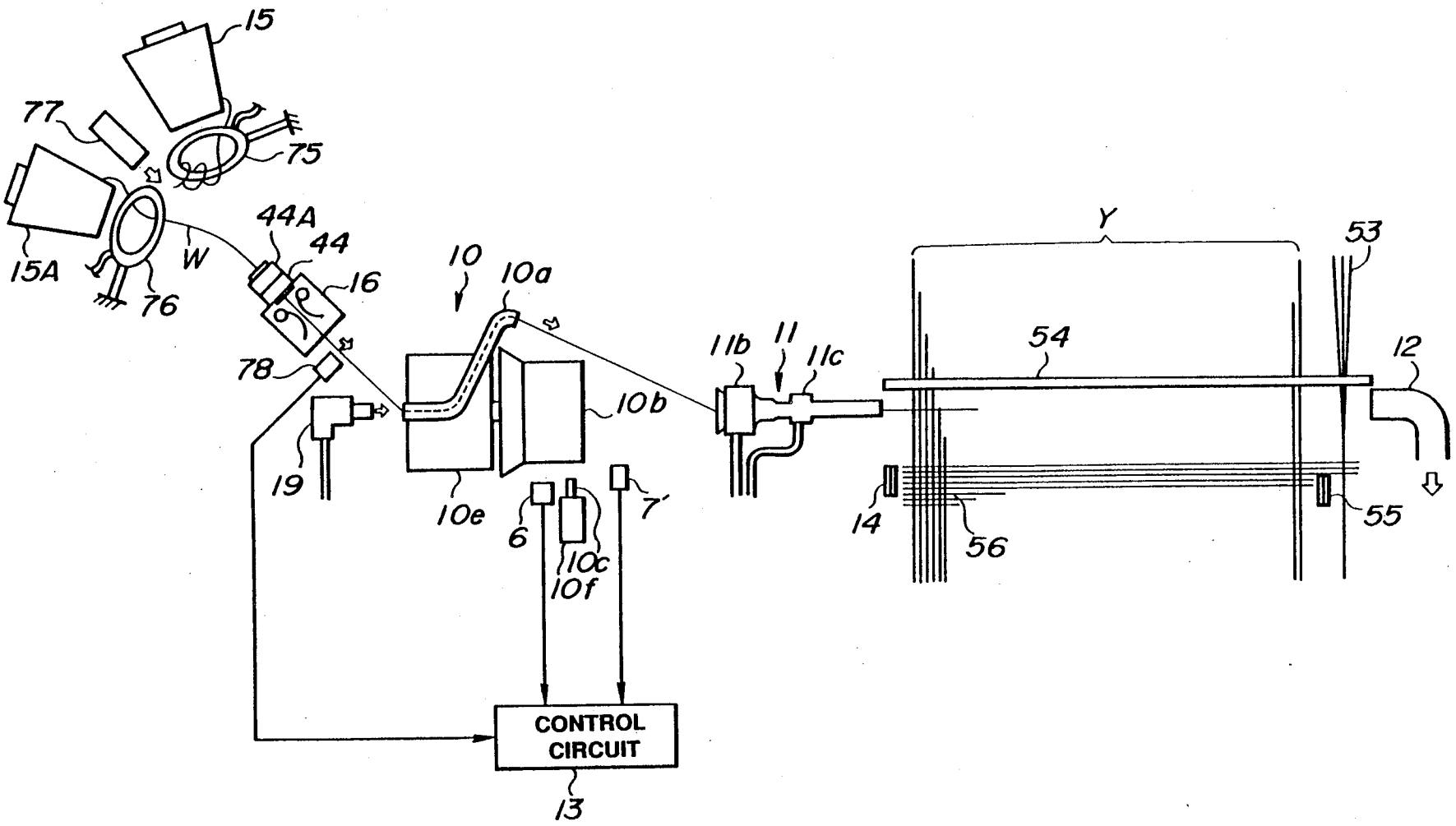

Besides, in order to remove the faulty weft yarn W leading to the weft supply member 15, 15A, air ejection is made in the nozzle 44A provided to the weft tensor 16 as shown in FIG. 34. As a result, the weft yarn introduced in the weft tensor 16 is reversely blown in a direction indicated by an arrow in FIG. 34 or toward the weft supply member 15, so that the weft yarn gets out of the weft tensor 16 and is entangled with the ring 75 as shown in FIG. 35. At this time, developing suction at the slit of the ring makes secure contact of the weft yarn with the ring 75. It is preferable that the weft tensor 16 is in an opened condition during the above operation.

Subsequently, passing of the weft yarn W from the auxiliary weft supply member 15A is carried out as follows: As shown in FIG. 35, air ejection in the weft feeding nozzle 77 is made, so that the tip end section of the weft yarn from the weft supply member 15A is blown to the weft inlet of the weft sensor 16 under influence of an air jet from the nozzle 77 and passing into the weft sensor 16 in its open condition.

The weft yarn W passing through the weft sensor 16 is further blown under the influence of an air jet from the nozzle 44 and flies toward the weft inlet of the pipe of the weft winding arm 10*a* of the weft storage unit 10. At this time, air ejection is made also in the weft supply nozzle 19 so that air jet from the nozzle 19 passes through the pipe of the weft winding arm 10*a* and is ejected from the weft outlet thereof. Under the influence of this air jet, the tip end section of the weft yarn W is blown toward the weft inlet of the weft inserting nozzle 11. In the weft inserting nozzle 11, air ejection is made in the ejector nozzle 11*b* and also in the ejector nozzle 11*c* so that suction is developed at the weft inlet of the weft inserting nozzle 11. Under the influence of this suction, the weft yarn W from the weft winding arm 10*a* is sucked or drawn into the weft inserting nozzle 11, thus smoothly completing passing operation for the weft yarn W.

Thereafter, in order to treat the excess portion of the weft yarn projected from the weft inserting nozzle 11, the weft yarn from the weft inserting nozzle 11 is sucked into the weft traction device 12 on the counter-weft picking side. Subsequently, the electromagnetic actuator 10*f* is operated to insert the measuring pawl 10*c* into the drum 10*b* of the weft storage unit 10. Then the cutter 14 on the weft picking side is operated to cut the weft yarn. The thus cut weft yarn is drawn to the weft traction device 12 to be removed. Thereafter, the rotatable body 10*e* is rotated by the motor to rotate the weft winding arm 10*a* around the drum 10*b*, thus winding a predetermined amount of the weft yarn on the drum 10*b*. In this condition, the loom stands ready for restarting.

It will be understood that this embodiment may be provided with the weft traction device 17 for drawing the faulty weft yarn toward the side of the weft supply member 15 relative to the weft storage unit 10 though not shown.

Figure 36:
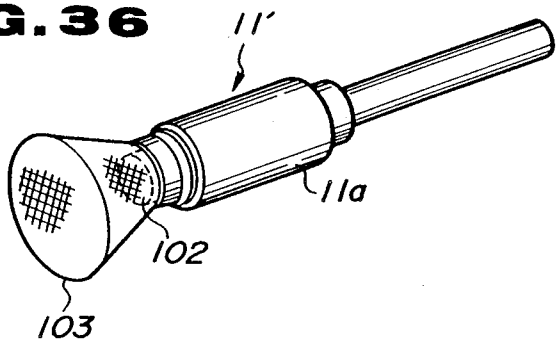
FIG. 36 is a perspective view of a weft inserting nozzle usable in place of the weft inserting nozzle in the various weft picking systems.
Figure 37:
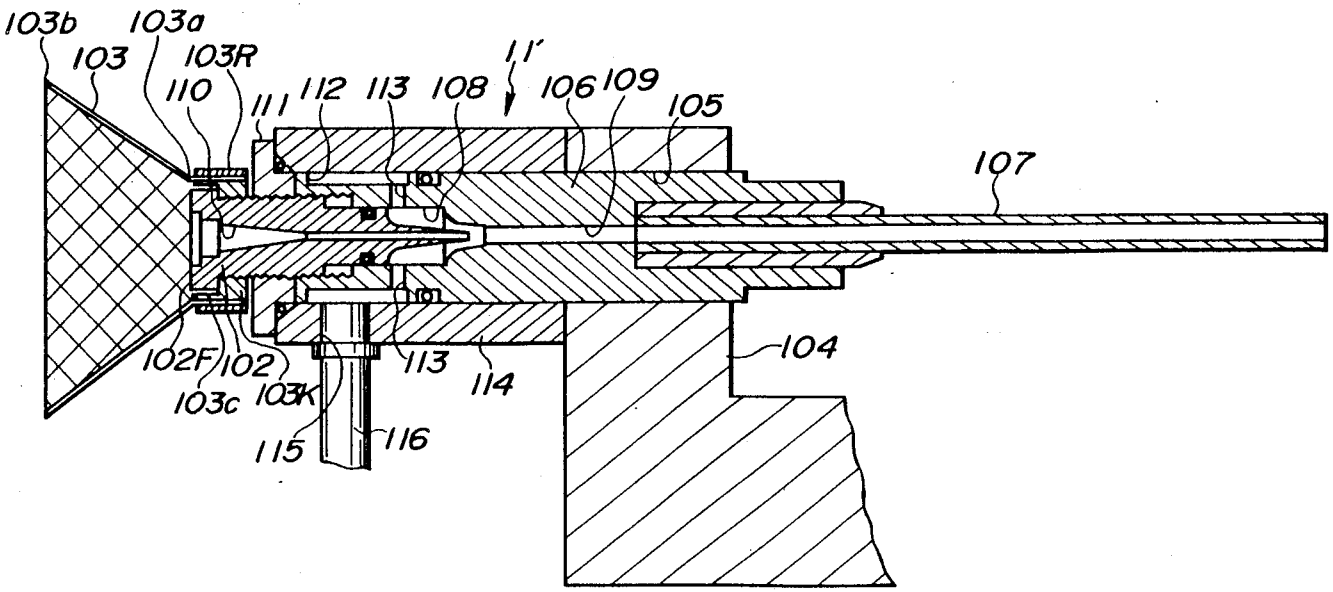
FIG. 37 is a longitudinal cross-sectional view of the weft inserting nozzle of FIG. 36.

FIGS. 36 and 37 show a weft inserting nozzle 11' which may be used in place of the weft inserting nozzle 11 in the above-discussed embodiments. The weft inserting nozzle 11' includes a nozzle main body 106 which is fittingly inserted into a hole 105 formed in a nozzle holder 104. An acceleration pipe 107 is fixedly connected to the front end section of the nozzle main body 106. The rear end section of the nozzle main body 106 is formed with a depression 108 which is communicated with the acceleration pipe 107 through a flow passage 109 formed along the center axis of the nozzle main body 106.

A yarn introduction pipe 102 is formed along its center axis thereof with a yarn introduction opening 110, and screwed in the depression 108 and fixed in position with a lock nut 111. The nozzle main body 106 is formed at its rear end peripheral surface with an annular groove 112 which is communicted with the depression 108 through a plurality of air supply openings 113. An outer pipe 114 is disposed around the nozzle main body 106 in such a manner as to cover the annular groove 112. The outer pipe 114 is formed with a hole 115 communicating with the annular groove 112. Fitted into the hole 115 is a pipe 116 through which pressurized air is supplied. The pipe 116 is fluidly connected through an electromagnetic valve with a tank for supply of pressurized air though not shown. Accordingly, when pressurized air is supplied through the pipe 116, it flows through the hole 115, annular groove 112, the air supply openings 113 and the depression 108 so as to flow into the flow passage 109 through a space around the tip needle section of the yarn introduction pipe 102. During this, the weft yarn passing in the yarn introduction opening 10 is drawn toward the flow passage 109 and pulled through the flow passage 109 and the acceleration pipe 107 to be projected from the tip end of the acceleration pipe 107, so that the weft yarn is picked through the shed of array of the warp yarns.

A generally frustoconical guide member 103 is provided at the yarn inlet of the weft inserting nozzle 11'. The guide member 103 has a front end section **103*a* secured to the weft inserting nozzle 11', and a rear end section. The diameter of the guide member 103 increases in a direction from the front end section 103*a* to the rear end section 103*b*. The frustconical wall of the guide member 103 is so constructed that air can pass therethrough. The guide member 103 is preferably formed of wire-netting or may be formed of perforated plate, low density woven cloth or non-woven fabric. The guide member 103 is formed at its front end section 103*a* with a cylindrical section 103*c*. An annular metal member 103K is fixed to the inner periphery of the cylindrical section 103*c* and located between the inlet flange 102F of the yarn introduction pipe 102 and the lock nut 111. The metal member 103K is fixedly secured to the weft inserting nozzle 11' in such a manner as to be in threaded engagement with the outer periphery of the yarn introduction pipe 102. Fixation of the guide member 103 is made during screwing the yarn introduction pipe 102 into the depression 108 and fixation of the same with the lock nut 111. In this case, the metal member 103K is fitted inside the cylindrical section 103*c*. A fixture ring 103R is fitted outside the cylindrical section 103*c*. Additionally, the metal member 103K and the cylindrical section 103*c*** are united, for example, by means of brazing.

Figure 38:
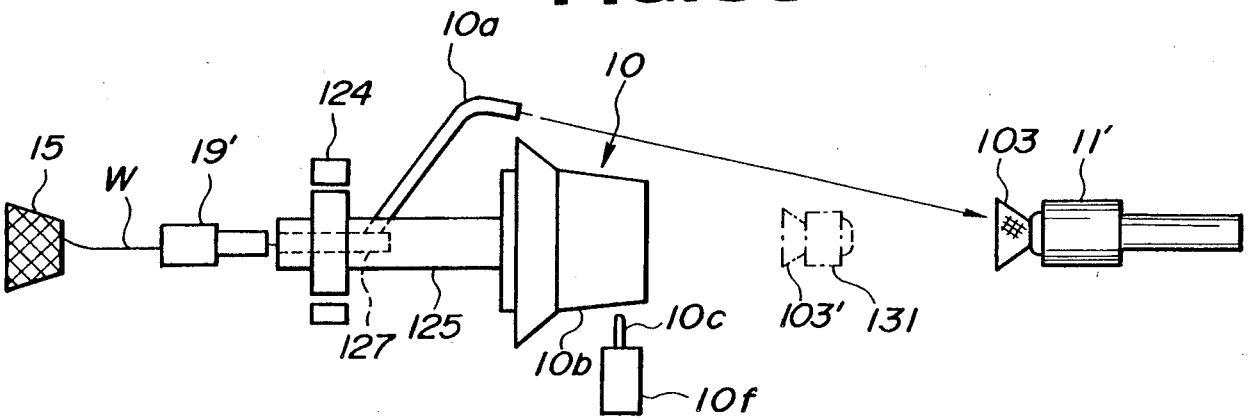
FIG. 38 is a schematic illustration of the weft picking system having the weft inserting nozzle of FIG. 36.

An example of a weft picking system including the weft inserting nozzle shown in FIGS. 36 and 37 is shown in FIG. 38, which is similar to that discussed above except for the structure of the weft inserting nozzle. In this example, the weft yarn W is drawn from the weft supply member 15 and introduced through the weft supply nozzle 19' into the weft storage unit 10. Thereafter, the weft yarn W is introduced into the weft inserting nozzle 11'. The weft storage unit 10 is of a so-called drum type having the drum **10*b* on which the weft yarn W is wound for the purpose of measuring the weft yarn and storing it prior to weft picking. The drum 10*b* of the weft storage unit 10 is rotatably supported on the tip end section a rotatable shaft 125 which is driven by a motor 124. The drum 10*b*** is maintained stationary under magnetic attraction of a magnet (not shown).

The weft yarn W drawn from the weft supply member 15 is passed through a weft introduction hole 127 which is formed from the rear end to the central section of the rotatable shaft 125 along the axis of the rotatable shaft 125. The weft introduction hole 127 is communicated with a elongate hole formed in along the axis of the weft winding arm **10*a* which projects from the peripheral surface of the rotatable shaft 125 and extends obliquely forward. Accordingly, the weft yarn W from the weft introduction hole 127 passed through the elongate hole of the weft winding arm 10*a* and wound around the drum 10*b*, while it is drawn off the weft yarn W from the weft supply member 15. When the measuring pawl 10*c* movably disposed at the front end of the drum 10*b* is got out of the drum 10*b* under drive by the actuator 10*f*, the weft yarn W on the drum 10*b* is picked under influence of an air jet ejected from the weft inserting nozzle 11', while being unwound from the drum 10*b*. When the measuring pawl 10*c* is inserted into the drum 10*b*, the weft yarn W is caught by the measuring pawl 10*c*** thereby completing one pick of the weft yarn W.

In passing the weft yarn W into the weft path in the weft picking system shown in FIG. 38 in order to restart the loom, for example, after a faulty weft yarn is removed, the tip end section of the weft yarn W from the weft supply member 15 is inserted into the weft inlet of the weft supply nozzle 19', and then air ejection is made in the weft supply nozzle 19'. Simultaneously, pressurized air is supplied through the pipe 116 of the weft inserting nozzle 11' in FIG. 37 thereby developing suction at the weft inlet of the yarn introduction pipe 102. The air jet from the weft supply nozzle 19' flows in the weft introduction hole 127 in the rotatable shaft 125 and thereafter is ejected from the tip end of the weft winding arm **10*a* and directed to the guide member 103 of the weft inserting nozzle 11'**.

At this time, if an air stream ejected from the weft winding arm **10*a* carrying the weft yarn W strikes against the inner wall surface of the guide member 103, a part of the air stream passes through the wall of the guide member 103 while the remaining part is guided along the inner wall surface of the guide member 103. The remaining part of the air stream is directed into the yarn introduction pipe 102 under assistance of suction developed at the weft inlet of the weft inserting nozzle 11'. Thus, the reflected pressure of air flow from the inner wall surface of the guide member 103 can be suppressed to a negligible extent, thereby preventing the weft yarn from flying out of the guide member 103. Accordingly, the weft yarn W from the weft winding arm 10*a* flies toward and reaches the guide member 103 of the weft inserting nozzle 11'. Then, the weft yarn W is guided to the vicinity of the yarn introduction opening 110 under the action of air stream toward the yarn introduction opening 110, and then drawn into the yarn introduction opening 110 under suction developed at the weft inlet of the weft inserting nozzle 11'**, thus completing passing operation of the weft yarn W into the weft path in the weft picking system prior to restarting of the loom.

While the weft yarn W from the weft winding arm **10*a* has been shown and described as being carried to the weft inserting nozzle under air ejection from the weft winding arm 10*a* in this embodiment, it will be understood that a guide nozzle 131 as shown in phantom in FIG. 38 may be provided on the back side of the weft inserting nozzle 11', in which the weft yarn from the weft winding arm 10*a* is passed into the weft inserting nozzle under the influence of an air jet stream ejected from the guide nozzle 131. In this case, the guide nozzle 131 may be provided with a generally frustoconical guide member 103' similar to guide member 103 and so arranged that the small diameter front end section 103***a* is fixedly secured to the weft inlet of the guide nozzle 131.

Figure 39:
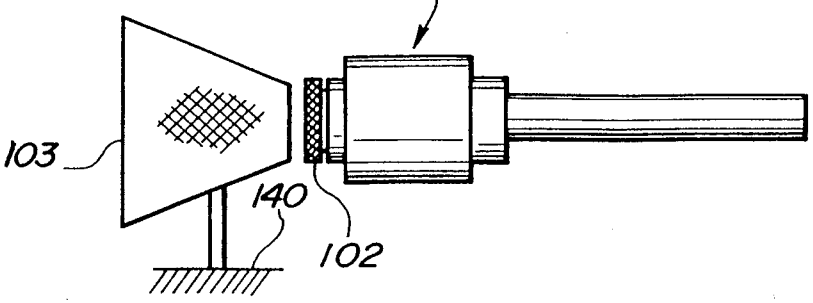
FIG. 39 is a side elevation of a modified example of the weft inserting nozzle of FIG. 36.

It will be appreciated that the guide member 103 may be stationarily disposed slightly separate from the weft inserting nozzle 11' as shown in FIG. 39. The guide member 103 may be fixed to the main body 140 of the loom.

While the guide member 103 has been shown and described as being used in the weft inserting nozzle 11' of the type having only one ejector nozzle, it will be understood that the guide member 103 may be usable for other types of weft inserting nozzles, for example, the weft inserting nozzle 11 in the above-discussed various embodiments.

Figures 40, 41:
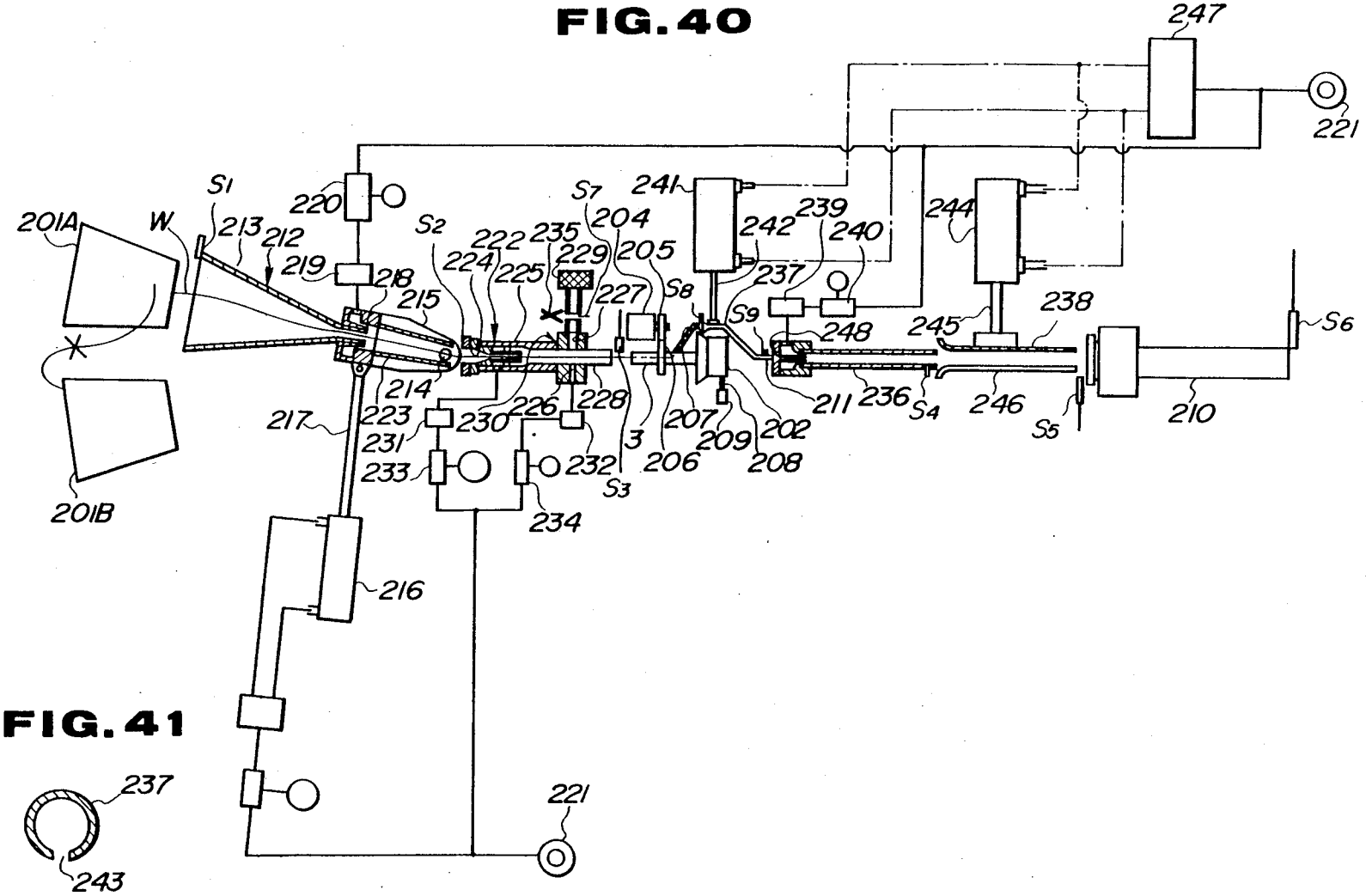
FIG. 40 is a schematic illustration of a weft picking system including an eighth embodiment of the weft treatment system in accordance with the present invention.
FIG. 41 is a cross-sectional view of a part of the weft picking system of FIG. 40.

FIG. 40 illustrates a ninth embodiment of the weft treatment method and system in accordance with the present invention. In this embodiment, weft yarn W is wound on weft supply members or bobbins 201A, 201B, in which the terminal end section of the weft yarn of the weft supply member 201A is connected to the initial end section of the weft supply member 201B to form a so-called pig tail connection. A weft storage drum 202 is rotatably mounted on the end section of a rotatable shaft 203. The drum 202 is maintained stationary under the action of a device (not shown). The rotatable shaft 203 is rotatable in normal and reverse directions around its axis through gears 205, 206 by means of a motor 203 whose rotating direction is reversible. A weft winding arm 207 projects from the outer peripheral surface of the rotatable shaft 203 and rotatable together with the rotatable shaft 203 as a single unit. The weft winding arm 207 is pipe-shaped so that the weft yarn W is introduced therein. Accordingly, the weft yarn W from the weft winding arm 207 is wound on the outer peripheral surface of the drum 202. A measuring pawl 208 is movably disposed so as to be inserted into or released (withdrawn) from the drum 202 under the action of an electromagnetic actuator 209. This measuring pawl 208 controls the length of the weft yarn to be picked. The reference numerals 210 and 211 designate a weft inserting nozzle and a guide, respectively.

A weft drawing device 212 is provided to draw the weft yarn W from the weft supply member 201A. The weft drawing device 212 includes a generally frustoconical air stream guide 213 which is secured to a support plate 215 which is pivotable around a pivot point 214. The support plate 215 is connected to a movable rod 217 of an air cylinder 216. Accordingly, the movement of the movable rod 217 causes the air stream guide 213 to swingably move around the pivot point 214, so that the air stream guide 213 is so locatable as to face to the other weft supply member 201B.

A nozzle opening 218 is formed around the tip or front end section of the air stream guide 213 and fluidly connected through an electromagnetic valve 219 and a regulator 220 with a pressurized air supply source 221. A guide pipe 223 is disposed forward of the nozzle opening 218 to guide the weft yarn W to the weft inlet of an air stream generating device 222. The air stream generating device 222 includes a nozzle 225 having a yarn introduction opening 224 formed along the axis thereof. This nozzle 225 is provided at its tip end section with an ejector opening 226 from which air stream is generated in such a manner as to cross the yarn introduction opening 224 in the diametrical direction. A receiving opening 227 is formed facing the ejector opening 224 to receive an air stream from the ejector opening 226. A guide nozzle 228 is provided downstream of the ejector opening 226 to communicate with the yarn introduction opening 224. The receiving opening 227 is connected with a waste yarn trap 229. The ejector opening 226, the receiving opening 226 and the waste yarn trap 229 constitute a weft traction device 230 for drawing the weft yarn W as discussed after. The guide nozzle 228 opens to the weft inlet side of the rotatable shaft 203, while the nozzle 25 and the ejector opening 226 are fluidly connected with the pressurized air supply source 221 through respective electromagnetic valves 231, 232 and regulators 233, 234. The reference numeral 235 designates a cutter installed to a pipe formed with the receiving opening 227.

A weft feeding nozzle 236 is provided between the drum 202 and the weft inserting nozzle 210. An inlet-side introduction pipe 237 is disposed on the upstream side of the weft feeding nozzle 236. An outlet-side introduction pipe 238 is disposed between the weft feeding nozzle 236 and the weft inserting nozzle 210. The weft feeding nozzle 236 is fluidly connected to the pressurized air supply source 221 through an electromagnetic valve 239 and a pressure regulator 240 and arranged to eject air jet in the direction of the outlet-side introduction pipe 237. The inlet-side introduction pipe 237 can be so located as to substantially connect the weft winding arm 207 and the weft feeding nozzle 236. The inlet-side introduction pipe 237 is connected to a movable or power output rod of an air cylinder 241 and formed along the length thereof with a slit 243 as shown in FIG. 41. The inlet-side introduction pipe 237 is movable between an operational position as indicated by the solid line in FIG. 40 and a withdrawal position (not shown) above the operational position under the action of the air cylinder 241.

The outlet-side introduction pipe 238 substantially connects the weft outlet side of the weft feeding nozzle 236 and the weft inlet side of the weft inserting nozzle 210. This outlet-side introduction pipe 238 is connected to a movable or power output rod 245 of an air cylinder 244 and formed along its length with a slit 46. The outlet-side introduction pipe 238 is movable between an operational position indicated by solid line in FIG. 40 and a withdrawal position (not shown) above the operational position under the action of the air cylinder 244 similarly to the inlet-side introduction pipe 237. The reference numeral 247 designates a change-over valve for changing the flow path of pressurized air. The reference characters $S_1$ to $S_9$ designate weft sensors for detecting presence or absence of the weft yarn.

The manner of operation of this embodiment will be discussed hereinafter.

First, during normal operation of the loom, both the inlet-side and outlet-side introduction pipes 237, 246 are withdrawn from the path of the weft yarn W without interference with the weft yarn W. At this time, the weft yarn W is extending from the weft supply member 101A through the air stream guide 213 and the guide pipe 223 and passed into the nozzle 225. The weft yarn W passed in the nozzle 225 passes through the rotatable shaft 203 and guided into the pipe-shaped weft winding arm 207, so that the weft yarn W from the weft winding arm 207 is wound by a predetermined amount on the drum 202. The weft yarn W on the drum 202 is introduced through the weft feeding nozzle 236 into the weft inserting nozzle 110.

Winding the weft yarn W on the drum 202 is accomplished by rotating the weft winding arm 207 in a normal direction through the gears 205, 206 upon drive of the motor 204, so that the weft yarn W in an amount corresponding to one pick is stored or wound on the drum 102 immediately before weft picking. At the time of weft picking, the measuring pawl 208 gets out of the drum 102 and therefore the weft yarn W is picked through the guide 211 and the weft introduction opening 248 under the influence of an air jet from ejected from weft inserting nozzle 210. When the predetermined amount of the weft yarn W is unwound from the drum 202 in weft picking, the measuring pawl 208 is again inserted into the drum 202 thereby stopping drawing of the weft yarn W from the drum 202, thus completing the weft picking.

When the loom is stopped, first detection of the weft yarn W is made by the weft sensors $S_1$ to $S_6$. For example, in the event that the weft sensors $S_5$, $S_6$ output a signal representative of absence of the yarn, the electromagnetic valve 232 is opened to eject pressurized air from the ejector opening 226 thereby blowing the weft yarn W toward the receiving opening 227. Simultaneously, the motor 204 is operated to rotate in a reverse direction relative to that during the above-mentioned weft yarn winding on the drum 202, at a speed lower than that of weft traction under the influence of an air jet from the ejection opening 226. As a result, the weft winding arm 207 is reversely rotated and therefore the weft yarn W wound on the drum 202 is successively unwound so that the weft yarn is successively sucked onto the side of the yarn trap 229 accompanied with the weft yarn W on the side of the weft feeding nozzle 236 being also sucked into the side of the yarn trap 229. Thus, the faulty weft yarn W is removed.

During the above operation in which the weft yarn W is blown into the receiving opening 227, the weft yarn W is prevented from being drawn from the side of the weft supply member 201A under friction, a weft grasping device (not shown) of the electromagnetic type may be provided on the side of the inlet of the nozzle 225 to grasp the weft yarn in order to secure weft yarn drawing prevention effect. In this case, the grasping device may be controlled in grasping and releasing operation for the weft yarn so as to control initiation and termination of passing the weft yarn into the weft path discussed after.

The reverse rotation or drive of the motor 204 is stopped after a lapse of a predetermined time or at a point of time at which the weft sensor $S_3$ outputs the signal representative of absence of the yarn. Subsequently, the cutter 235 is operated upon confirmation of presence of the yarn, thereby cutting the weft yarn W in the receiving opening 227 to have a predetermined length. Thereafter, the electromagnetic valve 228 is opened.

At this point of time, the weft yarn W does not remain in the weft path between the weft winding arm 207 and the weft inserting nozzle 210. Subsequently, the change-over valve 247 is operated to change the flow path of the pressurized air in such a manner that the inlet-side and outlet-side introduction pipes 237, 238 are moved respectively into the operational positions indicated by the solid lines. At this time, the weft winding arm 207 is restricted in its rotational position such that the weft outlet of the weft winding arm 207 faces with the weft inlet of the inlet-side introduction pipe 237. In this condition, the electromagnetic valve 239 is opened so that pressurized air is ejected from the weft feeding nozzle 236 while pressurized air is ejected from the weft inserting nozzle 110, thereby developing an air stream flowing in the direction of weft picking along the weft path from the inlet side of the weft feeding nozzle 236 through the outlet-side introduction pipe 238 to the weft inserting nozzle 210. Additionally, the electromagnetic valves 214 and 219 are opened thereby ejecting pressurized air from the nozzle 225 and from the nozzle opening 218. Under the influence of this air stream, the tip end section of the weft yarn W is blown into the rotatable shaft 203 while the weft yarn is drawn from the weft supply member 201A. The weft yarn W blown into the rotatable shaft 203 is passed from the rotatable shaft into the inlet-side introduction pipe 237, the weft feeding nozzle 236, the outlet-side introduction pipe 238, and the weft inserting nozzle 210 in the order mentioned. In this case, opening of the electromagnetic valves 214, 219, and 239 is made for a sufficient time to allow the weft yarn W to reach the weft inserting nozzle 210, or until the weft sensors $S_3$ to $S_6$ detect presence of the weft yarn W.

When the weft yarn W is passed into the, weft inserting nozzle 210, the electromagnetic valves 214, 219, and 239 are closed while the change-over valve 247 is changed in pressurized air flow path so that the inlet-side and outlet-side introduction pipes 237, 238 are withdrawn from their operational positions indicated by the solid lines. At this time, the weft yarn W can smoothly get out of the inlet-side and outlet-side introduction pipes 237, 238 by virtue of the slits 243, 246 formed in the introduction pipes 237, 238. Then, the motor 204 is driven to rotate in the normal direction thereby rotating the weft winding arm 207, so that the predetermined amount of the weft yarn W is previously wound on the drum 202. Thereafter, the loom is restarted to start normal loom operation. It will be understood that the weft yarn W is prevented from getting out of the weft inserting nozzle 210 by maintaining air ejection from the weft inserting nozzle 210 even after closing of the electromagnetic valves 214, 219, 239.

In the event that the weft sensor $S_1$ outputs the signal representative of absence of the yarn, the weft yarn W on the side of the air stream guide 213 is simultaneously drawn during air ejection from the ejector opening 226 thus removing the whole weft yarn W on the weft path from the weft supply member 101A to the weft inserting nozzle 210. Thereafter, the electromagnetic valves 231, 219 are opened to develop a pulling air stream for the weft yarn W on the side of the air stream guide 213. Accordingly, the end section of the weft yarn W is passed into the weft path from the air stream guide 213 to the nozzle 225 under the influence of the above air stream. When the weft sensor $S_3$ detects the presence of the weft yarn W, the electromagnetic valves 231, 219 are closed while the electromagnetic valve 232 is opened, thereby blowing the weft yarn W into the receiving opening 227. Then, the weft yarn W is cut by the cutter 235. Thereafter, the weft yarn W is passed reaching the weft inserting nozzle 210.

It will be understood that stopping the loom may be accomplished upon detection of breakage of the weft yarn W by the weft sensors $S_1$ to $S_6$. Additionally, the weft traction device 230 of the air ejection type may be replaced with other ones, for example, of the roll type in which a yarn is rolled on a roll.

While the motor 204 has been described as being of the type rotatable in the both normal and reverse directions, it will be understood that two motor which are opposite in rotating directions may be used in place of the motor 204. Additionally, although the weft winding arm 207 has been shown and described as means for winding the weft yarn on the drum, it will be understood that such weft yarn winding may be accomplished by rotating the drum upon fixing the weft winding arm.

We claim:

1. A fluid jet loom comprising a weft treatment system having a weft supply member and a weft storage unit including a weft winding arm and drum, and a weft inserting nozzle, said weft treatment system further comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum; and a weft traction device disposed between the weft supply member and the weft storage unit whereby said weft traction device draws a weft yarn including the faulty weft yarn so as to remove said faulty weft yarn.

2. A weft treatment system as claimed in claim 1, wherein said reversely running means includes means for reversely rotating a loom main shaft.

3. A weft treatment method as claimed in claim 1, wherein said weft traction device includes means for generating a fluid stream for drawing the weft yarn.

4. A weft treatment method as claimed in claim 1, wherein said reversely rotating means forms part of means for rotating the weft winding arm in first and second directions which are opposite to each other.

5. A weft treatment system as claimed in claim 1, wherein the weft storage unit includes a weft winding arm, a drum and a measuring pawl which is insertable into the drum, wherein said system further comprises means for pulling the weft yarn including the mispicked weft yarn from an array of warp yarns upon unwinding the weft yarn from the drum, prior to operation of said weft yarn drawing means.

6. A weft treatment system as claimed in claim 5, further comprising means for applying vibration to the weft yarn before pulling of the weft yarn by said pulling means.

7. A weft treatment system as claimed in claim 5, further comprising means for applying vibration to the weft yarn during pulling of weft yarn by said pulling means.

8. A weft treatment system as claimed in claim 1, further comprising means for drawing the faulty weft yarn from the side of the warp yarn array with respect to the weft inserting nozzle.

9. A weft treatment system as claimed in claim 1, further comprising means for discriminating a position at which the weft yarn is broken, said position including a first position on the side of the weft yarn array relative to the weft inserting nozzle, and a second position between the weft supply member and the weft inserting nozzle.

10. A weft treatment system as claimed in claim 1, wherein said faulty weft yarn detecting means includes means for detecting breakage of the weft yarn at a position between the weft storage unit and the weft inserting nozzle.

11. A weft treatment system as claimed in claim 1, wherein said faulty weft yarn detecting means includes means for detecting breakage of the weft yarn at a position between the weft supply member and the weft inserting nozzle.

12. A weft treatment system as claimed in claim 1, further comprising means for passing a weft yarn into the weft inserting nozzle after removal of the faulty weft yarn, said weft yarn passing means including means for ejecting air toward the weft inserting nozzle upon an air ejection of the weft inserting nozzle; means for detecting projection of the weft yarn from the tip end of the weft inserting nozzle upon passing of the weft yarn through the weft inserting nozzle; means for stopping air ejection of the weft inserting nozzle upon detection of the weft yarn projection; means for sucking the weft yarn projected from the weft inserting nozzle; and means for cutting the weft yarn upon suction of said weft yarn sucking means.

13. A weft treatment system as claimed in claim 1, further comprising means for passing a weft yarn into the weft inserting nozzle, said weft yarn passing means including a generally frustoconical and perforated guide member having first and second end sections, said first end section being larger in diameter than the second end section, said second end section being coaxially secured to an end section of the weft inserting nozzle, said weft inserting nozzle end section being formed with a weft inlet through which the weft yarn is introduced into the weft inserting nozzle, said guide member being formed with said perforations so that the air passes therethrough.

14. A weft treatment system as claimed in claim 1, wherein said faulty weft yarn detecting means includes a weft sensor for detecting unwinding of the weft yarn from a drum forming part of said weft storage unit during removing said faulty weft yarn.

15. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

wherein the weft storage unit includes a weft winding arm, a drum and a measuring pawl which is insertable into the drum, wherein said system further comprises means for pulling the weft yarn including the mispicked weft yarn from an array of warp yarns upon unwinding the weft yarn from the drum, prior to operation of said weft yarn drawing means; and wherein said weft yarn pulling means includes reverse rotating means for reversely rotating the weft winding arm around the drum upon insertion of the measuring pawl into the drum, restraint means for restraining the weft yarn at a position between said weft storage unit and the weft supply member so as to unwind the weft yarn from the drum; and means for rotating the weft winding arm upon the insertion of the measuring pawl into the drum under restraint of the weft yarn at said position so as to pull the mispicked weft yarn from the warp yarn array toward the weft winding arm, after operation of said reversely rotating means.

16. A weft treatment system as claimed in claim 15, further comprising means for applying vibration to the weft yarn at a position between the weft inserting nozzle and the weft storage unit, before operation of said weft yarn pulling means.

17. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

further comprising means for drawing the faulty weft yarn from the side of the warp yarn array with respect to the weft inserting nozzle; and wherein faulty weft yarn drawing means includes means for drawing the faulty weft yarn through the warp yarn array be a second weft traction device disposed on a counter-weft picking side of the woven fabric.

18. A weft treatment system as claimed in claim 11, further comprising the step of applying vibration to the faulty weft yarn at the position between the warp yarn array and said second weft traction device.

19. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

further comprising means for discriminating a position at which the weft yarn is broken, said position including a first position on the side of the weft yarn array relative to the weft inserting nozzle, and a second position between the weft supply member and the weft inserting nozzle; and wherein said discriminating means includes:

means for detecting the presence of the weft yarn on the side of the warp yarn array relative to the weft inserting nozzle;

means for ejecting an air jet from the weft inserting nozzle; and means for detecting unwinding of the weft yarn from a weft storage unit.

20. A weft treatment system for a fluid jet loom having a weft winding arm member and a weft storage unit including a weft supply and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

wherein said faulty weft yarn detecting means includes means for detecting breakage of the weft yarn at a position between the weft storage unit and the weft inserting nozzle; and further comprising means for blowing the weft yarn leading to the weft supply member toward the weft inserting nozzle upon stopping operation of the loom; a booster located near the weft inserting nozzle to suck the blown weft yarn; and means for generating suction at the inlet of the weft inserting nozzle to suck the weft yarn from said booster.

21. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

wherein said faulty weft yarn detecting means includes means for detecting breakage of the weft yarn at a position between the weft supply member and the weft inserting nozzle; and further comprising means for cutting the weft yarn at a position between the weft inserting nozzle and the woven fabric; means for ejecting air from the weft inserting nozzle upon a stopping of the operation of the loom so as to project the weft yarn passing through the weft inserting nozzle to reach a second weft traction device disposed on a counter-weft picking side to draw the projected weft yarn.

22. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn; and wherein said faulty weft yarn detecting means includes means for detecting breakage of the weft yarn at a position between the weft supply member and the weft storage unit.

23. A weft treatment system as claimed in claim 22, wherein said weft yarn drawing means includes means for blowing the weft yarn leading to the weft supply member toward the weft supply member.

24. A weft treatment system as claimed in claim 23, wherein said weft yarn blowing means includes a nozzle provided on a weft tensor located between the weft supply member and the weft storage unit.

25. A weft treatment system for a fluid jet loom having a weft supply member and a weft storage unit including a weft winding arm and drum, and a weft inserting nozzle said system comprising:

means for detecting a faulty weft yarn;

means for stopping the operation of a cutter for the weft yarn and operation of the loom;

means for reversely running the loom to expose the faulty weft yarn at a cloth fell of a woven fabric;

means for reversely rotating the weft winding arm around the drum to unwind the weft yarn wound on the drum;

a weft traction device disposed between the weft supply member and the weft storage unit whereby said weft traction device draws a weft yarn including the faulty weft yarn so as to remove said faulty weft yarn;

further comprising means for passing a weft yarn into the weft inserting nozzle, said weft yarn passing means including a generally frustoconical and perforated guide member having first and second end sections, said first end section being larger in diameter than the second end section, said second end section being coaxially secured to an end section of the weft inserting nozzle, said weft inserting nozzle end section being formed with a weft inlet through which the weft yarn is introduced into the weft inserting nozzle, said guide member being formed with said perforations so that the air passes therethrough; and wherein said guide member is formed of wire-netting.

26. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum; and drawing a weft yarn including said faulty weft yarn through said weft storage unit by a first weft traction device disposed between said weft storage unit and said weft supply member so as to remove said faulty weft yarn.

27. A weft treatment method as claimed in claim 26, wherein the step of reversely running the loom includes reversely rotating a loom main shaft.

28. A weft treatment method as claimed in claim 26, wherein the step of drawing a weft yarn includes generating a fluid stream to draw the weft yarn in the first weft traction device.

29. A weft treatment method as claimed in claim 26, further comprising drawing the faulty weft yarn from side the of a warp yarn array with respect to a weft inserting nozzle.

30. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn; and in which said weft storage unit includes a weft winding arm, a drum and a measuring pawl which is insertable into the drum, wherein said method further comprises the step of pulling said weft yarn including the faulty weft yarn form an array of warp yarns upon unwinding said weft yarn form said drum, between said reversely running step and said weft yarn drawing step.

31. A weft treatment method as claimed in claim 30, wherein the weft yarn pulling step includes the step of reversely rotating the weft winding arm upon insertion of the measuring pawl into said drum, restraint means for restraining said weft yarn at a position between said weft storage unit and said weft supply member so as to unwind said weft yarn from said drum, and the step of rotating said weft winding arm upon insertion of said measuring pawl into said drum under restraint of said weft yarn at said position so as to pull said faulty weft yarn from the warp yarn array toward said weft winding arm.

32. A weft treatment method as claimed in claim 30, further comprising the step of applying vibration to the weft yarn at a position between a weft inserting nozzle and the weft storage unit, before said weft yarn pulling step.

33. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn;

further comprising drawing the faulty weft yarn from the side of a warp yarn array with respect to a weft inserting nozzle; and wherein the step of faulty weft yarn drawing includes drawing the faulty weft yarn through the warp yarn array by a second weft traction device disposed on a counter-weft picking side of the woven fabric.

34. A weft treatment method as claimed in claim 33, further comprising applying vibration to the faulty weft yarn at the position between the warp yarn array and said second weft traction device.

35. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn; and further comprising discriminating a position at which the weft yarn is broken, said position including a first position on the side of the weft yarn array relative to a weft inserting nozzle, and a second position between the weft supply member and the weft inserting nozzle.

36. A weft treatment method as claimed in claim 33, wherein the position discriminating step includes:

detecting the presence of the weft yarn on the side of the weft warp array relative to the weft inserting nozzle;

ejecting air jet from the weft inserting nozzle; and detecting unwinding of the weft yarn from the weft storage unit.

37. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn; and wherein said faulty weft yarn detecting step includes detecting breakage of the weft yarn at a position between the weft storage unit and a weft inserting nozzle.

38. A weft treatment method as claimed in claim 37, wherein further comprising blowing the weft yarn leading to the weft supply member toward the weft inserting nozzle upon stopping operation of the loom; sucking the blown weft yarn by a booster located near the weft inserting nozzle; and generating suction at the inlet of the weft inserting nozzle to suck the weft yarn from the booster upon stopping operation of the booster.

39. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn; and wherein said faulty weft yarn detecting step includes detecting breakage of the weft yarn at a position between the weft supply member and a weft inserting nozzle.

40. A weft treatment method as claimed in claim 39, further comprising cutting the weft yarn at a position between the weft insertion nozzle and the woven fabric; ejecting an air jet from the weft inserting nozzle upon a stopping of the operation of the loom so as to project the weft yarn passing through the weft inserting nozzle to reach a counter-weft picking side; and drawing the weft yarn projected from the weft inserting nozzle by a second weft traction device.

41. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn; and further comprising passing a weft yarn into the weft inserting nozzle after removal of said faulty weft yarn, said weft yarn passing step including ejecting air toward a weft inserting nozzle upon air ejection of the weft inserting nozzle; detecting projection of the weft yarn from the tip end of the weft inserting nozzle upon passing of the weft yarn through the weft inserting nozzle; stopping air ejection of the weft inserting nozzle upon detection of the weft yarn projection; sucking the weft yarn projected from the weft inserting nozzle tip end; and cutting the weft yarn upon sucking.

42. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn;

further comprising passing a weft yarn into the weft inserting nozzle after removal of said faulty weft yarn, said weft yarn passing step including ejecting air toward a weft inserting nozzle upon air ejection of the weft inserting nozzle; detecting projection of the weft yarn from the tip end of the weft inserting nozzle upon passing of the weft yarn through the weft inserting nozzle; stopping air ejection of the weft inserting nozzle upon detection of the weft yarn projection; sucking the weft yarn projected from the weft inserting nozzle tip end; and cutting the weft yarn upon sucking; and wherein said faulty weft yarn detecting step includes detecting breakage of the weft yarn at a position between the weft supply member and the weft storage unit.

43. A weft treatment method as claimed in claim 42, wherein said weft yarn drawing step includes blowing the weft yarn leading to the weft supply member, toward the weft supply member.

44. A weft treatment method as claimed in claim 43, wherein said weft yarn blowing is carried by a nozzle provided on a weft tensor located between the weft supply member and the weft storage unit.

45. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn;

wherein the step of reversely running the loom includes reversely rotating a loom main shaft; and further comprising the step of applying vibration to the weft yarn before said pulling step.

46. A weft treatment method for a fluid jet loom having a weft supply member and a weft storage unit including a weft winding arm and a drum, said method comprising the following steps in the sequence set forth:

detecting a faulty weft yarn;

stopping the operation of a cutter for weft yarn and operation of the loom;

reversely running the loom to expose the faulty weft yarn at a cloth fell of a woven fabric;

reversely rotating the weft winding arm around the drum to unwind the weft yarn wound on the drum;

drawing a weft yarn including said faulty weft yarn through said weft storage unit by a first weft traction device disposed between said weft storage unit and said weft supply member so as to remove said faulty weft yarn;

wherein the step of reversely running the loom includes reversely rotating a loom main shaft; and further comprising the step of applying vibration to the weft yarn during said pulling step.

* * * * *